US006837093B2

(12) United States Patent
Yamasaki et al.

(10) Patent No.: US 6,837,093 B2
(45) Date of Patent: Jan. 4, 2005

(54) METHODS FOR MAKING AN EASY-OPENING CAN END

(75) Inventors: Yuji Yamasaki, Fukuyama (JP); Masayoshi Kurihara, Fukuyama (JP); Masahisa Fujikake, Fukuyama (JP); Yoshinori Yomura, Fukuyama (JP); Reiko Sugihara, Fukuyama (JP); Yutaka Mihara, Tokyo (JP)

(73) Assignee: NKK Corporation, Tokyo (JP)

( * ) Notice: Subject to any disclaimer, the term of this patent is extended or adjusted under 35 U.S.C. 154(b) by 114 days.

(21) Appl. No.: 10/103,217

(22) Filed: Mar. 20, 2002

(65) Prior Publication Data

US 2002/0170913 A1 Nov. 21, 2002

Related U.S. Application Data

(62) Division of application No. 09/132,624, filed on Aug. 11, 1998, now abandoned.

(30) Foreign Application Priority Data

| | | |
|---|---|---|
| Aug. 12, 1997 | (JP) | 9-217349 |
| Sep. 11, 1997 | (JP) | 9-246673 |
| Sep. 11, 1997 | (JP) | 9-246674 |
| Sep. 11, 1997 | (JP) | 9-246675 |
| Sep. 11, 1997 | (JP) | 9-246676 |
| Dec. 26, 1997 | (JP) | 9-360778 |
| Dec. 26, 1997 | (JP) | 9-360779 |

(51) Int. Cl.[7] ..... B21D 51/44

(52) U.S. Cl. ..... 72/379.4; 413/16; 413/17

(58) Field of Search ..... 220/268, 269, 220/270, 265, 266, 906; 413/14, 15, 17, 56, 66, 67; 72/325, 379.4, 41

(56) References Cited

U.S. PATENT DOCUMENTS

| | | | | |
|---|---|---|---|---|
| 2,145,252 A | * | 1/1939 | Engle | 72/47 |
| 3,688,718 A | | 9/1972 | Schrecker | |
| 3,728,980 A | * | 4/1973 | Fraze | 72/325 |
| 3,875,884 A | | 4/1975 | Zundel | |
| 3,964,633 A | | 6/1976 | Zundel | |
| 3,967,753 A | | 7/1976 | Cudzik | |
| 4,012,935 A | * | 3/1977 | Holk et al. | 72/325 |
| 4,130,074 A | | 12/1978 | Cudzik | |
| 4,276,993 A | | 7/1981 | Hasegawa | |
| 4,318,493 A | | 3/1982 | Jacobsen et al. | |
| 4,504,181 A | | 3/1985 | Khoury | |
| 4,596,342 A | | 6/1986 | Zysset | |
| 5,248,053 A | | 9/1993 | Lundgren | |
| 5,497,896 A | | 3/1996 | Shand | |
| 5,770,290 A | | 6/1998 | McHenry et al. | |
| 5,927,536 A | | 7/1999 | Oyagi et al. | |
| 6,435,368 B1 | | 8/2002 | Yamanaka et al. | |

FOREIGN PATENT DOCUMENTS

| | | | | |
|---|---|---|---|---|
| DE | 2 126 067 | * | 11/1972 | 72/325 |
| EP | 0 542 104 A1 | | 5/1993 | |

(List continued on next page.)

*Primary Examiner*—Lowell A. Larson
(74) *Attorney, Agent, or Firm*—Frishauf, Holtz, Goodman & Chick, P.C.

(57) ABSTRACT

A method for making an easy-opening can end comprising providing an upper die and a lower die, at least one of the upper die and the lower die having a curved surface with a radius of 0.1 to 1 mm at the tip portion thereof, the other die having a flat surface at the tip portion thereof; and press-forming an end panel by using the upper die and the lower die to form a score on the upper surface or the lower surface of the end panel so that the end panel has a thickness of 0.025 to 0.08 mm at the thinnest portion thereof.

20 Claims, 28 Drawing Sheets

FOREIGN PATENT DOCUMENTS

| | | |
|---|---|---|
| JP | 55-10454 | 3/1980 |
| JP | 62-142746 | 6/1987 |
| JP | 62-235053 | 10/1987 |
| JP | 63-40439 | 10/1988 |
| JP | 2-179329 | 7/1990 |
| JP | 3-5890 | 1/1991 |
| JP | 3-57179 | 8/1991 |
| JP | 3-71500 | 11/1991 |
| JP | 3-71501 | 11/1991 |
| JP | 4-14169 | 3/1992 |
| JP | 5-40133 | 5/1993 |
| JP | 6-115546 | 4/1994 |
| JP | 6-115547 | 4/1994 |
| JP | 6-115548 | 4/1994 |
| JP | 8-99140 | 4/1996 |
| JP | 8-224626 | 9/1996 |
| JP | 9-99945 | 4/1997 |
| JP | 9-108756 | 4/1997 |

* cited by examiner

METHODS FOR MAKING AN EASY-OPENING CAN END

This is a division of application Ser. No. 09/132,624 filed Aug. 11, 1998, now abandoned.

BACKGROUND OF THE INVENTION

1. Field of the Invention

The present invention relates to an easy-opening can end used for beverage cans and food cans, which cans are opened by fracturing the opening section formed on the can end on the can, and relates to a making method thereof.

2. Description of the Related Arts

Easy-opening can ends are widely used as the lids of cans containing various kinds of drinks such as beer, juice, and coffee, to open the can by breaking the opening section formed on the can end by pressing the opening section with finger. Easy-opening can ends are roughly classified to the partial-open can ends used mainly in beverage cans, and the full-open can ends used mainly in food cans.

The partial-open can ends are further grouped into the pull-top tab can ends and the stay-on tab can ends. FIG. 8 shows a plan view of an example of the pull-top tab can ends. The procedure to open the pull-top tab can end illustrated in FIG. 8 is given below. That is, a tab 3 fixed to the center of a central panel section 8 made of a metal sheet such as steel or aluminum sheet as a part of a can end 1 using a rivet mechanism 9 is pulled up. With the resulted force of the lever rule, the working edge of the tab 3 pushes down a break-opening section 10 around which a score 2 for opening the can is formed on the central panel section 8. As a result, the score 2 for opening the can is broken. Further pull-up of the tab 3 results in separation of the broken opening section piece from the can end 1.

FIG. 9 shows a plan view of an example of the stay-on tab can ends. The procedure to open the stay-on tab can end illustrated in FIG. 9 is given below. That is, a tab 3 fixed to the center of a central panel section 8 structuring a can end 1 using a rivet mechanism 9 is pulled up. With the resulted force of the lever rule, the working edge of the tab 3 pushes down a break-opening section 10 around which a score 2 for opening the can is formed on the central panel section 8. As a result, the score 2 for opening the can is broken. Further pull-up of the tab 3 propagates the breaking, thus pushing a portion of the resulted broken opening section piece into the can while the piece is kept connected with the can end 1.

Since the full-open can end has a score for opening the can along the outer periphery of the can end, pull-up of the tab fixed to the panel at near outer periphery of the can end allows the opening section piece to separate from the can end, as in the case of pull-top can end.

As illustrated in the prior art illustration FIG. 10, the formation of a score for opening the can in an easy-opening can end in the prior art is performed by press-forming using a working tool 12 which has a knife-edge protrusion having a specified profile of the opening section and by applying a heavy load to form the score for opening the can with score depths of half or more of the thickness of the can end plate 13 from the upper surface of the can end, thus giving the score 11 in a V-shape cross section.

The pull-up force of the conventional tabs described above for opening the easy-opening cans needs a large power, and child or aged person cannot easily open the cans.

There have been proposed several means to solve the above-described problems which arose in forming a score for opening the can by pressing down the working tool having a knife-edge shape protrusion, in, for example, JP-B-55-10454 (the term "JP-B-" herein referred signifies the "examined" Japanese patent publication"), JP-B-3-71500, JP-B-3-71501. All of these proposals, however, failed to sufficiently reduce the pull-up force of the tab.

Furthermore, JP-B-3-5890, JP-A-62-235053 (the term "JP-A-" herein referred signifies the "unexamined Japanese patent publication"), and JP-A-2-179329 disclose means to combine the thickness-reduction working and the working from inside of the can end to reduce the pull-up force of tab. Even these means do not sufficiently reduce the pull-up force of tab.

JP-A-8-224626 discloses a means to form a score for opening the can with a different shape from V-shaped score by combining compression, tension, and shearing works. The means, however, does not use a wrinkle-prevention press-plate so that the material in the vicinity of the forming section is subjected to tensile deformation during punch-pressing step, which generates reduction in sheet thickness, ending in degraded rigidity, and failing to concentrate the deformation to the score portion during opening step, and failing to fully reduce the can-opening force.

Since the formation of a score for opening the can is conducted using a working tool and under a heavy load of press machine, a can end made of a steel sheet coated by resin layer on both sides thereof induces damage on the resin coating layers on both sides of the can end during the press-forming stage, thus degrading the corrosion resistance of the can. Accordingly, to prevent the degradation of corrosion resistance, repair coating is requested after the press-forming, which requires excess amount of man-hour and cost.

There has recently been introduced an aluminum that does not generate rust even when the resin coating layer is damaged. The use of aluminum, however, increases cost and raises a problem in resource recycling.

As a means to solve the above-described problems encountered during the formation of a score for opening the can on a can end made of surface-treated steel sheet coated by resin layer, a method to form a score for opening the can by composite extrusion process is disclosed in JP-A-6-115546, JP-A-6-115547, and JP-A-6-115548. According to the disclosure, the score for opening the can is formed by the composite extrusion process so that the resin coated layer is not damaged and that no repair coating is required. The disclosure, however, does not give detailed description on the working conditions of the composite extrusion and on the score shape, thus it is difficult to judge the reproducibility of the stable score for opening the can.

JP-A-8-99140 discloses a method of forming a score by hot-working between upper and lower dies having shoulder radius ranging from 0.1 to 1.0 mm to attain thickness at the thinnest portion to half or less of the original thickness. The use of dies having radius ranging from 0.1 to 1.0 mm is effective against the damage of resin coating layer. The can-opening force is determined by the absolute value of the thickness at the thinnest portion, so even the values of thickness less than half the original one do not necessarily give good can-openability.

Examined Japanese utility model publication No. 63-40439 discloses the formation of a concavity for finger-insertion beneath the finger-picking section of the tab and on the central panel section aiming to broaden the gap between the central panel section of the can end and the finger-picking section of the tab for assuring easy insertion of finger and easy holding of the finger-picking section. Unexamined Japanese utility model publication No. 5-40133 discloses a structure for easy insertion of finger into a gap between the central panel section of the can end and the finger-picking section of the tab and for easy holding of the finger-picking section. According to the disclosure, a tab is fixed by a rivet in a manner that the tab is allowed to rotate to move from a disabled-opening position with an off-set between the center axis of the tab and the center axis of the break-opening section to an enabled-opening position with coincident center axes therebetween, thus the finger-picking section of the tab is lifted by a tapered protrusion formed on the central panel section between the rivet and the finger-picking section of the tab during the movement of the tab from the disabled-opening position to the enabled-opening position.

According to the above-described can end, a formed concavity for finger insertion or a formed tapered protrusion assures easy insertion of finger into a gap between the central panel section of the can end and the finger-picking section of the tab and easy holding of the finger-picking section compared with the can end having no concavity or tapered protrusion. Nevertheless, the pull-up force for opening the can does not differ between these cases, so the reduction in can-opening force is not attained.

Aluminum alloys are used as can lids in recent years rather than steel sheets owing to the soft in rigidity and the favorable can-openability compared with the steel sheets. The use of aluminum alloys, however, is not preferable because they increase cost than in the case of steel sheets. In addition, when the can shell is made of a steel sheet and only the can lid is made of aluminum plate, galvanic cell is formed to enhance corrosion of can depending on the contents of the can, which may result in pin-hole occurrence in a short time.

Furthermore, for efficient implementation of resource recycling which is promoted from the point of global environment conservation, a single material can structure is preferred. In this respect, development of an easy-opening can made of steel sheet that assures good can-openability is wanted.

Responding to these problems, studies were conducted on the steel sheets for can lids to improve the can-openability of the steel sheet easy-opening can lids in terms of base material. For example, JP-A-62-142746 discloses technology to improve the can-openability by limiting the thickness, yield point, and tensile strength of steel sheet within a specific range. JP-B-4-14169 discloses technology of manufacturing method of can lid to improve the can-openability by limiting the composition, thickness, yield point, and tensile strength of steel sheet within a specific range. JP-A-62-142746 and JP-B-4-14169, however, do not consider the material quality change resulted from work-hardening occurred during the score-forming step. In addition, JP-B-3-57179 discloses technology to improve the can-openability by suppressing the increase in strength at the score-forming section and by decreasing the elongation at the section through the limitation of the composition and hardness (HR30T) of the steel sheet in a specified range. Reduction in elongation, however, raises a problem to make the rivet working during lid-manufacturing step difficult.

SUMMARY OF THE INVENTION

It is an object of the present invention is to provide an easy-opening can end having excellent can-openability, of which can end the can-opening force is stably reduced, and child or aged person is able to easily open the can, and to provide a method for making the same.

To attain the object, first, the present invention provides an easy-opening can end comprising a score having a specified cross section and a end panel having a specified thickness at the thinnest portion thereof.

When the score exists on an upper surface or a lower surface of the end panel, the cross section of the score has a curved surface having a radius of 0.01 to 1 mm and the end panel has a thickness of 0.025 to 0.08 mm at the thinnest portion thereof.

When the score exists on an upper surface and a lower surface of the end panel, the cross section of the score has a curved surface having a radius of 0.025 to 1 mm and the end panel has a thickness of 0.025 to 0.08 mm at the thinnest portion thereof.

An method for making the above mentioned easy-opening can end comprises the steps of providing an upper die and a lower die, and press-forming an end panel by using the upper die and the lower die to form a score on a surface of the end panel.

When the score is formed on an upper surface or a lower surface of the end panel, either the upper die or the lower die has a curved surface with a radius ranging from 0.1 to 1 mm at the tip portion thereof and the other die has a flat surface at the tip portion thereof. The end panel is press-formed to form a score on the upper surface or the lower surface by using the upper die and the lower die so that the end panel has a thickness of 0.025 to 0.08 mm at the thinnest portion thereof.

When the scores are formed on an upper surface and a lower surface of the end panel, the upper die and the lower die have a curved surface with a radius ranging from over 0.025 to 1 mm at the tip portion thereof. The end panel is press-formed to form scores on the upper surface and the lower surface by using the upper die and the lower die so that the end panel has a thickness of 0.025 to 0.08 mm at the thinnest portion thereof.

Secondly, the present invention provides an easy-opening can end comprising: an end panel having an upper surface and a lower surface; a score which is formed on at least one surface of the upper surface and the lower surface; a tab having a finger grasping portion, said tab being attached to the can end panel and being rotatable around tab-fastening means; and a slope protrusion for lifting the tab to above a height of a seam portion when the tab is rotated to a position for allowing the can open.

The tab-fastening means is positioned offset by a distance "a" expressed in the following equation from the center of the can end to the opposite side of an openable section.

$$(D-d)/2<a<d/2-l$$

The finger grasping portion has a distance "L" from the tab-fastening means, the distance "L" being defined by the following equation.

$$d-l>L>d/2-a$$

The tab has a first center line before rotation thereof and a second center line at an opening position, the first center line and the second line having an angle "θ" therebetween which is within a range defined by the equation.

$$-1<\cos\theta<1/(2\times a\times L)\times\{(d/2)^2-(L^2+a^2)\}$$

In the above equations, "a" is the distance between the center of the tab-fastening means and the center of can end, "L" is the distance between the center of the tab-fastening means and the finger grasping portion on the tab, "l" is the distance between the center of the tab-fastening means and a tab working section, "θ" the angle between the center line of tab before rotation and the center line at opening position, "d" the inner diameter of the can end, and "D" the outer diameter of the can end.

When the score exists on an upper surface or a lower surface of the end panel, the cross section of the score has a curved surface having a radius of 0.01 to 1 mm and the end panel has a thickness of 0.025 to 0.12 mm at the thinnest portion thereof.

When the score exists on an upper surface and a lower surface of the end panel, the cross section of the score has a curved surface having a radius of over 0.025 to 1 mm and the end panel has a thickness of 0.025 to 0.12 mm at the thinnest portion thereof.

Thirdly, the present invention provides an easy-opening can end comprising: an end panel comprising a steel sheet and resin film layers on an upper surface and a lower surface of the steel sheet; and a score which is formed on at least one surface of the upper surface and the lower surface of the end panel. The score has a cross section of a curved surface having a radius of 0.1 to 1 mm, and the end panel has a thickness of 0.025 to 0.08 mm at the thinnest portion thereof.

A method for making the easy-opening can end comprises the steps of: providing an end panel comprising a steel sheet and resin film layers on an upper surface and a lower surface of the steel sheet; providing an upper die and a lower die; and press-forming the end panel by using the upper die and the lower die to form a score on at least one surface of the upper surface and the lower surface of the end panel.

The at least one of the upper die and the lower die has a curved surface with a radius ranging from 0.1 to 1 mm at the tip portion thereof. The end panel is press-formed so that the end panel has a thickness of 0.025 to 0.08 mm at the thinnest portion thereof.

Fourthly, the present invention provides an easy-opening can end comprising: an end panel comprising a steel sheet and resin film layers on an upper surface and a lower surface of the steel sheet; a score which is formed on at least one surface of the upper surface and the lower surface of the end panel; a tab having a finger grasping portion, said tab being attached to the can end panel and being rotatable around tab-fastening means; and a slope protrusion for lifting the tab to above a height of a seam portion when the tab is rotated to a position for allowing the can open.

The tab-fastening means is positioned offset by a distance "a" expressed in the following equation from the center of the can end to the opposite side of an openable section:

$$(D-d)/2<a<d/2-l$$

The finger grasping portion has a distance "L" from the tab-fastening means, the distance "L" being defined by the following equation:

$$d-l>L>d/2-a$$

The tab has a first center line before rotation thereof and a second center line at an opening position, the first center line and the second line having an angle "θ" therebetween which is within a range defined by the equation:

$$-1<\cos\theta<1/(2\times a\times L)\times\{(d/2)^2-(L^2+a^2)\}$$

In the above equations, "a" is the distance between the center of the tab-fastening means and the center of can end, "L" is the distance between the center of the tab-fastening means and the finger grasping portion on the tab, "l" is the distance between the center of the tab-fastening means and a tab working section, "θ" the angle between the center line of tab before rotation and the center line at opening position, "d" the inner diameter of the can end, and "D" the outer diameter of the can end.

The score has a cross section of a curved surface having a radius of 0.1 to 1 mm, and the end panel has a thickness of 0.025 to 0.12 mm at the thinnest portion thereof.

Fifthly, the present invention provides an easy-opening can end comprising: a end panel comprising a steel sheet having a tensile strength (TS) of 30 to 45 kgf/mm$^2$ and a work-hardening coefficient (n-value) of 0.15 to 0.2; and a score which is formed on at least one surface of an upper surface and a lower surface of the end panel.

Sixthly, the present invention provides a method for making an easy-opening can end comprising the steps of:

providing a end panel comprising a metal sheet having a thickness of $t_0$ (mm), a work-hardening coefficient of n in a 40 to 90% range of uniform elongation region and a tensile strength of TS (kgf/mm$^2$);

providing an upper die and a lower die; and press-forming the end panel by using the upper die and the lower die to form a score on the end panel.

The press-formed can end panel has a thickness t (mm) at the thinnest portion thereof, the thickness t (mm) satisfying the following equations.

$$2.5\leqq P\leqq 5.0$$

$$P=t\times TS\times\{\exp(n)/(n^n)\}\times[2/\sqrt{3}\times|\ln(1+(t-t_0)/t_0\}|]^n$$

When the score is formed on an upper surface or a lower surface of the end panel, either the upper die or the lower die has a curved surface with a radius ranging from over 0.025 to 1 mm at the tip portion thereof and the other die has a flat surface at the tip portion thereof.

When the scores are formed on an upper surface and a lower surface of the end panel, the upper die and the lower die have a curved surface with a radius ranging from over 0.025 to 1 mm at the tip portion thereof.

Seventhly, the present invention provides a method for making an easy-opening can end comprising the steps of: providing a end panel comprising a steel sheet having a thickness of $t_0$ (mm), a work-hardening coefficient of n in a 40 to 90% range of uniform elongation region and a tensile strength of TS (kgf/mm$^2$) and resin film layers on both sides of the steel sheet;

providing an upper die and a lower die; and press-forming the end panel by using the upper die and the lower die to form score on the end panel.

The press-formed can end panel has a thickness t (mm) at the thinnest portion thereof, the thickness t (mm) satisfying the following equations.

$$2.5\leqq P\leqq 5.0$$

$$P=t\times TS\times\{\exp(n)/(n^n)\}\times[2/\sqrt{3}\times|\ln(1+(t-t_0)/t_0\}|]^n$$

When the score is formed on an upper surface or a lower surface of the end panel, either the upper die or the lower die has a curved surface with a radius ranging from 0.1 to 1 mm at the tip portion thereof and the other die has a flat surface at the tip portion thereof.

When the scores are formed on an upper surface and a lower surface of the end panel, the upper die and the lower die have a curved surface with a radius ranging from 0.1 to 1 mm at the tip portion Eighthly, the present invention provides a method for making an easy-opening can end comprising the steps of:

providing a end panel comprising a metal sheet having a thickness of $t_0$ (mm), a work-hardening coefficient of n in a 40 to 90% range of uniform elongation region and a tensile strength of TS (kgf/mm$^2$);

providing an upper die and a lower die;

press-forming the end panel by using the upper die and the lower die to form score on the end panel;

attaching a tab having a finger grasping portion to the can end panel rotatably around tab-fastening means;

arranging a slope protrusion for lifting the tab to above a height of a seam portion when the tab is rotated to a position for allowing the can open.

In forming a score on an upper surface or a lower surface of the end panel, either the upper die or the lower die has a curved surface with a radius ranging from over 0.025 to 1 mm at the tip portion thereof and the other die has a flat surface at the tip portion thereof.

In forming scores on an upper surface and lower surface of the end panel, the upper die and the lower die have a curved surface with a radius ranging from over 0.025 to 1 mm at the tip portion thereof.

The press-formed can end panel has a thickness t (mm) at the thinnest portion thereof, the thickness t (mm) satisfying the following equations:

$$5<P\leqq 7.0$$

$$P=t\times TS\times\{\exp(n)/(n^n)\}\times[2/\sqrt{3}\times|\ln(1+(t-t_0)/t_0\}|]^n$$

The tab-fastening means is positioned offset by a distance "a" expressed in the following equation from the center of the can end to the opposite side of an openable section:

$$(D-d)/2<a<d/2-l$$

The finger grasping portion has a distance "L" from the tab-fastening means, the distance "L" being defined by the following equation:

$$d-l>L>d/2-a$$

The tab has a first center line before rotation thereof and a second center line at an opening position, the first center line and the second line having an angle "θ" therebetween which is within a range defined by the equation:

$$-1<\cos\theta<1/(2\times a\times L)\times\{(d/2)^2-(L^2+a^2)\}$$

In the above equations, "a" is the distance between the center of the tab-fastening means and the center of can end, "L" is the distance between the center of the tab-fastening means and the finger grasping portion on the tab, "l" is the distance between the center of the tab-fastening means and a tab working section, "θ" the angle between the center line of tab before rotation and the center line at opening position, "d" the inner diameter of the can end, and "D" the outer diameter of the can end.

Ninthly, the present invention provides a method for making an easy-opening can end comprising the steps of:

providing a end panel comprising a metal sheet having a thickness of $t_0$ (mm), a work-hardening coefficient of n in a 40 to 90% range of uniform elongation region and a tensile strength of TS (kgf/mm$^2$) and resin film layers on both sides of the steel sheet;

providing an upper die and a lower die;

press-forming the end panel by using the upper die and the lower die to form score on the end panel;

attaching a tab having a finger grasping portion to the can end panel rotatably around tab-fastening means; and arranging a slope protrusion for lifting the tab to above a height of a seam portion when the tab is rotated to a position for allowing the can open.

In forming a score on an upper surface or a lower surface of the end panel, either the upper die or the lower die has a curved surface with a radius ranging from over 0.1 to 1 mm at the tip portion thereof and the other die has a flat surface at the tip portion thereof.

In forming scores on an upper surface and lower surface of the end panel, the upper die and the lower die have a curved surface with a radius ranging from over 0.1 to 1 mm at the tip portion thereof.

The press-formed can end panel has a thickness t (mm) at the thinnest portion thereof, the thickness t (mm) satisfying the following equations;

$$5<P\leqq 7.0$$

$$P=t\times TS\times\{\exp(n)/(n^n)\}\times[2/\sqrt{3}\times|\ln(1+(t-t_0)/t_0\}|]^n$$

The tab-fastening means is positioned offset by a distance "a" expressed in the following equation from the center of the can end to the opposite side of an openable section:

$$(D-d)/2<a<d/2-l$$

The finger grasping portion has a distance "L" from the tab-fastening means, the distance "L" being defined by the following equation:

$$d-l>L>d/2-a$$

The tab has a first center line before rotation thereof and a second center line at an opening position, the first center line and the second line having an angle "θ" therebetween which is within a range defined by the equation:

$$-1<\cos\theta<1(2\times a\times L)\times\{(d/2)^2-(L^2+a^2)\}$$

In the above equations, "a" is the distance between the center of the tab-fastening means and the center of can end, "L" is the distance between the center of the tab-fastening means and the finger grasping portion on the tab, "l" is the distance between the center of the tab-fastening means and a tab working section, "θ" the angle between the center line of tab before rotation and the center line at opening position, "d" the inner diameter of the can end, and "D" the outer diameter of the can end.

BRIEF DESCRIPTION OF THE DRAWINGS

FIG. 3(*b*) is a plan view of an easy-opening can end after rotating the tab according to the Embodiment 1.

FIG. 30 is a plan view of an easy-opening can end formed on the can end according to the Embodiment 6.

DESCRIPTION OF THE EMBODIMENT

Embodiment 1

Figure 1:
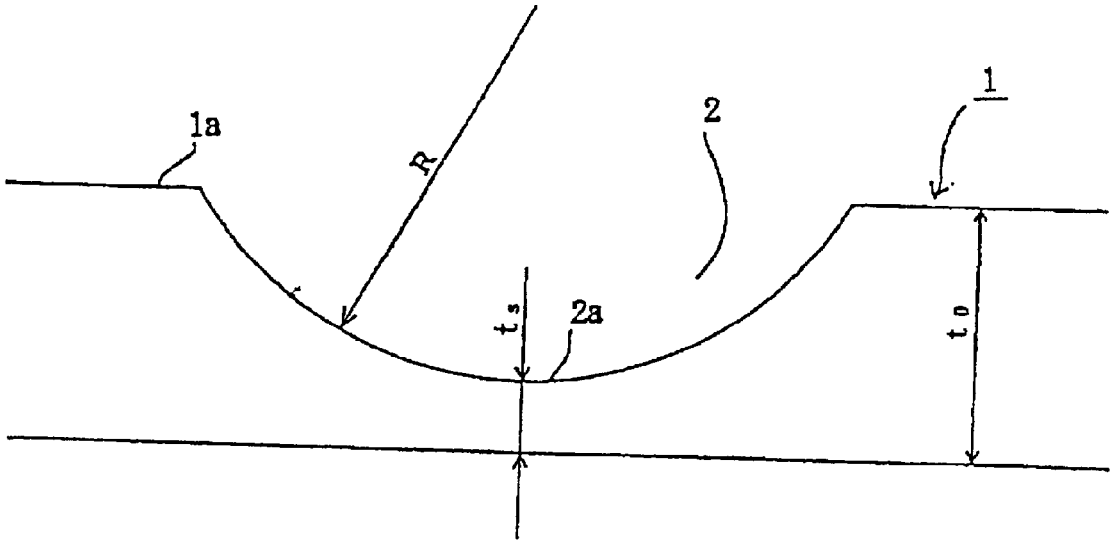
FIG. 1 is a cross sectional view of a score portion formed on the can end according to the Embodiment 1.

In the past, the fracture of score occurred in opening the can was understood being resulted from shear deformation. So the shape of the score for opening the can was designed on the basis of the concept. The study made by the inventors of the present invention, however, revealed that the fracture of score for opening the can is caused mainly by tensile deformation, not by shear deformation, and that the most effective way of reduction of can-opening force is to minimize the absolute value of thickness of the thinnest portion of the score for opening the can.

The embodiment 1 was completed on the basis of the above-described findings. The embodiment 1 provides an easy-opening can end comprising a score having a specified cross section and a end panel having a specified thickness at the thinnest portion thereof.

When the score exists on an upper surface or a lower surface of the end panel, the cross section of the score has a curved surface having a radius of 0.01 to 1 mm and the end panel has a thickness of 0.025 to 0.08 mm at the thinnest portion thereof.

When the score exists on an upper surface and a lower surface of the end panel, the cross section of the score has a curved surface having a radius of 0.025 to 1 mm and the end panel has a thickness of 0.025 to 0.08 mm at the thinnest portion thereof.

An method for making the above mentioned easy-opening can end comprises the steps of providing an upper die and a lower die, and press-forming an end panel by using the upper die and the lower die to form a score on a surface of the end panel.

When the score is formed on an upper surface or a lower surface of the end panel, either the upper die or the lower die has a curved surface with a radius ranging from 0.1 to 1 mm at the tip portion thereof and the other die has a flat surface at the tip portion thereof. The end panel is press-formed to form a score on the upper surface or the lower surface by using the upper die and the lower die so that the end panel has a thickness of 0.025 to 0.08 mm at the thinnest portion thereof.

When the scores are formed on an upper surface and a lower surface of the end panel, the upper die and the lower die have a curved surface with a radius ranging from over 0.025 to 1 mm at the tip portion thereof. The end panel is press-formed to form scores on the upper surface and the lower surface by using the upper die and the lower die so that the end panel has a thickness of 0.025 to 0.08 mm at the thinnest portion thereof.

The easy-opening can end according to the Embodiment 1 and the method for making the same are explained in more detail referring to the drawings.

FIG. 1 shows an easy-opening can end according to the Embodiment 1. FIG. 1 is a cross sectional view of the score for opening the can formed on the can end. As shown in FIG. 1, a score 2 is formed on the upper surface 1*a* of the can end 1 having a thickness of to, which score 2 has a curved shape cross section having a radius (R) ranging from 0.01 to 1.0 mm and having a thickness ($t_s$) at the thinnest portion 2*a* ranging from 0.025 to 0.080 mm.

Figure 2:
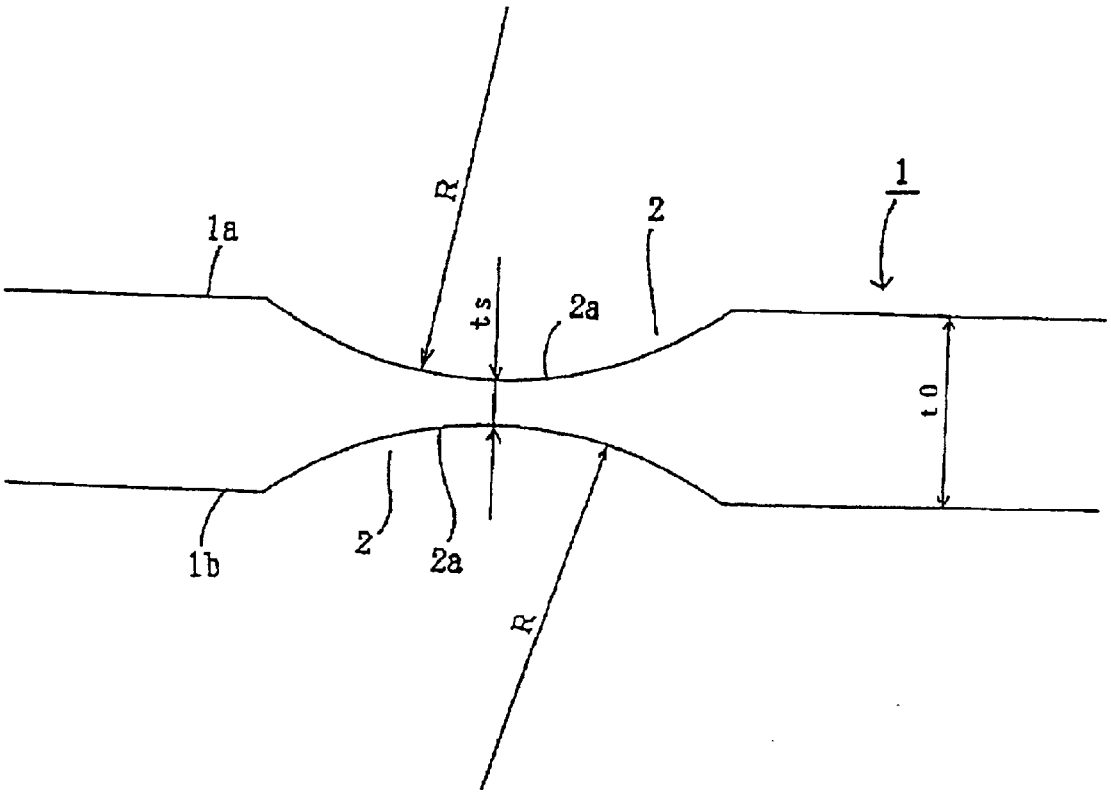
FIG. 2 is another cross sectional view of a score portion formed on the can end according to the Embodiment 1.

FIG. 2 is another cross sectional view of the score for opening the can formed on the can end. As shown in the figure, scores 2, 2 for opening the can are formed on the upper surface 1*a* and the lower surface 1*b* of the can end 1 having a thickness of $t_0$, which scores 2, 2 have curved shape cross sections having a radius (R) ranging from over 0.025 mm to 1.0 mm and having the values of thickness ($t_s$) at the thinnest portion 2*a* ranging from 0.025 to 0.080 mm.

Owing to the score 2 having a curved shape with the radius (R) on the upper surface 1*a* or on both of the upper surface 1*a* and the lower surface 1*b* of the can end 1, the can-opening force is stably reduced to a level that child or aged person is able to easily open the can, while preventing the generation of shock fracture.

For the case that the score 2 for opening the can is formed only on the upper surface 1*a* of the can end 1, provided by the radius (R) of the bottom cross section of the score 2 for opening the can being less than 0.01 mm, or for the case that the score 2 of the bottom cross section is formed on both of the upper surface 1*a* and the lower surface 1*b* of the can end, provided by the bottom cross sectional radius (R) of each score 2 being equal to or less than 0.025 mm, the working accuracy of the dies to form the above-described score 2 on the can end panel degrades, and the abrasion of the dies induced by the forming work appears in an early working time, so a problem of difficulty in maintaining the die shape during the successive forming cycles arises.

On the other hand, when the bottom cross sectional radius (R) of the above-described score 2 for opening the can exceeds 1.0 mm, the area of thin-thickness section on the can end 1 increases to make the breaking position of the opening section unstable, which results in poor shape of opening and induces a problem of increased "sagging", or a portion of the broken section hangs down. It is also practically impossible to form a score 2 for opening the can with widths wider than 1.0 mm on a can end panel having a limited space.

If the thickness of the thinnest portion 2*a* on the score 2 for opening the can is less than 0.025 mm, the can end panel may be broken. If a can with that kind of can end panel is dropped or is subjected to external shock, the opening section may be fractured. On the other hand, if the thickness of the thinnest portion 2*a* on the score 2 for opening the can exceeds 0.080 mm, then a problem of needing a large can-opening force arises.

Consequently, the bottom cross sectional shape of the score for opening the can formed on the upper surface or the lower surface of the can end is necessary to have a curved surface having a radius ranging from 0.01 to 1.0 mm and having a thickness at the thinnest portion ranging from 0.025 to 0.080 mm, and the bottom cross sectional shape of the score for opening the can formed on each side of the can end is necessary to have a curved surface having a radius ranging from more than 0.025 mm and not more than 1.0 mm and a thickness at the thinnest portion ranging from 0.025 to 0.080 mm. From the viewpoint of maintaining the shape, the radius of curvature of the score for opening the can is preferably 0.05 mm or more.

The can end described in FIG. 1 may be formed by using a pair of dies one of which having a curved surface with a tip in a curved surface with radius ranging from 0.01 to 1.0 mm and other of which having a flat surface, by applying the press forming method to a can end panel into a shape having a thickness at the thinnest portion ranging from 0.025 to 0.080 mm. The can end described in FIG. 2 may be formed by using a pair of dies both of which having a curved surface with a tip in a curved surface with radius ranging from more than 0.025 mm and not more than 1.0 mm, respectively, by applying the press forming method to a can end panel into a shape having a thickness at the thinnest portion ranging from 0.025 to 0.080 mm. The reason why the dimensions and shape of the dies are selected as described one is to form a score for opening the can having the dimensions described above on the can end. The reason for limiting the dimensions and shape of the score for opening the can is described above.

Figure 8:
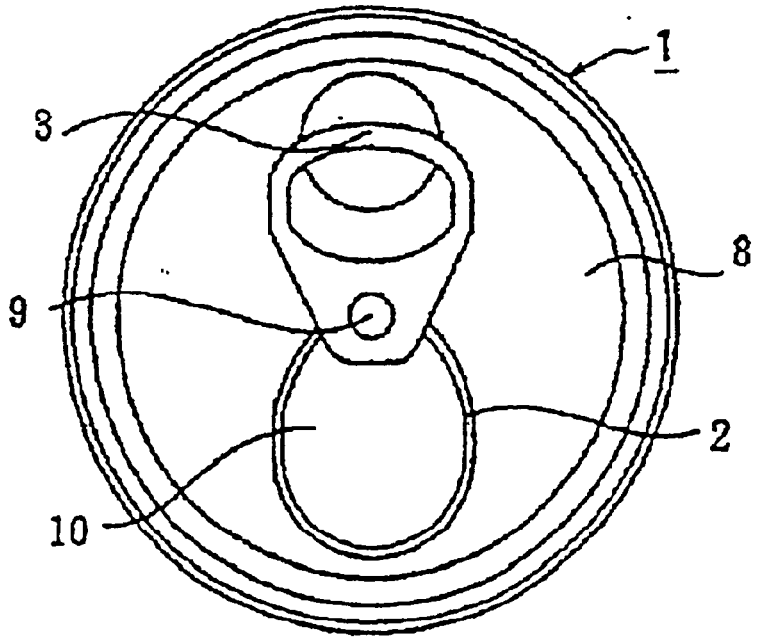
FIG. 8 is a plan view of a pull-top tab can end.
Figure 9:
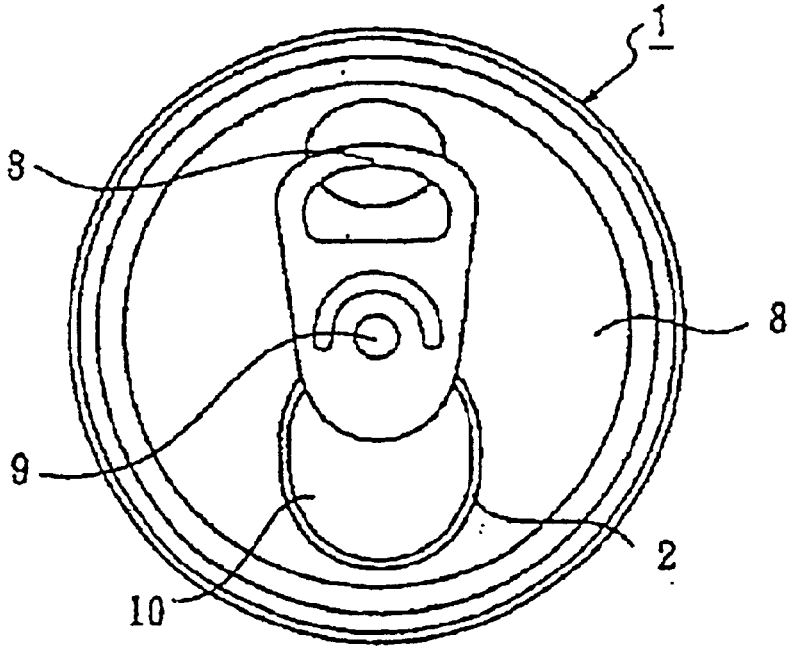
FIG. 9 is a plan view of a stay-on tab can end.

The can end having a score for opening the can with the above-described curved surface cross sectional shape according to the present invention is applicable to both the pull-top tab can end shown in FIG. 8 and the stay-on tab can end shown in FIG. 9.

Figure 3A:
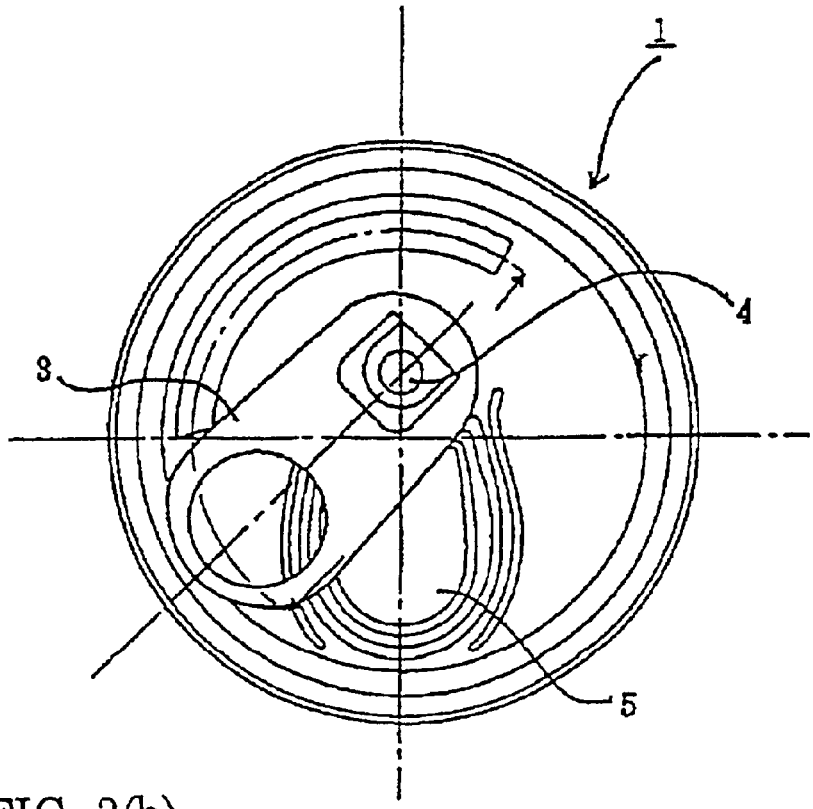
FIG. 3(*a*) is a plan view of an easy-opening can end before rotating the tab according to the Embodiment 1.
Figure 3B:
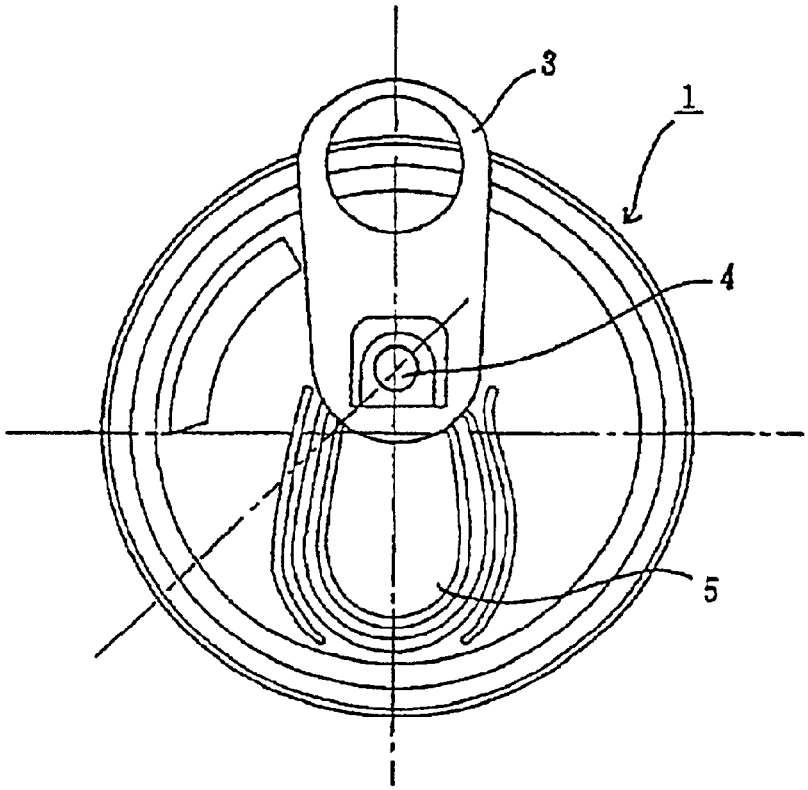

Alternatively, as shown in FIG. 3(*a*), if the tab 3 is attached to the can end 1 in a manner that the tab-fastening mean 4 is at an off-set position against the center of the can end 1 toward the opposite side of the opening section 5 to allow the tab 3 to rotate around the tab-fastening mean 4, while lengthening the distance between the tab-fastening mean 4 on the tab 3 and the tip of the tab to some degree compared with the conventional length, thus increasing the generated force at the working point. Under the configuration, when the tab 3 is rotated to the enabled-opening position as shown in FIG. 3(*b*), the can-opening force is further reduced if only the score for opening the can having the curved surface shape according to the present invention is formed on the can end on which the turning of the tab 3 to an enabled-opening position brings the pick-up edge of the tab 3 to outside of the outer periphery of the can end.

Generally, the materials of can end are aluminum sheet or surface-treated steel sheet coated with a metal, having a thickness ranging from 0.15 to 0.30 mm.

EXAMPLE 1

A tin-free steel sheet was prepared from a thin steel sheet having a thickness of 0.25 mm and a tensile strength of 440 MPa by forming a chromate coating layer on the upper surface thereof, which chromate coating layer consists of a chromated metal chromium layer with a coating weight of 120 mg/m$^2$ and of a top layer of chromium oxide hydrate with a coating weight of 15 mg/m$^2$ as metallic chromium. To the steel sheet, a pair of dies one of which has a curved surface with tip radius ranging from 0.1 to 1.0 mm while the other has a flat surface were applied using the method according to the present invention, thus press-formed the can end panel to give a thickness at the thinnest portion ranging from 0.025 to 0.080 mm, to form the score for opening the can on the surface of the can end panel. As a result, the test samples No. 1 through No. 11 for stay-on tab easy-opening can ends within a range specified by the present invention were prepared. (Hereinafter these test samples are referred to as the test samples of the present invention.)

Figure 4:
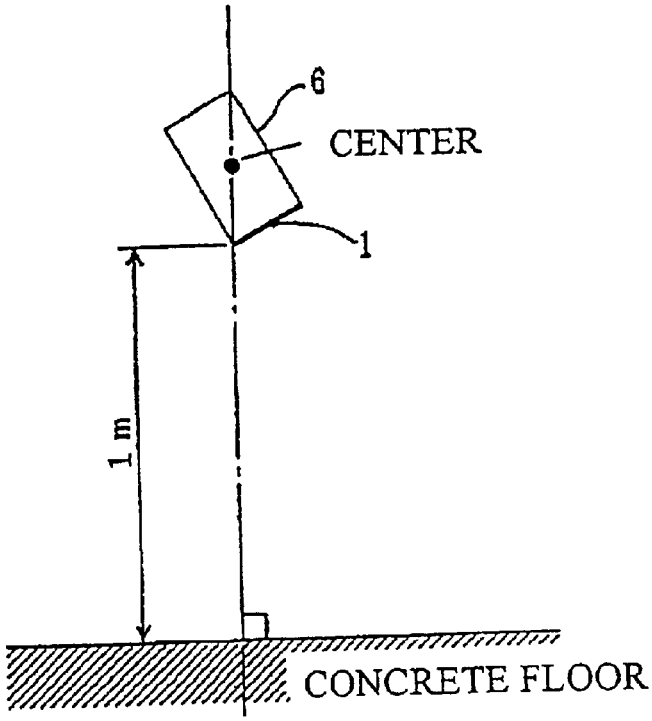
FIG. 4 is an explanation view to illustrate the method of shock test.
Figure 5:
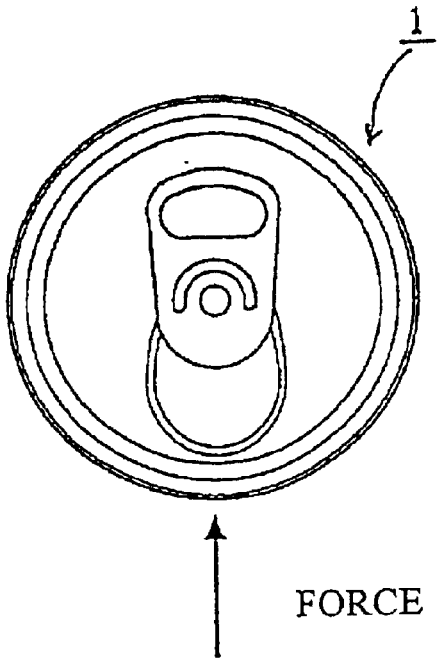
FIG. 5 is an explanation view to illustrate the position of applying shock against a can end.

Each of the can ends prepared from above-described samples of the present invention and comparative samples was attached to a shell of 350 ml can containing commercially available soda water, and the can was sealed. Pop value (kg) of the can 6 containing soda water, (the force that the opening section of the can end begins to open under a specified pulling force applied to the tab on the can) was determined. Shock fracture was evaluated by the presence/absence of shock fracture when a can 6 is dropped from 1 m above the concrete floor against the floor in a slanted position of the can facing the can end 1 downward, as shown in FIG. 4, to apply a shock force to the can end 1 in arrow direction in FIG. 5. The result is also shown in Table 1.

As seen in Table 1, the comparative test samples Nos. 1, 3, 5 through 8, and 10 which had smaller thickness at the thinnest portion on cross sectional curved shape of the score for opening the can than the range according to the present invention generated shock fracture. The comparative test samples Nos. 2, 4, 9, and 11 which had larger thickness at the thinnest portion on the score for opening the can than the range specified by the present invention gave large Pop values ranging from 2.8 to 3.0 kg, and gave poor can-openability.

The comparative test samples Nos. 14 and 16 which had larger radius (R) of the score for opening the can than the range specified by the present invention gave low Pop values and generated no shock fracture, but gave poor can-openability. The comparative test samples Nos. 12, 13, and 15 which had larger radius (R) of score for opening the can and smaller value of thickness at the thinnest portion than the range specified by the present invention generated shock fracture and resulted in poor opening section shape.

To the contrary, all the samples of the present invention gave Pop values of 2.6 or less, and gave no shock fracture, and gave good shape of opening section.

TABLE 1

| No. | | Die radius (mm) | Sheet thickness at the thinnest portion (mm) | Pop value (kg) | Shock fracture |
|---|---|---|---|---|---|
| Sample of the present invention | 1 | 0.025 | 0.025 | 1.0 | Absence |
| | 2 | 0.100 | 0.050 | 1.5 | Absence |
| | 3 | 0.100 | 0.080 | 2.4 | Absence |
| | 4 | 0.200 | 0.025 | 0.9 | Absence |
| | 5 | 0.500 | 0.025 | 1.1 | Absence |
| | 6 | 0.800 | 0.025 | 1.1 | Absence |
| | 7 | 0.800 | 0.050 | 1.3 | Absence |
| | 8 | 0.800 | 0.080 | 2.5 | Absence |
| | 9 | 1.000 | 0.025 | 1.1 | Absence |
| | 10 | 1.000 | 0.050 | 1.6 | Absence |
| | 11 | 1.000 | 0.080 | 2.6 | Absence |
| Comparative test sample | 1 | 0.010 | 0.020 | 0.8 | Presence |
| | 2 | 0.010 | 0.100 | 2.8 | Absence |
| | 3 | 0.080 | 0.020 | 0.9 | Presence |
| | 4 | 0.080 | 0.100 | 2.8 | Absence |
| | 5 | 0.100 | 0.020 | 0.8 | Presence |
| | 6 | 0.200 | 0.020 | 0.7 | Presence |
| | 7 | 0.500 | 0.020 | 0.9 | Presence |
| | 8 | 0.800 | 0.020 | 1.0 | Presence |
| | 9 | 0.800 | 0.100 | 2.8 | Absence |
| | 10 | 1.000 | 0.020 | 0.9 | Presence |
| | 11 | 1.000 | 0.100 | 3.0 | Absence |
| | 12 | 1.200 | 0.020 | 1.0 | Presence |
| | 13 | 1.200 | 0.020 | 1.1 | Presence |
| | 14 | 1.200 | 0.025 | 1.1 | Absence |
| | 15 | 1.500 | 0.020 | 0.9 | Presence |
| | 16 | 1.500 | 0.025 | 1.0 | Absence |

EXAMPLE 2

Figure 6:
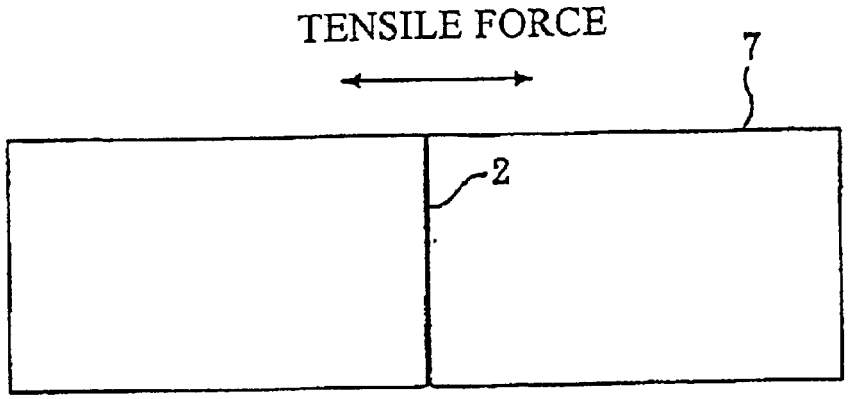
FIG. 6 is a plan view of a tensile test piece.

Two sheets of tin-free steel sheets were prepared from two sheets of thin steel sheets each having a thickness of 0.25 mm and a tensile strength of 290 MPa and 440 MPa, respectively, by forming a chromate coating layer on the upper surface thereof, which chromate coating layer consists of a chromated metal chromium layer with a coating weight of 120 mg/m$^2$ and of an upper layer of chromium oxide hydrate with a coating weight of 15 mg/m$^2$ as metallic chromium. To the steel sheet, a pair of dies one of which has a curved surface with tip radius ranging from 0.01 to 1.0 mm while the other has a flat surface were applied using the method according to the present invention, thus prepared the test samples 7 for tensile test having a score 2 for opening the can as shown in FIG. 6, each of which has different values of thickness at the thinnest portion thereof to each other. The relation between the thickness at the thinnest portion and the tensile strength of the test sample 7 was determined. The result is given in FIG. 7. In the figure, the symbol (○) denotes the test sample having a tensile strength of 290 MPa, and the symbol (□) denotes the test sample having a tensile strength of 440 MPa.

For comparison, the test samples Nos. 1 through 8 of commercially available easy-opening can ends having conventional score for opening the can, which are shown in Table 2, were tested to determine the relation between the thickness at the thinnest portion and the tensile strength. The result is shown in FIG. 7.

TABLE 2

| | Material | Pop value (kg) | Shock fracture |
|---|---|---|---|
| Commercial can No. 1 | A1 | 2.1 | Not occurred |
| Commercial can No. 2 | A1 | 2.1 | Not occurred |
| Commercial can No. 3 | Steel | 1.6 | Not occurred |
| Commercial can No. 4 | Steel | 1.2 | Not occurred |
| Commercial can No. 5 | A1 | 2.2 | Not occurred |
| Commercial can No. 6 | A1 | 2.0 | Not occurred |
| Commercial can No. 7 | A1 | 1.9 | Not occurred |
| Commercial can No. 8 | A1 | 2.2 | Not occurred |

Figure 7:
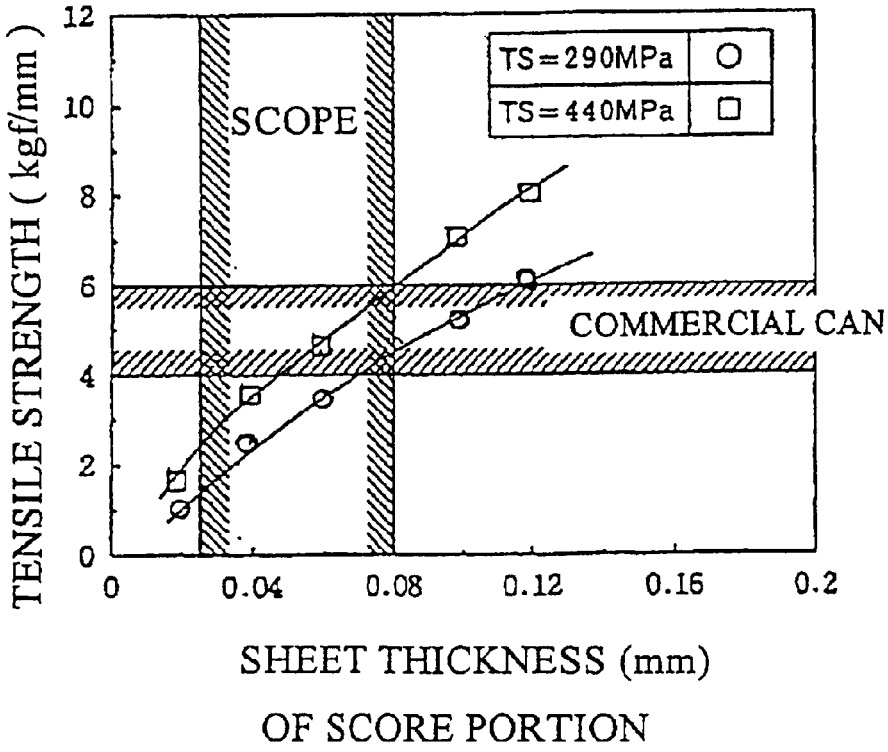
FIG. 7 is a graph showing the relation between the thickness at the thinnest portion and the tensile strength of the test samples.

As shown in FIG. 7, the values of tensile strength of the commercially available test samples were in a range of from 4 to 6 kgf/mm, while the tensile strength of the test samples according to the present invention gave the values of from about 2 to about 5 kgf/mm for thickness at the thinnest portion ranging from 0.025 to 0.0800 mm, which values are lower than those of commercially available cans, thus superior in can-openability.

EXAMPLE 3

A tin-free steel sheet was prepared from a thin steel sheet having a thickness of 0.25 mm and tensile strength of 440 MPa by forming a chromate coating layer on the upper surface thereof, which chromate coating layer consists of a chromated metal chromium layer with a coating weight of 120 mg/m$^2$ and of an upper layer of chromium oxide hydrate with a coating weight of 15 mg/m$^2$ as metallic chromium. To the steel sheet, a pair of dies both of which have a curved surface with tip radius ranging from more than 0.025 mm and not more than 1.0 mm, respectively, were applied, thus press-formed the can end panel using the method according to the invention to form the score for opening the can on the can end panel to give thickness at the thinnest portion ranging from 0.025 to 0.080 mm. Thus, the test samples of the present invention Nos. 12 through 16 were prepared, which are shown in Table 3.

For comparison, the tin-free steel sheet was press-formed using a pair of dies both of which have curved surface and at least one of which is outside of the range specified by the Embodiment 1 in terms of radius of score for opening the can on the curved surface and/or thickness at the thinnest portion thereof, thus forming a score for opening the can. The prepared comparative test samples Nos. 17 through 22 are shown also in Table 3. The Pop value and the presence/absence of thus prepared test samples of the present invention and comparative test samples were determined. The result is shown in Table 3.

TABLE 3

| No. | | Upper die radius (mm) | Lower die radius (mm) | Sheet thickness at the thinnest portion (mm) | Pop value (kg) | Shock fracture |
|---|---|---|---|---|---|---|
| Test sample of the present invention | 12 | 0.03 | 0.03 | 0.025 | 0.9 | Not occurred |
| | 13 | 0.5 | 0.5 | 0.050 | 1.5 | Not occurred |
| | 14 | 1.0 | 1.0 | 0.080 | 2.6 | Not occurred |
| | 15 | 0.03 | 0.5 | 0.025 | 1.3 | Not occurred |
| | 16 | 0.03 | 1.0 | 0.050 | 1.4 | Not occurred |
| | 17 | 0.5 | 1.0 | 0.080 | 2.4 | Not occurred |
| Comparative test sample | 17 | 0.1 | 0.1 | 0.020 | 0.8 | Not occurred |
| | 18 | 1.0 | 0.03 | 0.020 | 0.7 | Not occurred |
| | 19 | 0.1 | 0.1 | 0.100 | 3.0 | Not occurred |
| | 20 | 1.0 | 0.03 | 0.100 | 2.8 | Not occurred |
| | 21 | 1.2 | 1.2 | 0.025 | 0.9 | Not occurred |
| | 22 | 1.2 | 1.5 | 0.080 | 3.0 | Not occurred |

As seen in Table 3, the comparative test samples Nos. 17 and 18 which had the radius of curvature of the score for opening the can on the upper surface and that on the lower surface within the range specified by the present invention, and which have smaller thickness at the thinnest portion than the range specified by the present invention generated shock fracture.

The comparative test samples Nos. 19 and 20 which had the radius of curvature of the score for opening the can on the upper surface and that on the lower surface within the range specified by the present invention and which had larger thickness at the thinnest portion than the range specified by the present invention gave large Pop values of 2.8 kg or more, and showed poor can-openability.

The comparative test samples Nos. 21 and 22 which had the thickness at the thinnest portion within the range specified by the present invention and which had larger radius of curvature of the score for opening the can on the upper surface and that on the lower surface than the range specified by the present invention gave poor shape of opening section.

To the contrary, all the samples of the present invention gave low Pop values, generated no shock fracture, and showed good shape of opening section.

Embodiment 2

Embodiment 2 provides an easy-opening can end comprising: an end panel having an upper surface and a lower surface; a score which is formed on at least one surface of the upper surface and the lower surface; a tab having a finger grasping portion, said tab being attached to the can end panel and being rotatable around tab-fastening means; and a slope protrusion for lifting the tab to above a height of a seam portion when the tab is rotated to a position for allowing the can open.

The tab-fastening means is positioned offset by a distance "a" expressed in the following equation from the center of the can end to the opposite side of an openable section.

$$(D-d)/2<a<d/2-l$$

The finger grasping portion has a distance "L" from the tab-fastening means, the distance "L" being defined by the following equation.

$$d-l>L>d/2-a$$

The tab has a first center line before rotation thereof and a second center line at an opening position, the first center line and the second line having an angle "θ" therebetween which is within a range defined by the equation.

$$-1<\cos\theta<1/(2\times a\times L)\times\{(d/2)^2-(L^2+a^2)\}$$

In the above equations, "a" is the distance between the center of the tab-fastening means and the center of can end, "L" is the distance between the center of the tab-fastening means and the finger grasping portion on the tab, "l" is the distance between the center of the tab-fastening means and a tab working section, "θ" the angle between the center line of tab before rotation and the center line at opening position, "d" the inner diameter of the can end, and "D" the outer diameter of the can end.

When the score exists on an upper surface or a lower surface of the end panel, the cross section of the score has a curved surface having a radius of 0.01 to 1 mm and the end panel has a thickness of 0.025 to 0.12 mm at the thinnest portion thereof.

When the score exists on an upper surface and a lower surface of the end panel, the cross section of the score has a curved surface having a radius of over 0.025 to 1 mm and the end panel has a thickness of 0.025 to 0.12 mm at the thinnest portion thereof.

The easy-opening can end according to the Embodiment 2 is explained in more detail referring to the drawings.

Figure 11:
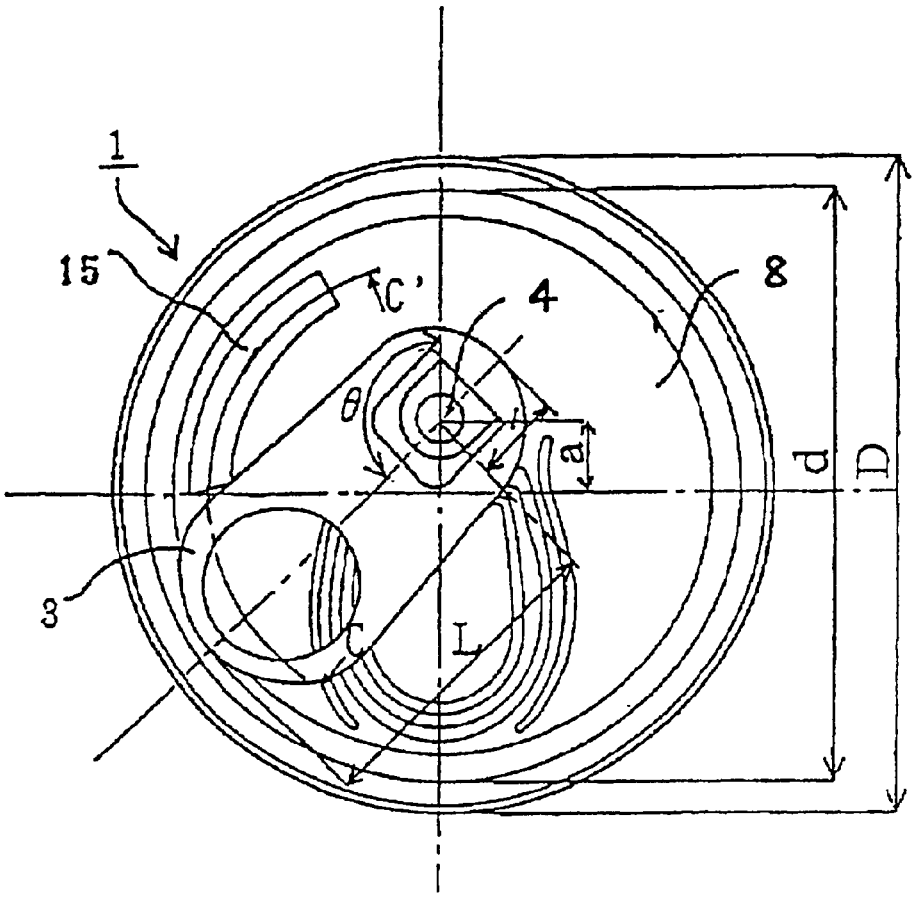
FIG. 11 is a plan view of an easy-opening can end according to the Embodiment 2.

FIG. 11 shows a plan view of the easy-opening can end according to the present invention illustrating a mode thereof. In the figure, "a" denotes the off-set between the center of tab-fastening mean 4 and the center of can end 1, "L" denotes the distance between the center of tab-fastening mean 4 and the tip of the tab 3, "l" denotes the distance between the center of tab-fastening mean 4 and the tip of working section of the tab 3, "θ" denotes the angle between the center line of tab before rotation and the center line after the rotation of the tab and before the opening of the can, "d" denotes the inner diameter of the can end 1, and "D" denotes the outer diameter of the can end 1.

According to the Embodiment 2, the center of the tab-fastening means 4 is displaced by an off-set of "a", which is defined by the equation (1), from the center of the can end 1 to opposite side of the can-opening section, $$(D-d)/2<a<d/2-l \quad (1)$$

and the distance "L" between the center of the tab-fastening means 4 and the tip of the tab 3 is limited by the equation (2) to extend longer than that in prior art, thus increasing the distance between the support point of lever work and the work point thereof, which increases the generated force at the work point compared with that in the prior art, $$d-l>L>d/2-a \quad (2)$$

If, however, a tab-fastening mean is applied at the center of the can end 1 as in prior art, the whole tab cannot be held within the area of the central panel section, so the performance of stacking, storing, and transporting of cans is significantly degraded. In this regard, according to the Embodiment 2, the position of the tab-fastening means 4 is moved from the center of the can end 1 to opposite side of the can opening section within a range of the equation (1), and the tab 3 is rotated by an angle of θ derived from the equation (3) around the tab-fastening means 4, $$-1<\cos\theta<1/(2\times a\times L)\times\{(d/2)^2-(L^2+a^2)\} \quad (3)$$

By moving the position of the tab-fastening means 4 by "a" and by rotating the tab 3 by an angle of "θ", the total tab is able to be held inside of the area of the central panel section 8.

Figure 12:
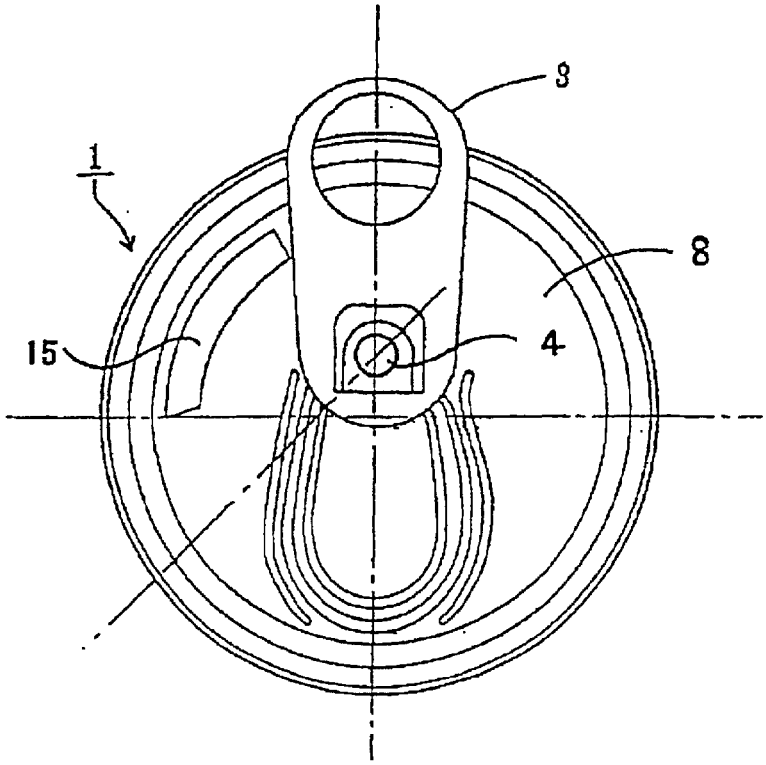
FIG. 12 is a plan view of an easy-opening can end after rotating the tab and immediately before opening the can according to the Embodiment 2.

In addition, as shown in FIG. 12, the tab 3 is rotated around the tab-fastening mean 4 from the disabled-opening position to the enabled-opening position during the can-opening step. With the simple rotation, however, the tab edge section collides against the seam section in the periphery of the can end to prevent further rotation of the tab 3. To solve the problem, a slope-shape protrusion 15 is formed on the center panel section 8. By pulling-up the tip of the tab 3 to above the height of the seam section, the tab 3 becomes possible to rotate to the enabled-opening position.

After the tab 3 is rotated to the enabled-opening position in this manner, the tab picking-up edge becomes outside of the outer periphery of the can end (or the outer periphery of the seam section) so that the finger picking and holding the tab 3 are easily done.

FIG. 11 uses a rivet as a means to hold the tab 3 in free-rotational angle movement. The means is, however, not limited to the rivet, and a tab-fastening mean material having the same construction may be attached to the central panel section using an adhesive. The shape of the tab 3 is preferably raised from the can end for easy angle movement and for easy finger picking.

Figure 13:
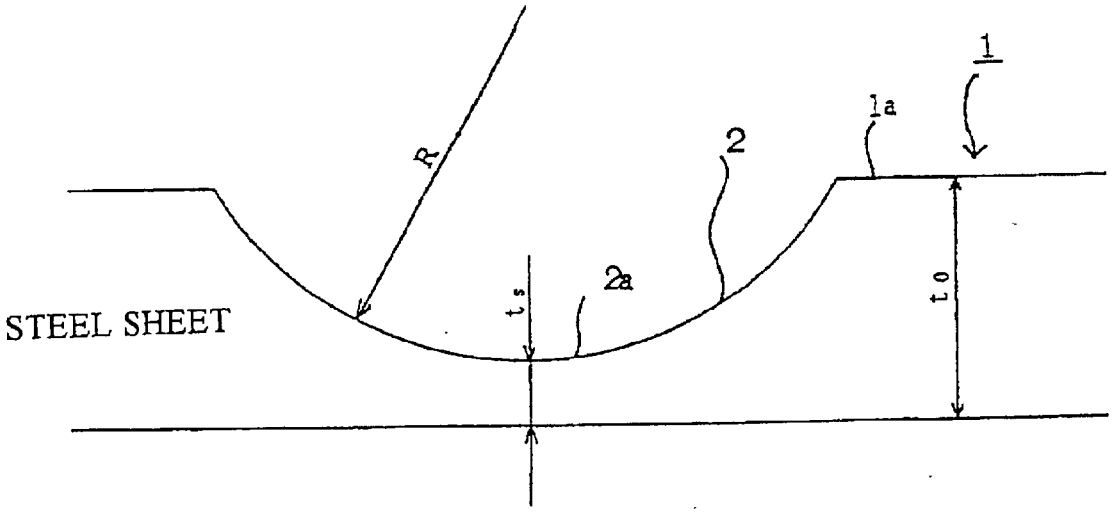
FIG. 13 is a cross sectional view of a score portion formed on the can end panel according to the Embodiment 2.

As shown in FIG. 13 of a cross sectional view of the score for opening the can, the can end according to the Embodiment 2 has a score 2 for opening the can on a surface 1*a* of the can end 1 having a thickness of $t_0$, which score 2 has a curved shape cross section having the values of radius (R) ranging from 0.01 to 1.0 mm and having the values of thickness ($t_s$) at the thinnest portion 6*a* ranging from 0.025 to 0.120 mm.

Figure 14:
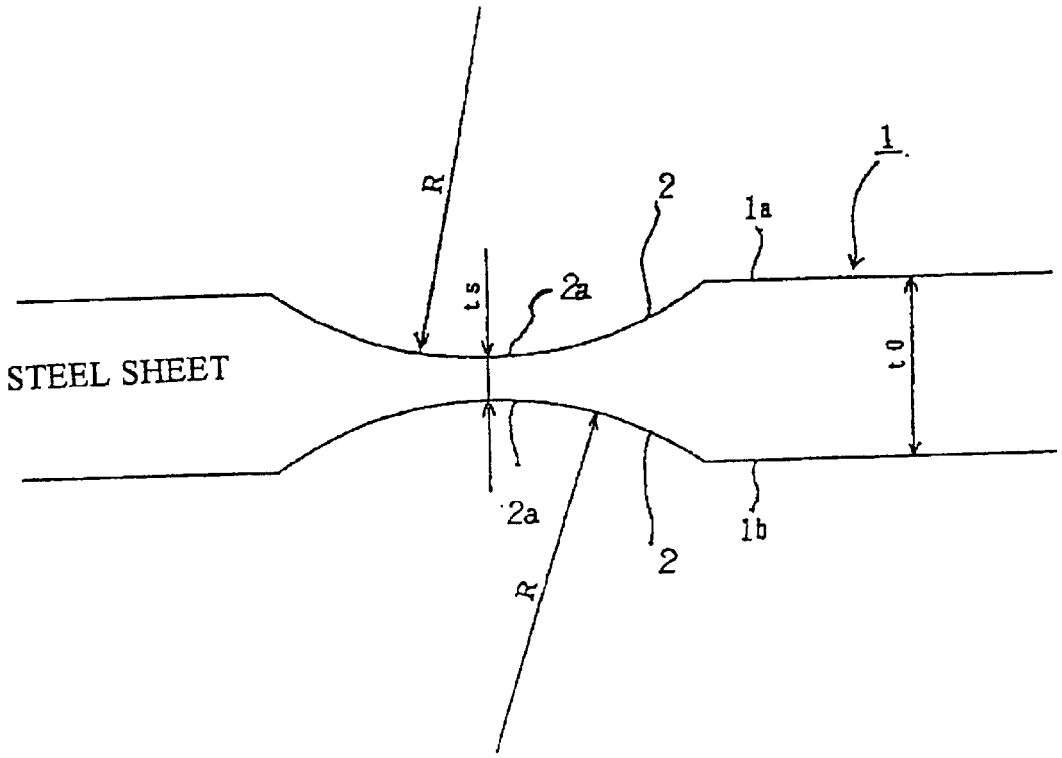
FIG. 14 is a cross sectional view of another example of the score portion formed on the can end panel according to the Embodiment 2.

FIG. 14 shows another easy-opening can end according to the Embodiment 2, illustrating the score for opening the can formed on the can end. As seen in FIG. 14, the scores 2,2 for opening the can having a curved shape of bottom cross section are formed on the upper surface 1*a* and the lower surface 1*b* of the can end 1 having a thickness of $t_0$, which score has the values of radius (R) ranging from over 0.025 mm to 1.0 mm, and has the values of thickness ($t_s$) at the thinnest portion 2*a* ranging from 0.025 to 0.120 mm.

Owing to the score 2 for opening the can having a curved shape with above-described radius (R) on the upper surface 1*a* or on both of the upper surface 1*a* and the lower surface 1*b* of the can end, along with the tab mechanism, the can-opening force is stably reduced to a level that child or aged person is able to easily open the can, while preventing the generation of shock fracture.

For the case that the score 2 for opening the can is formed only on the upper surface 1*a* of the can end 1, provided by the radius (R) of the bottom cross section of the score 2 for opening the can being less than 0.01 mm, or for the case that the score 2 of the bottom cross section is formed on both of the upper surface 1*a* and the lower surface 1*b* of the can end, provided by the bottom cross sectional radius (R) of each score 2 being equal to or less than 0.025 mm, the working accuracy of the dies to form the above-described score 2 on the can end panel degrades, and the abrasion of the dies induced by the forming work appears in an early working time, so a problem of difficulty in maintaining the die shape during the successive forming cycles arises.

On the other hand, when the bottom cross sectional radius (R) of the above-described score 2 for opening the can exceeds 1.0 mm, the area of thin-thickness section on the can end 1 increases to make the breaking position of the opening section unstable, which results in poor shape of opening and induces a problem of increased "sagging", or a portion of the broken section hangs down. It is also practically impossible to form a score 2 for opening the can with widths wider than 1.0 mm on a can end panel having a limited space.

If the thickness of the thinnest portion 6*a* on the score 2 for opening the can is less than 0.025 mm, the can end panel may be broken. If a can with that kind of can end panel is dropped or is subjected to external shock, the opening section may be fractured. On the other hand, if the thickness of the thinnest portion 6*a* on the score 2 for opening the can exceeds 0.120 mm, then a problem of needing a large can-opening force arises.

Consequently, the bottom cross sectional shape of the score for opening the can formed on either the upper surface or the lower surface of the can end is necessary to have a curved surface having radius ranging from 0.01 to 1.0 mm and having the thickness at the thinnest portion ranging from 0.025 to 0.080 mm, and the bottom cross sectional shape of the score for opening the can formed on the can end is necessary to have a curved surface having radius ranging from more than 0.025 mm and not more than 1.0 mm and the thickness at the thinnest portion ranging from 0.025 to 0.120 mm.

The can end having a score for opening the can with the above-described curved surface cross sectional shape according to the present invention is applicable to both the pull-top tab can end and the stay-on tab can end. Generally, the materials of can end are aluminum plate, surface-treated steel sheet coated with a metal, or metal-coated steel sheet laminated by a resin coating layer, with a thickness of the metal sheet ranging from 0.15 to 0.30 mm.

Example

The present invention is further described in the following referring to example and comparative example.

A can end panel of a tin-free steel sheet was prepared from a thin steel sheet having a thickness of 0.25 mm and a tensile strength of 440 MPa by forming a chromate coating layer on the upper surface thereof, which chromate coating layer consists of a chromated metal chromium layer with a coating weight of 120 mg/m$^2$ and of a top layer of chromium oxide hydrate with a coating weight of 15 mg/m$^2$ as metallic chromium. To the steel sheet, a pair of dies one of which has a curved surface with tip radius ranging from 0.1 to 1.0 mm while the other has a flat surface were applied, thus press-formed the can end panel to give the thickness at the thinnest portion ranging from 0.025 to 0.120 mm, to form the score for opening the can on the surface of the can end panel. A tab 3 having a structure shown in FIG. 11 and having the dimensions described below was attached to thus prepared can end panel. As a result, the test samples No. 1 through No. 10 for stay-on tab easy-opening can ends within a range specified by the present invention were prepared, which samples are listed in Table 4. (Hereinafter these test samples are referred to as the test samples of the present invention.)

Off-set between the center of tab-fastening mean and the center of can end (a): 5 mm Distance between the center of tab-fastening mean and the finger-picking section on the tab (L): 25 mm Distance between the center of tab-fastening mean and the tab working section (l): 10 mm Inner diameter of the can end (d): 49 mm Outer diameter of the can end (D): 53 mm For comparison, the above-described tin-free steel sheet was press-formed using a pair of dies one of which has a score for opening the can on the curved surface thereof with radius and/or thickness at the thinnest portion thereof outside of the range specified by the present invention, and the other of which has a flat surface to form a score for opening the can on the upper surface of the can end, thus prepared the test samples No. 1 through 14 for stay-on tab easy-opening can ends shown also in Table 4. (Hereinafter these test samples are referred to as the comparative test samples.) The length (L) of the tab in conventional type was set to 17 mm.

TABLE 4

| No. | | Die radius (mm) | Sheet thickness at the thinnest portion (mm) | Type of tab | Pop value (kg) | Shock fracture |
|---|---|---|---|---|---|---|
| Sample of the present invention | 1 | 0.025 | 0.025 | Rotational tab | 0.7 | Not occurred |
| | 2 | 0.050 | 0.050 | Rotational tab | 1.0 | Not occurred |
| | 3 | 0.100 | 0.080 | Rotational tab | 1.7 | Not occurred |
| | 4 | 0.200 | 0.100 | Rotational tab | 2.0 | Not occurred |
| | 5 | 0.500 | 0.025 | Rotational tab | 0.6 | Not occurred |
| | 6 | 0.500 | 0.120 | Rotational tab | 2.4 | Not occurred |
| | 7 | 0.800 | 0.025 | Rotational tab | 0.8 | Not occurred |
| | 8 | 0.800 | 0.120 | Rotational tab | 2.5 | Not occurred |
| | 9 | 1.000 | 0.025 | Rotational tab | 0.8 | Not occurred |
| | 10 | 1.000 | 0.120 | Rotational tab | 2.5 | Not occurred |
| Comparative test sample | 1 | 0.025 | 0.020 | Rotational tab | 0.5 | Not occurred |
| | 2 | 0.100 | 0.020 | Rotational tab | 0.4 | Not occurred |
| | 3 | 0.500 | 0.020 | Rotational tab | 0.6 | Not occurred |
| | 4 | 1.000 | 0.020 | Rotational tab | 0.5 | Not occurred |
| | 5 | 0.025 | 0.150 | Rotational tab | 2.8 | Not occurred |
| | 6 | 0.100 | 0.150 | Rotational tab | 3.0 | Not occurred |
| | 7 | 0.500 | 0.150 | Rotational tab | 2.9 | Not occurred |
| | 8 | 1.000 | 0.150 | Rotational tab | 3.2 | Not occurred |
| | 9 | 1.200 | 0.050 | Rotational tab | 1.1 | Not occurred |
| | 10 | 1.500 | 0.080 | Rotational tab | 1.9 | Not occurred |
| | 11 | 0.025 | 0.100 | Rotational tab | 2.8 | Not occurred |
| | 12 | 0.100 | 0.100 | Conventional tab | 2.9 | Not occurred |
| | 13 | 0.500 | 0.120 | Conventional tab | 3.4 | Not occurred |
| | 14 | 1.000 | 0.120 | Conventional tab | 3.3 | Not occurred |

Figure 15:
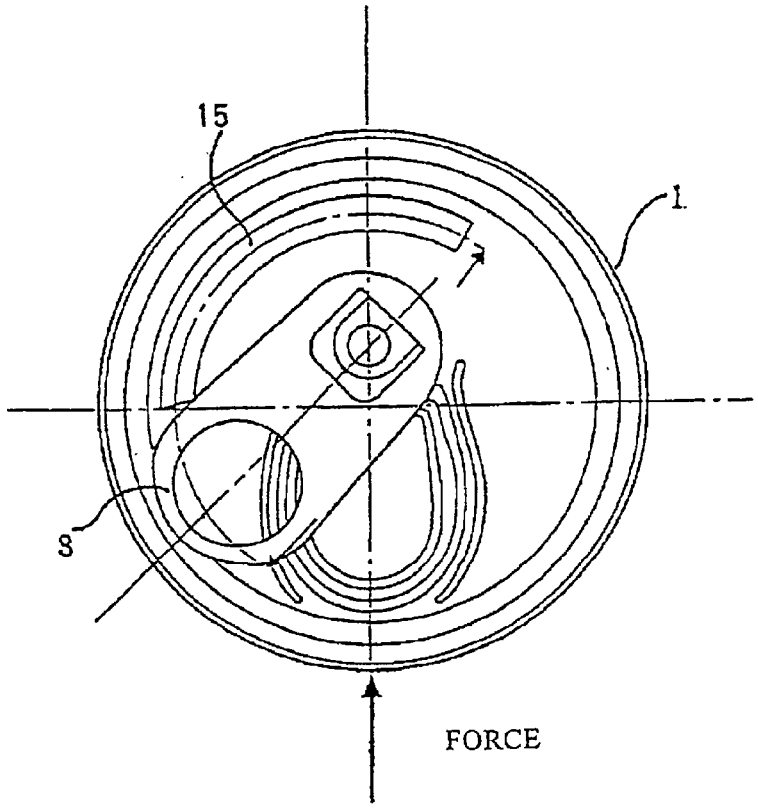
FIG. 15 is an explanation view to illustrate the position of applying shock against a can end.

Each of the can ends prepared from above-described samples of the present invention and comparative samples was attached to a shell of 340 ml can containing commercially available soda water, and the can was sealed. Pop value (kg) of the can containing soda water, (the force that the opening section of the can end begins to open under a specified pulling force applied to the tab on the can) was determined. Shock fracture was evaluated by the presence/absence of shock fracture when a can is dropped from 1 m above the concrete floor against the floor in a slanted position of the can facing the can end 1 downward, as shown in FIG. 15, to apply a shock force to the can end 1 in arrow direction in FIG. 6. The result is also shown in Table 4.

As seen in Table 4, the comparative test samples Nos. 1 through 4 which had smaller thickness at the thinnest portion than the range according to the Embodiment 2 generated shock fracture. The comparative test samples Nos. 5 through 8 which had larger thickness at the thinnest portion than the range specified by the Embodiment 2 gave large Pop values ranging from 2.8 to 3.2 kg, and showed poor can-openability even with the use of the rotational tab according to the Embodiment 2. The comparative test samples Nos. 9 and 10 which had larger radius (R) of score for opening the can than the range according to the present invention gave low Pop values and showed no shock fracture, but gave poor can-openability. The comparative test samples Nos. 11 through 14 which used the conventional tub gave high Pop values ranging from 2.8 to 3.4 kg, and showed poor can-openability even they had radius (R) of score for opening the can within a range specified by the Embodiment 2.

Embodiment 3

Embodiment 3 provides an easy-opening can end comprising: an end panel comprising a steel sheet and resin film layers on an upper surface and a lower surface of the steel sheet; and a score which is formed on at least one surface of the upper surface and the lower surface of the end panel. The score has a cross section of a curved surface having a radius of 0.1 to 1 mm, and the end panel has a thickness of 0.025 to 0.08 mm at the thinnest portion thereof.

A method for making the easy-opening can end comprises the steps of: providing an end panel comprising a steel sheet and resin film layers on an upper surface and a lower surface of the steel sheet; providing an upper die and a lower die; and press-forming the end panel by using the upper die and the lower die to form a score on at least one surface of the upper surface and the lower surface of the end panel.

The at least one of the upper die and the lower die has a curved surface with a radius ranging from 0.1 to 1 mm at the tip portion thereof. The end panel is press-formed so that the end panel has a thickness of 0.025 to 0.08 mm at the thinnest portion thereof.

The easy-opening can end and the method to manufacture the same according to the Embodiment 3 are described in more detail in the following referring to the drawings.

Figure 16:
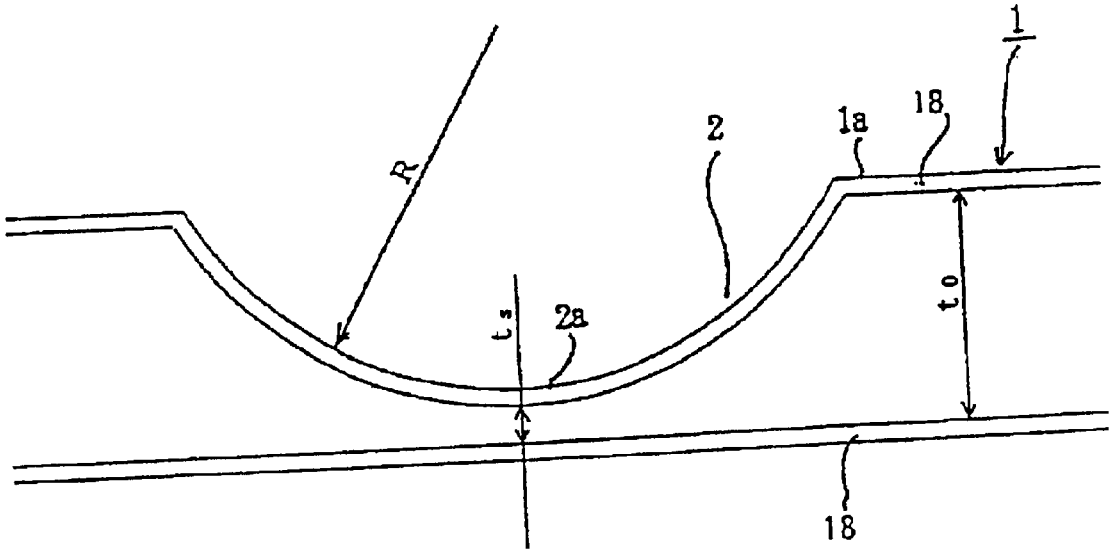
FIG. 16 is a cross sectional view of a score portion formed on the can end according to the Embodiment 3.

FIG. 16 shows the first mode of the easy-opening can end described in claim 1 of the present invention. FIG. 16 is a cross sectional view of the score for opening the can formed on the can end.

In the first mode, as shown in the figure, the can end has resin coating layer 8 on both sides thereof. A score 2 for opening the can is formed on the upper surface 1*a* of the can end 1 being coated by resin layer 8 on both sides thereof and having a thickness of $t_0$, which score 2 has a curved shape cross section having radius (R) ranging from 0.1 to 1.0 mm and having the values of thickness ($t_s$) at the thinnest portion 2*a* ranging from 0.025 to 0.080 mm.

Figure 17:
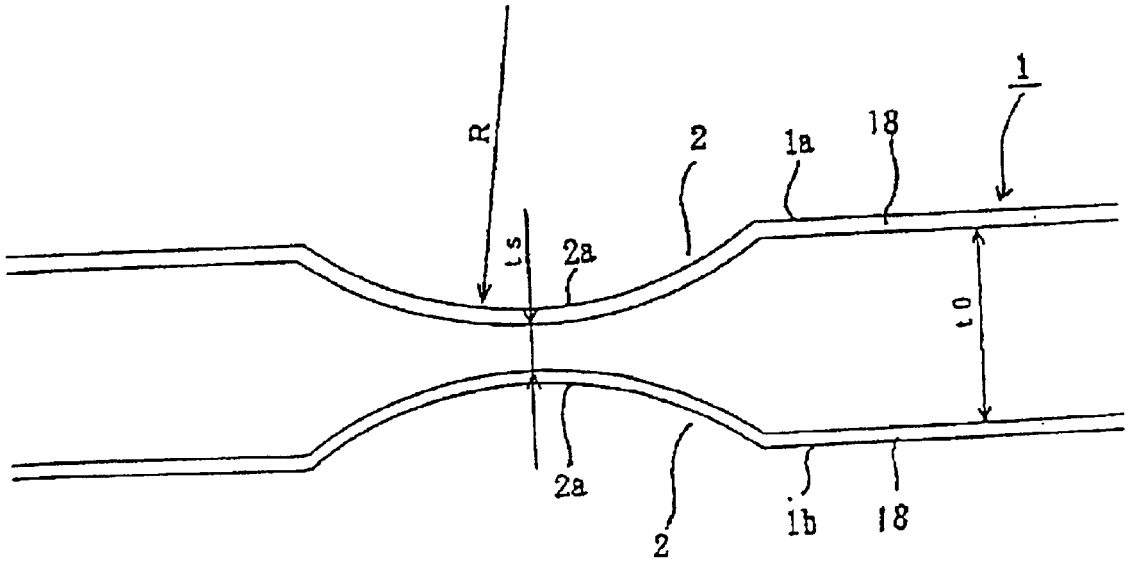
FIG. 17 is another cross sectional view of a score portion formed on the can end according to the Embodiment 3.

FIG. 17 shows the second mode of the easy-opening can end described in claim 1 of the present invention. FIG. 17 is a cross sectional view of the score for opening the can formed on the can end. In the second mode, as shown in the figure, the can end has resin coating layer 8 on both sides thereof. Scores 2, 2 for opening the can are formed on the upper surface 1*a* and the lower surface 1*b* of the can end 1 being coated by resin layer on both sides thereof, respectively, and having a thickness of $t_0$, which score 2 has a curved shape cross section having radius (R) ranging from 0.1 to 1.0 mm and having the values of thickness ($t_s$) at the thinnest portion 2*a* ranging from 0.025 to 0.080 mm.

Owing to the score 2 for opening the can having a curved shape with above-described radius (R) on the upper surface 1*a* or on both of the upper surface 1*a* and the lower surface 1*b* of the can end 1, the can-opening force is stably reduced to a level that child or aged person is able to easily open the can, while preventing the generation of shock fracture.

When the radius (R) of the score 2 for opening the can is less than 0.1 mm, it is difficult to form the score 2 for opening the can on the can end panel without damaging the resin coating layer. On the other hand, if the radius (R) of the score 2 for opening the can exceeds 1.0 mm, the area of thin thickness section on the can end 1 increases, so the breaking position of the opening section becomes unstable to result in non-smooth opening shape, and further to induce a problem of "sagging", or a portion of the broken section hangs down. It is also practically impossible to form a score 2 for opening the can with widths wider than 1.0 mm on a can end panel having a limited space.

If the thickness at the thinnest portion 2*a* on the score 2 for opening the can is less than 0.025 mm, the resin coating layer is damaged during forming work, and the can end panel may be broken. If a can with that kind of can end panel is dropped or is subjected to external shock, the opening section may be fractured. On the other hand, if the thickness at the thinnest portion on the score 2 for opening the can exceeds 0.080 mm, then a problem of needing a large can-opening force arises.

Consequently, the cross sectional shape of the score for opening the can formed on at least one of the front and lower surfaces of the can end is necessary to have a curved surface having radius ranging from 0.1 to 1.0 mm and having a thickness at the thinnest portion ranging from 0.025 to 0.080 mm.

The can end according to the Embodiment 3 may be formed by using a pair of dies at least one of the upper and the lower thereof having a tip in a curved surface with radius ranging from 0.1 to 1.0 mm and by applying the press forming method to a can end panel coated by resin layer on both sides thereof into a shape having thickness at the thinnest portion ranging from 0.025 to 0.080 mm. The reason why the dimensions and shape of the dies are selected as described one is to form a score for opening the can having the dimensions described above on the can end. The reason for limiting the dimensions and shape of the score for opening the can is described above.

Use of a lubricant for press-forming a can end panel reduces the friction force between the dies and the resin. As a result, the shearing force generated in the resin becomes less, thus suppressing the occurrence of separation of interface between the resin and the steel sheet.

Figure 10:
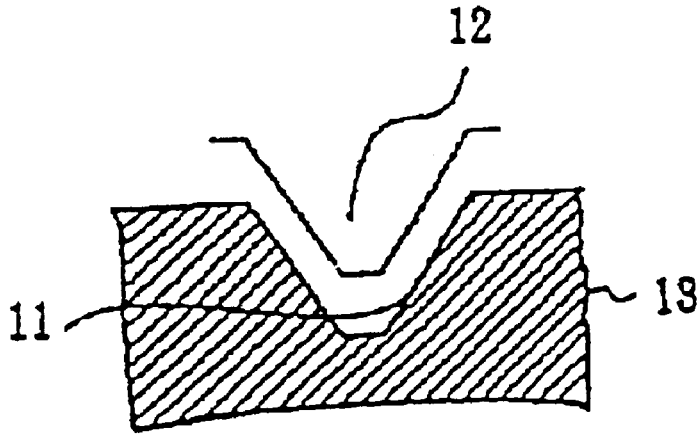
FIG. 10 is an explanation view to illustrate the conventional method for forming score for opening the can on easy-opening can end.

The can end having a score for opening the can with the above-described curved surface cross sectional shape according to the present invention is applicable to both the pull-top tab can end shown in FIG. 9 and the stay-on tab can end shown in FIG. 10.

Figure 18A:
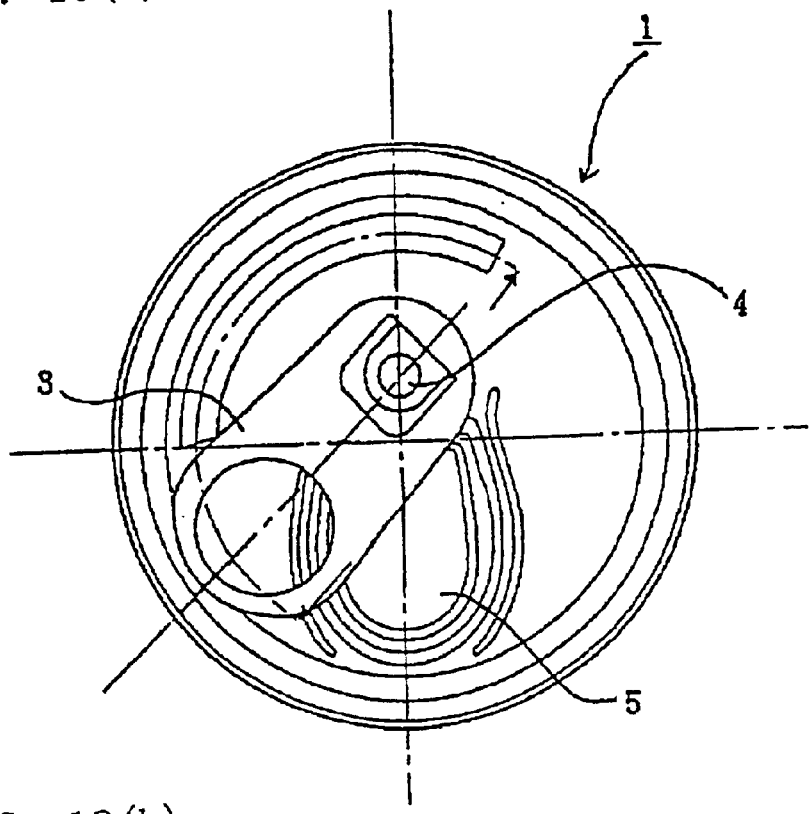
FIGS. 18(*a*) and 18(*b*) are plan views of an easy-opening can end according to Embodiment 3.
Figure 18B:
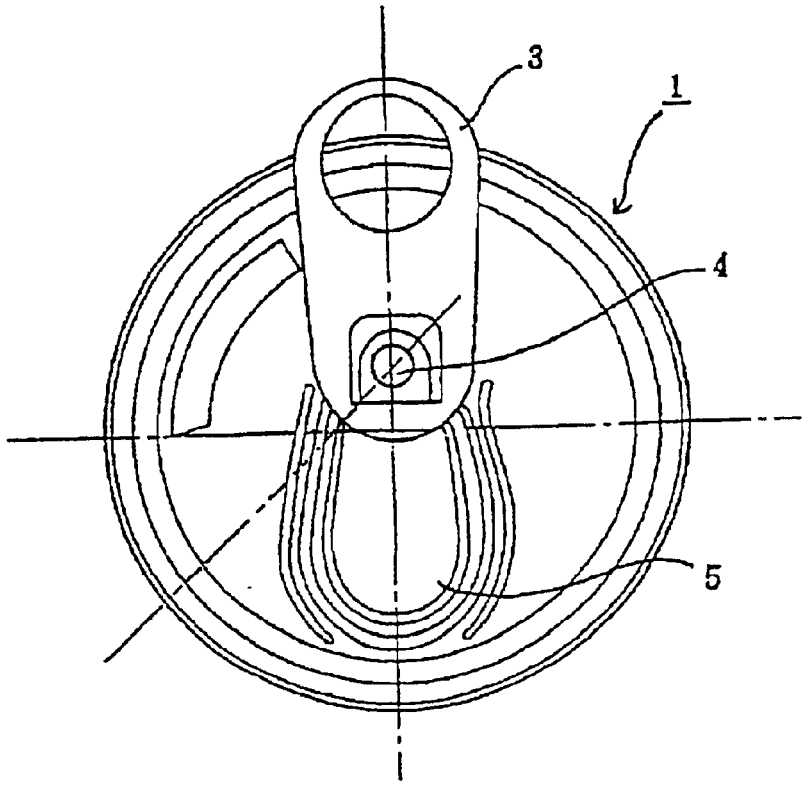

Alternatively, as shown in FIG. 18(*a*), if the tab 3 is attached to the can end 1 in a manner that the tab-fastening mean 4 is at an off-set position against the center of the can end 1 toward the opposite side of the opening section 5 to allow the tab 3 to rotate around the tab-fastening mean 4, while lengthening the distance between the tab-fastening mean 4 on the tab 3 and the tip of the tab to some degree compared with the conventional length, thus increasing the generated force at the working point. Under the configuration, when the tab 3 is rotated to the enabled-opening position as shown in FIG. 18(*b*), the can-opening force is further reduced if only the score for opening the can having the curved surface shape according to the present invention is formed on the can end on which the turning of the tab 3 to an enabled-opening position brings the pick-up edge of the tab 3 to outside of the outer periphery of the can end.

Generally, the materials of can end are aluminum plate or surface-treated steel sheet coated with a metal, having thickness ranging from 0.15 to 0.30 mm.

EXAMPLE 1

A tin-free steel sheet was prepared from a thin steel sheet having a thickness of 0.25 mm and tensile strength of 440 MPa by forming a chromate coating layer on both sides thereof, which chromate coating layer consists of a chromated metal chromium layer with a coating weight of 120 $mg/m^2$ and of a top layer of chromium oxide hydrate with a coating weight of 15 $mg/m^2$ as metallic chromium. On both sides of thus prepared tin-free steel sheet, a thermal-fusing polyester film having a thickness of 25 $\mu$m was laminated.

To the polyester-laminated steel sheet, a pair of dies at least one of which has a curved surface with tip radius ranging from 0.1 to 1.0 mm while the other has a flat surface were applied using the method according to the present invention, thus press-formed the can end panel with or without using lubricant to give thickness at the thinnest portion ranging from 0.025 to 0.080 mm, to form the score for opening the can on the surface of the can end panel. As a result, the test samples No. 1 through No. 17 for stay-on tab easy-opening can ends within a range specified by the present invention were prepared. (Hereinafter these test samples are referred to as the test samples of the present invention.) For comparison, the above-described tin-free steel sheet was press-formed using a pair of dies one of which has a score for opening the can on the curved surface thereof with radius and/or thickness at the thinnest portion thereof outside of the range specified by the present invention, and the other of which has a flat surface, applying or without applying lubricant thereto to form a score for opening the can on the upper surface of the can end, thus prepared the test samples No. 1 through 20 for stay-on tab easy-opening can ends shown also in Table 1.

TABLE 5

| No. | | Die radius (mm) | Sheet thickness at the thinnest portion (mm) | Lubrication during forming | Pop value (kg) | Damage on coating layer | Separation of coating layer | Shock fracture |
|---|---|---|---|---|---|---|---|---|
| Sample of the present invention | 1 | 0.100 | 0.025 | Not applied | 1.0 | Not occurred | Not occurred | Not occurred |
| | 2 | 0.100 | 0.050 | Not applied | 1.5 | Not occurred | Not occurred | Not occurred |
| | 3 | 0.100 | 0.025 | Applied | 1.2 | Not occurred | Not occurred | Not occurred |
| | 4 | 0.100 | 0.050 | Applied | 1.4 | Not occurred | Not occurred | Not occurred |
| | 5 | 0.100 | 0.085 | Not applied | 2.4 | Not occurred | Not occurred | Not occurred |
| | 6 | 0.200 | 0.025 | Applied | 0.9 | Not occurred | Not occurred | Not occurred |
| | 7 | 0.500 | 0.025 | Applied | 1.1 | Not occurred | Not occurred | Not occurred |
| | 8 | 0.800 | 0.025 | Not applied | 1.1 | Not occurred | Not occurred | Not occurred |
| | 9 | 0.800 | 0.050 | Not applied | 1.3 | Not occurred | Not occurred | Not occurred |
| | 10 | 0.800 | 0.025 | Applied | 1.2 | Not occurred | Not occurred | Not occurred |
| | 11 | 0.800 | 0.050 | Applied | 1.4 | Not occurred | Not occurred | Not occurred |
| | 12 | 0.800 | 0.080 | Not applied | 2.5 | Not occurred | Not occurred | Not occurred |
| | 13 | 1.000 | 0.025 | Not applied | 1.1 | Not occurred | Not occurred | Not occurred |
| | 14 | 1.000 | 0.050 | Not applied | 1.5 | Not occurred | Not occurred | Not occurred |
| | 15 | 1.000 | 0.025 | Applied | 1.1 | Not occurred | Not occurred | Not occurred |
| | 16 | 1.000 | 0.050 | Applied | 1.6 | Not occurred | Not occurred | Not occurred |
| | 17 | 1.000 | 0.080 | Not applied | 2.6 | Not occurred | Not occurred | Not occurred |
| Comparative sample | 1 | 0.010 | 0.020 | Not applied | 0.8 | Occurred | Occurred | Occurred |
| | 2 | 0.010 | 0.050 | Not applied | 1.6 | Occurred | Occurred | Not occurred |
| | 3 | 0.010 | 0.080 | Not applied | 2.4 | Occurred | Occurred | Not occurred |
| | 4 | 0.010 | 0.100 | Not applied | 2.6 | Occurred | Occurred | Not occurred |
| | 5 | 0.080 | 0.020 | Not applied | 0.9 | Occurred | Occurred | Occurred |
| | 6 | 0.080 | 0.050 | Not applied | 1.6 | Occurred | Occurred | Not occurred |
| | 7 | 0.080 | 0.080 | Not applied | 2.8 | Not occurred | Not occurred | Not occurred |
| | 8 | 0.080 | 0.100 | Not applied | 2.8 | Not occurred | Not occurred | Not occurred |
| | 9 | 0.100 | 0.020 | Not applied | 0.8 | Occurred | Occurred | Occurred |
| | 10 | 0.200 | 0.020 | Not applied | 0.7 | Occurred | Occurred | Occurred |
| | 11 | 0.050 | 0.020 | Not applied | 0.9 | Occurred | Occurred | Occurred |
| | 12 | 0.800 | 0.020 | Not applied | 1.0 | Occurred | Occurred | Occurred |
| | 13 | 0.800 | 0.100 | Not applied | 2.8 | Not occurred | Not occurred | Not occurred |
| | 14 | 1.000 | 0.020 | Not applied | 0.9 | Occurred | Occurred | Occurred |
| | 15 | 1.000 | 0.100 | Not applied | 3.0 | Not occurred | Not occurred | Not occurred |
| | 16 | 1.200 | 0.020 | Not applied | 1.0 | Not occurred | Occurred | Occurred |
| | 17 | 1.200 | 0.020 | Applied | 1.1 | Not occurred | Not occurred | Occurred |
| | 18 | 1.200 | 0.025 | Applied | 1.1 | Not occurred | Not occurred | Not occurred |
| | 19 | 1.500 | 0.020 | Not applied | 0.9 | Occurred | Occurred | Occurred |
| | 20 | 1.500 | 0.025 | Not applied | 1.0 | Not occurred | Not occurred | Not occurred |

For each of the samples of the Embodiment 3 and the comparative samples, Pop value and presence/absence of damage on the coating layer, of separation of the coating layer, and of shock fracture were determined in accordance with the procedure described below. The result is also shown in Table 5. Pop value (kg) was determined by the force that begins to open the can end opening section under a constant tensile force applied to the tab on the can end. Shock fracture was evaluated by the presence/absence of shock fracture when a can 6 is dropped from 1 m above a concrete floor against the floor in a slanted position of the can facing the can end 1 downward, to apply a shock force to the can end 1 in the arrow direction in FIG. 5. Damage on the coating layer was evaluated by the presence/absence of rust after applying the specified corrosion test. Separation of the coating layer was evaluated by the presence/absence of separation of the coating layer under a cross section observation.

As seen in Table 5, the comparative test samples Nos. 1 through 6 which had smaller radius of cross sectional curved shape of the score than the range according to the Embodiment 3 generated damage on coating layer and separation of coating layer. The comparative test samples Nos. 1 and 5 which had smaller thickness at the thinnest portion than the range specified by the present invention generated shock fracture.

The comparative test samples Nos. 7 and 8 which had smaller radius of score for opening the can than the range according to the present invention and which had larger thickness at the thinnest portion than the range according to the present invention gave a high Pop value of 2.8. The comparative test samples Nos. 9 through 12, and 14 which had smaller thickness at the thinnest portion than the range according to the Embodiment 3 generated damage on coating layer, separation of coating layer, and shock fracture. The comparative test samples Nos. 13 and 15 which had larger thickness at the thinnest portion than that specified by the present invention gave high Pop values of 2.8 or more. The comparative test samples Nos. 16 through 20 which had larger radius of score for opening the can than the range specified by the Embodiment 3 resulted in poor opening section shape. The comparative test samples Nos. 16, 17, and 19 which had smaller thickness at the thinnest portion than the range according to the Embodiment 3 generated shock fracture.

To the contrary, all the samples of the Embodiment 3 gave Pop values of 2.6 or less, and gave no damage on coating layer, no separation of coating layer, no shock fracture, and gave good shape of opening section.

EXAMPLE 2

Figure 20:
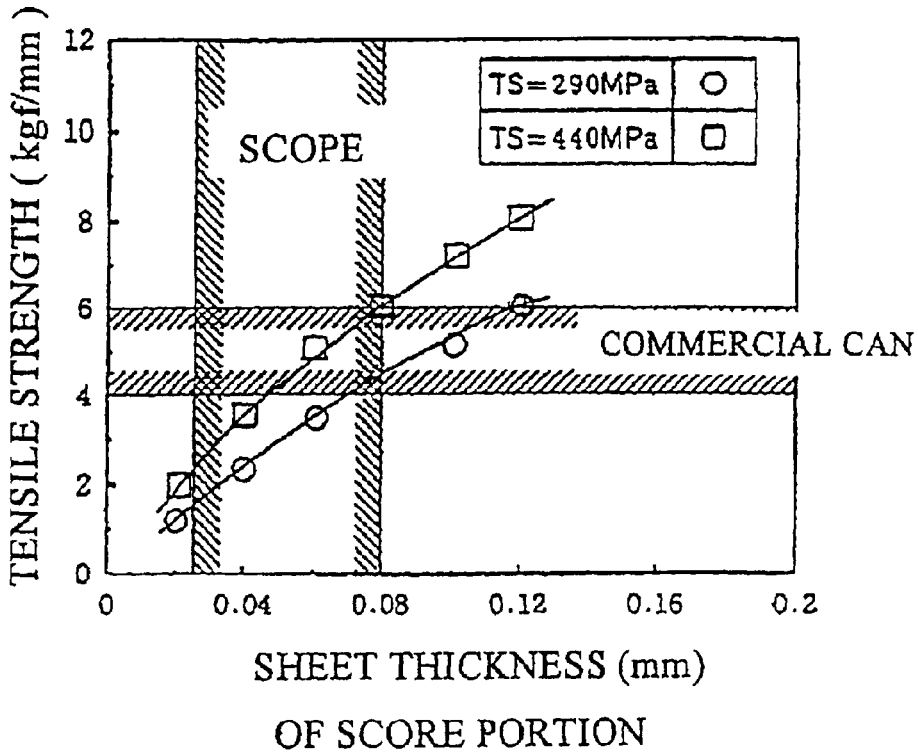
FIG. 20 is a graph showing the relation between the tip radius of the die, the sheet thickness at the thinnest portion, and the damage on the coating layer according to Embodiment 3.

Two sheets of tin-free steel sheets were prepared from two sheets of thin steel sheets each having a thickness of 0.25 mm and a tensile strength of 290 MPa and 440 MPa, respectively, by forming a chromate coating layer on the upper surface thereof, which chromate coating layer consists of a chromated metal chromium layer with a coating weight of 120 mg/m$^2$ and of an upper layer of chromium oxide hydrate with a coating weight of 15 mg/m$^2$ as metallic chromium. The prepared chromate-coated steel sheet was laminated by a film of thermal-fusion type having a thickness of 25 $\mu$m. To the laminated steel sheet, a pair of dies one of which has a curved surface with tip radius ranging from 0.1 to 1.0 mm while the other has a flat surface were applied using the method according to the present invention. thus prepared test samples 7 for tensile test having a score 2 for opening the can as shown in FIG. 20, each of which has different values of thickness at the thinnest portion thereof to each other. The relation between the thickness at the thinnest portion and the tensile strength of the test sample 7 was determined. The result is given in FIG. 6. In the figure, the symbol (o) denotes the test sample having a tensile strength of 290 MPa, and the symbol (□) denotes the test sample having a tensile strength of 440 MPa.

For comparison, the test samples Nos. 1 through 8 of commercially available easy-opening can ends having a conventional score for opening the can, which are shown in Table 6, were tested to determine the relation between the thickness at the thinnest portion and the tensile strength. The result is shown in FIG. 19.

TABLE 6

| | Material | Pop value (kg) | Shock fracture |
|---|---|---|---|
| Commercial can No. 1 | A1 | 2.1 | Not occurred |
| Commercial can No. 2 | A1 | 2.1 | Not occurred |
| Commercial can No. 3 | Steel | 1.6 | Not occurred |
| Commercial can No. 4 | Steel | 1.2 | Not occurred |
| Commercial can No. 5 | A1 | 2.2 | Not occurred |
| Commercial can No. 6 | A1 | 2.0 | Not occurred |
| Commercial can No. 7 | A1 | 1.9 | Not occurred |
| Commercial can No. 8 | A1 | 2.2 | Not occurred |

Figure 19:
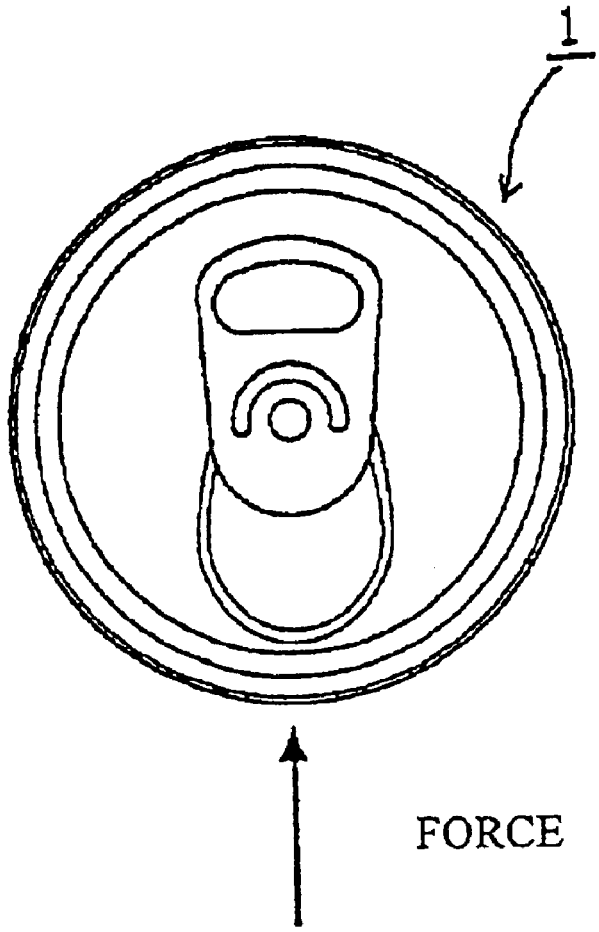
FIG. 19 is a graph showing the relation between the thickness at the thinnest portion and the tensile strength of the test samples according to Embodiment 3.

As shown in FIG. 19, the values of tensile strength of the commercially available test samples were in a range of from 4 to 6 kgf/mm, while the tensile strength of the test samples according to the present invention gave the values of from about 2 to about 5 kgf/mm for thicknesses at the thinnest portion ranging from 0.025 to 0.0800 mm, which values are lower than those of commercially available cans, thus superior in can openability.

EXAMPLE 3

A tin-free steel sheet was prepared from a thin steel T sheet having a thickness of 0.25 mm and a tensile strength of 440 MPa by forming a chromate coating layer on the upper surface thereof, which chromate coating layer consists of a chromated metal chromium layer with a coating weight of 120 mg/m$^2$ and of an upper layer of chromium oxide hydrate with a coating eight of 15 mg/m$^2$ as metallic chromium. The prepared chromate-coated steel sheet was laminated by a thermal-fusion type film having a thickness of 25 $\mu$m. To the laminated steel sheet, a pair of dies one of which has a curved surface while the other has a flat surface were applied, thus press-formed the can end panel to form the score for opening the canon the surface of the can end panel, while giving a varied tip radius on one side of the dies and different values of thickness at the thinnest portion. The presence/absence of damage on the coating layer during the forming stage was checked. The result is shown in FIG. 20.

As seen in FIG. 20, the condition of the tip radius of the score for opening the can ranging from 0.1 to 1.0 mm and the thickness at the thinnest portion ranging from 0.025 of 0.080 mm gave no damage on the coating layer.

Embodiment 4

Embodiment 4 provides an easy-opening can end comprising: an end panel comprising a steel sheet and resin film layers on an upper surface and a lower surface of the steel sheet; a score which is formed on at least one surface of the upper surface and the lower surface of the end panel; a tab having a finger grasping portion, said tab being attached to the can end panel and being rotatable around tab-fastening means; and a slope protrusion for lifting the tab to above a height of a seam portion when the tab is rotated to a position for allowing the can open.

The tab-fastening means is positioned offset by a distance "a" expressed in the following equation from the center of the can end to the opposite side of an openable section:

$$(D-d)/2<a<d/2-l$$

The finger grasping portion has a distance "L" from the tab-fastening means, the distance "L" being defined by the following equation:

$$d-l>L>d/2-a$$

The tab has a first center line before rotation thereof and a second center line at an opening position, the first center line and the second line having an angle "θ" therebetween which is within a range defined by the equation:

$$-1<\cos\theta<1/(2\times a\times L)\times\{(d/2)^2-(L^2+a^2)\}$$

In the above equations, "a" is the distance between the center of the tab-fastening means and the center of can end, "L" is the distance between the center of the tab-fastening means and the finger grasping portion on the tab, "l" is the distance between the center of the tab-fastening means and a tab working section, "θ" the angle between the center line of tab before rotation and the center line at opening position, "d" the inner diameter of the can end, and "D" the outer diameter of the can end.

The score has a cross section of a curved surface having a radius of 0.1 to 1 mm, and the end panel has a thickness of 0.025 to 0.12 mm at the thinnest portion thereof.

Figure 21:
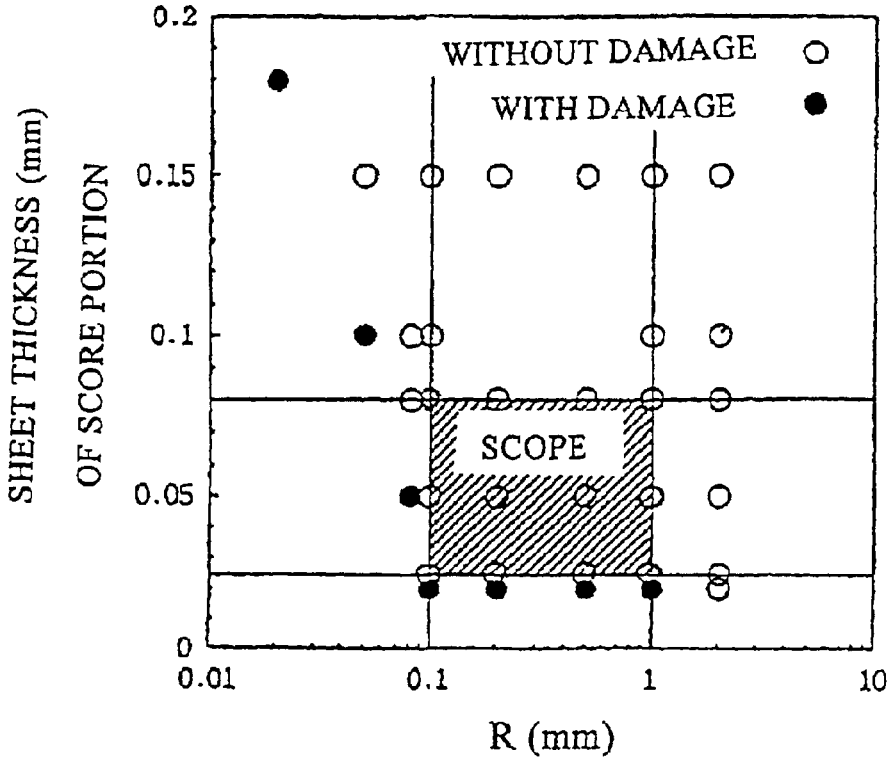
FIG. 21 is a plan view of an easy-opening can end according to the Embodiment 4.

FIG. 21 shows a plan view of the easy-opening an end according to the Embodiment 4 illustrating a mode thereof. In the figure, "a" denotes the off-set between the center of tab-fastening means 4 and the center of can end 1, "L" denotes the distance between the center of tab-fastening means 4 and the tip of the tab 3, "a" denotes the distance between the center of tab-fastening means 4 and the tip of working section of the tab 3, "θ" denotes the angle between the center line of tab before rotation and the center line after the rotation of the tab and before the opening of the can, "d" denotes the inner diameter of the can end 1, and "D" denotes the outer diameter of the can end 1.

According to the Embodiment 4, the center of the tab-fastening means 4 is displaced by an off-set of "a", which is defined by the equation (1), from the center of the can end 1 to opposite side of the can-opening section, $$(D-d)/2<a<d/2-l \quad (1)$$

and the distance "L" between the center of the tab-fastening means 4 and the tip of the tab 3 is limited by the equation (2) to extend longer than that in prior art, thus increasing the distance between the support point of lever work and the work point thereof, which increases the generated force at the work point compared with that in the prior art, $$d-l>L>d/2-a \quad (2)$$

If, however, a tab-fastening mean is applied at the center of the can end 1 as in prior art, the whole tab cannot be held within the area of the central panel section, so the performance of stacking, storing, and transporting of cans is significantly degraded. In this regard, according to the present invention, the position of the tab-fastening means 4 is moved from the center of the can end 1 to opposite side of the can opening section within a range of the equation (1), and the tab 3 is rotated by an angle of θ derived from the equation (3) around the tab-fastening means 4, $$-1<\cos\theta<1/(2\times a\times L)\times\{(d/2)^2-(L^2+a^2)\} \quad (3)$$

By moving the position of the tab-fastening means 4 by "a" and by rotating the tab 3 by an angle of "θ", the total tab is able to be held inside of the area of the central panel section 8.

Figure 22:
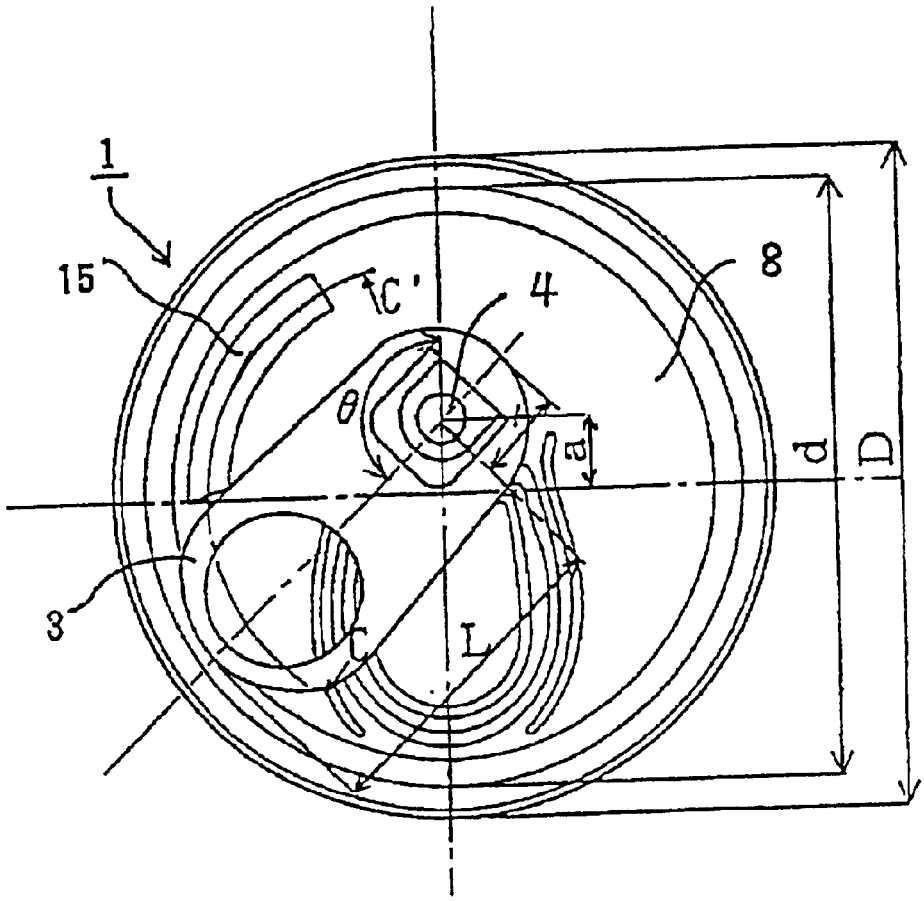
FIG. 22 is a plan view of an easy-opening can end after rotating the tab and immediately before opening the can according to the Embodiment 4.

In addition, as shown in FIG. 22, the tab 3 is rotated around the tab-fastening means 4 from the disabled-opening position to the enabled-opening position during the can-opening step. With the simple rotation, however, the tab edge section collides against the seam section in the periphery of the can end to prevent further rotation of the tab 3. To solve the problem, a slope-shape protrusion 5 is formed on the center panel section 8. By pulling-up the tip of the tab 2 to above the height of the seam section, it becomes possible to rotate the tab 3 to the enabled-opening position.

After the tab 3 is rotated to the enabled-opening position in this manner, the tab picking-up edge becomes outside of the outer periphery of the can end (or the outer periphery of the seam section) so that the finger picking and holding the tab 3 are easily done.

FIG. 21 uses a rivet as a means to hold the tab 3 in free-rotational angle movement. The means is, however, not limited to the rivet, and a tab-fastening mean material having the same construction may be attached to the central panel section using an adhesive. The shape of the tab 3 is preferably raised from the can end for easy angle movement and for easy finger picking.

Figure 23:
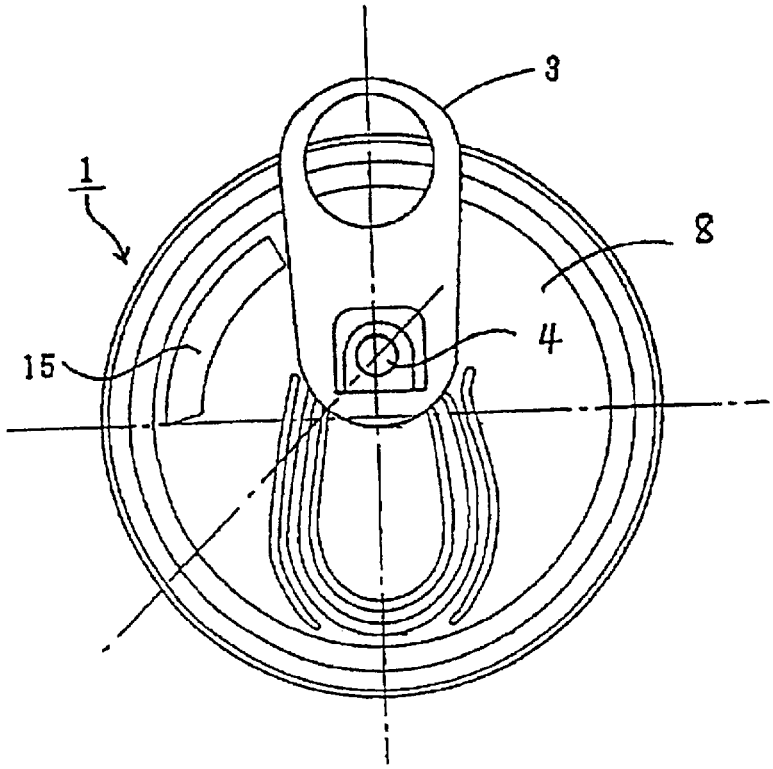
FIG. 23 is a cross sectional view of a score portion formed on the can end panel according to the Embodiment 4.

As shown in FIG. 23 of a cross sectional view of the score for opening the can, the can end according to the Embodiment 4 has a score 2 for opening the can on a surface 1*a* of the can end 1 made of a steel sheet laminated by a resin coating layer on both sides thereof and having a thickness of $t_0$, which score 2 has a curved shape cross section having the radius (R) ranging from 0.1 to 1.0 mm and having a thickness ($t_s$) at the thinnest portion 2*a* ranging from 0.025 to 0.120 mm.

Figure 24:
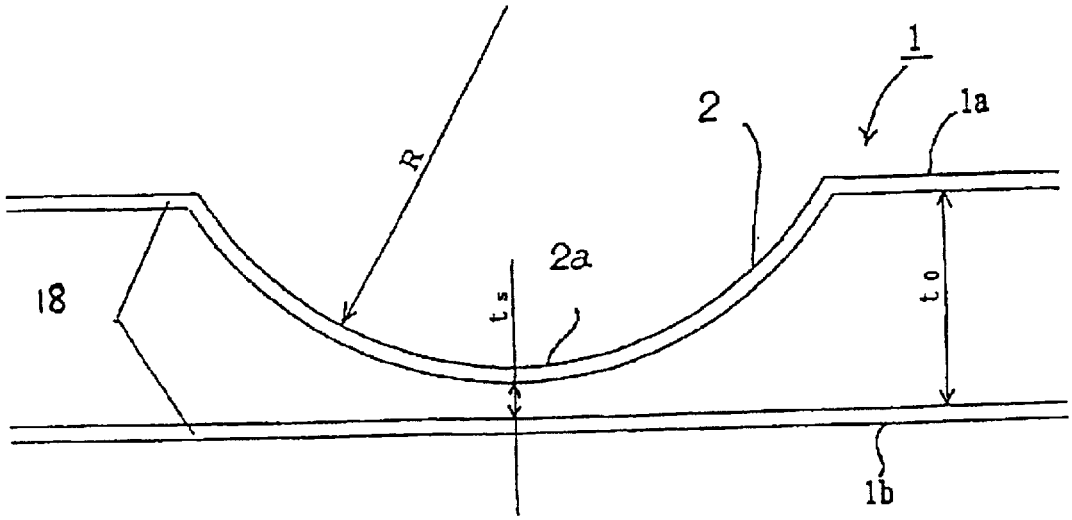
FIG. 24 is another cross sectional view of a score portion formed on the can end panel according to the Embodiment 4.

FIG. 24 shows another easy-opening can end according to the Embodiment 4, illustrating the score for opening the an formed on the can end. As seen in FIG. 24, the scores 2,2 for opening the can having a curved shape of bottom cross section are formed on the upper surface 1*a* and the lower surface 1*b* of the can end 1 made of a steel sheet laminated by a resin coating layer on both sides thereof, which can end 1 has a thickness of $t_0$, and which score has the values of radius (R) ranging from 0.1 to 1.0 mm and has the values of thickness ($t_s$) at the thinnest portion 2*a* ranging from 0.025 to 0.120 mm.

Owing to the score 2 for opening the can having a curved shape with above-described radius (R) on the upper surface 1*a* or on both of the upper surface 1*a* and the lower surface 1*b* of the can end, along with the above-described tab mechanism, the can-opening force is stably reduced to a level that child or aged person is able to easily open the can, while preventing the generation of shock fracture.

For the case that the score 2 for opening the can is formed on the upper surface 1*a* of the can end 1, or formed on both of the upper surface 1*a* and the lower surface 1*b* of the can end, provided by the bottom cross sectional radius (R) of each score 2 being less than 0.1 mm, it is difficult to form the above-described score 2 for opening the can on the can end panel without damaging the resin coating layer. On the other hand, when the bottom cross sectional radius (R) of the above-described score 2 for opening the can exceeds 1.0 mm, the area of thin-thickness portion on the can end 1 increases to make the breaking position of the opening section unstable, which results in poor shape of opening and induces a problem of increased "sagging", or a portion of the broken section hangs down. It is also practically impossible to form a score 2 for opening the can with widths wider than 1.0 mm on a can end panel having a limited space.

For the values of thickness of the thinnest portion 2*a* on the score 2 for opening the can are less than 0.025 mm, if a can with that kind of can end panel is dropped or is subjected to external shock, the opening section may be fractured. On the other hand, if the thickness of the thinnest portion 6*a* on the score 2 for opening the can exceeds 0.120 mm, then a problem of needing a large can-opening force arises.

Consequently, the bottom cross sectional shape of the score for opening the can formed on at least one of the upper surface and the lower surface of the can end made of resin-laminated steel sheet being coated by resin layer on both sides is necessary to have a curved surface having radius ranging from 0.1 to 1.0 mm and having thickness at the thinnest portion being ranging from 0.025 to 0.120 mm.

The can end having a score for opening the can with the above-described curved surface cross sectional shape according to the Embodiment 4 is applicable to both the pull-top tab can end and the stay-on tab can end. Generally, the materials of the can end are aluminum plate, surface-treated steel sheet coated with a metal, or metal-coated steel sheet laminated by a resin coating layer, with thickness of metal sheet ranging from 0.15 to 0.30 mm.

Example

The Embodiment 4 is further described in the following referring to example and comparative example.

A tin-free steel sheet was prepared from a thin steel sheet having a thickness of 0.25 mm and a tensile strength of 440 MPa by forming a chromate coating layer on the upper surface thereof, which chromate coating layer consists of a chromated metal chromium layer with a coating weight of 120 mg/m$^2$ and of a top layer of chromium oxide hydrate with a coating weight of 15 mg/m$^2$ as metallic chromium. On both sides of thus prepared tin-free steel sheet, a thermal-fusing film having a thickness of 25 μm was laminated. To the film-laminated steel sheet, a pair of dies one of which has a curved surface with tip radius ranging from 0.1 to 1.0 mm while the other has a flat surface were applied, thus press-formed the can end panel to give thickness at the thinnest portion ranging from 0.025 to 0.120 mm, to form the score for opening the can on the surface of the can end panel. A tab 3 having a structure shown in FIG. 1 and having the dimensions described below was attached to thus prepared can end panel. As a result, the test samples No. 1 through No. 10 for stay-on tab easy-opening can ends within a range specified by the present invention were prepared, which samples are listed in Table 7. (Hereinafter these test samples are referred to as the test samples of the present invention.)

Off-set between the center of tab-fastening mean and the center of can end (a): 5 mm Distance between the center of tab-fastening mean and the finger-picking section on the tab (L): 25 mm Distance between the center of tab-fastening mean and the tab working section (e): 10 mm Inner diameter of the can end (d): 49 mm Outer diameter of the can end (D): 53 mm For comparison, the above-described tin-free steel sheet was press-formed using a pair of dies one of which has a score for opening the can on the curved surface thereof with radius and/or thickness at the thinnest portion thereof outside of the range specified by the present invention, and the other of which has a flat surface to form a score for opening the can on the upper surface of the can end, thus prepared the test samples Nos. 1 through 14 for stay-on tab easy-opening can ends shown also in Table 7. (Hereinafter these test samples are referred to as the comparative test samples.)

TABLE 7

| No. | | Die radius (mm) | Sheet thickness at the thinnest portion (mm) | Lubrication during forming | Pop value (kg) | Damage on coating layer | Separation of coating layer | Shock fracture |
|---|---|---|---|---|---|---|---|---|
| Sample of the present invention | 1 | 0.100 | 0.025 | Rotational tab | 0.6 | Not occurred | Not occurred | Not occurred |
| | 2 | 0.100 | 0.050 | Rotational tab | 1.0 | Not occurred | Not occurred | Not occurred |
| | 3 | 0.100 | 0.080 | Rotational tab | 1.8 | Not occurred | Not occurred | Not occurred |
| | 4 | 0.100 | 0.100 | Rotational tab | 2.0 | Not occurred | Not occurred | Not occurred |
| | 5 | 0.500 | 0.025 | Rotational tab | 0.6 | Not occurred | Not occurred | Not occurred |
| | 6 | 0.500 | 0.120 | Rotational tab | 2.5 | Not occurred | Not occurred | Not occurred |
| | 7 | 0.800 | 0.025 | Rotational tab | 0.7 | Not occurred | Not occurred | Not occurred |
| | 8 | 0.800 | 0.120 | Rotational tab | 2.5 | Not occurred | Not occurred | Not occurred |
| | 9 | 1.000 | 0.025 | Rotational tab | 0.9 | Not occurred | Not occurred | Not occurred |
| | 10 | 1.000 | 0.120 | Rotational tab | 2.4 | Not occurred | Not occurred | Not occurred |
| Comparative test sample | 1 | 0.025 | 0.020 | Rotational tab | 0.4 | Occurred | Occurred | Occurred |
| | 2 | 0.050 | 0.020 | Rotational tab | 0.4 | Occurred | Occurred | Occurred |
| | 3 | 0.500 | 0.020 | Rotational tab | 0.5 | Not occurred | Not occurred | Occurred |
| | 4 | 1.000 | 0.020 | Rotational tab | 0.5 | Not occurred | Not occurred | Occurred |
| | 5 | 0.025 | 0.150 | Rotational tab | 3.0 | Occurred | Occurred | Not occurred |
| | 6 | 0.100 | 0.150 | Rotational tab | 3.0 | Not occurred | Not occurred | Not occurred |
| | 7 | 0.500 | 0.150 | Rotational tab | 2.9 | Not occurred | Not occurred | Not occurred |
| | 8 | 1.000 | 0.150 | Rotational tab | 3.2 | Not occurred | Not occurred | Not occurred |
| | 9 | 1.200 | 0.050 | Rotational tab | 1.2 | Not occurred | Not occurred | Not occurred |
| | 10 | 1.500 | 0.080 | Rotational tab | 1.5 | Not occurred | Not occurred | Not occurred |
| | 11 | 0.025 | 0.100 | Conventional tab | 3.0 | Occurred | Occurred | Not occurred |
| | 12 | 0.100 | 0.100 | Conventional tab | 2.8 | Not occurred | Not occurred | Not occurred |
| | 13 | 0.500 | 0.120 | Conventional tab | 3.3 | Not occurred | Not occurred | Not occurred |
| | 14 | 1.000 | 0.120 | Conventional tab | 3.3 | Not occurred | Not occurred | Not occurred |

For each of the above-described samples of the present invention and comparative samples, Pop value and presence/absence of damage on coating layer, of separation of coating layer, and of shock fracture were determined in accordance with the procedure described below. The result is also shown in Table 7. Pop value (kg) was determined by the force that begins to open the can end opening section under a constant tensile force applied to the tab on the can end. Shock fracture was evaluated by the presence/absence of shock fracture when a can is dropped from 1 m above the concrete floor against the floor in a slanted position of the can facing the can end 1 downward to apply a shock force to the can end 1. Damage on coating layer was evaluated by the presence/absence of rust after applying specified corrosion test. Separation of coated layer was evaluated by the presence/absence of separation of coating layer under a cross section observation.

As seen in Table 7, the comparative test samples Nos. 1 and 2 which had smaller radius (R) of the score for opening the can and smaller thickness at the thinnest portion than the range according to the present invention generated damage of coating layer and shock fracture. The comparative test samples Nos. 3 and 4 which had smaller thickness at the thinnest portion than the range specified by the present invention gave shock fracture even the radius (R) of the score for opening the can was within the range according to the present invention. The comparative test samples Nos. 5 through 8 which used the rotary tab according to the present invention and had larger thickness at the thinnest portion than the range according to the present invention gave large Pop values ranging from 2.9 to 3.2 kg, and showed poor can-openability.

The comparative test samples Nos. 9 and 10 which had larger radius (R) of the score for opening the can than the range according to the present invention gave low Pop values and generated no shock fracture, but gave poor shape of opening section. The comparative test samples Nos. 11 through 14 which used the conventional tub gave high Pop values ranging from 2.8 to 3.3 kg and gave poor can-openability even they had radius (R) of the score for opening the can and thickness at the thinnest portion thereof within the range according to the present invention.

Embodiment 5

Embodiment 5 provides an easy-opening can end comprising: a end panel comprising a steel sheet having a tensile strength (TS) of 30 to 45 kgf/mm$^2$ and a work-hardening coefficient (n-value) of 0.15 to 0.2; and a score which is formed on at least one surface of an upper surface and a lower surface of the end panel.

The inventors of the present invention carried out survey and investigation on the can-opening mechanism of stay-on tab easy-opening can end which has become the mainstream of the can ends, and found that the fracture of score for opening the can occurs under tensile stress as the principal stress. According to the past concept, the opening of pull-top tab can end develops the tensile stress as the principal stress, but the opening of stay-on tab can end is governed by shearing stress as the principal stress. However, the inventors of the present invention inspected the fracture mode of the opening section on commercially available cans in detail and analyzed the phenomena of fracture, and found that the score for opening the can functions under tensile stress as the principal stress, and break occurs mainly from tensile strain.

Based on the finding, the inventors conducted intense study on the steel performance suitable for the stay-on tab easy-opening can end which shows excellent can-openability, and confirmed that the tensile strength (TS) and the work-hardening coefficient (n-value) of steel sheet are critical variables affecting the break-strength of the score for opening the can after formed into a can end. The tensile strength is determined by a tensile test using JIS No.5 specimens at a tensile speed of 10 mm/min. The n-value is determined by approximation using the least square method in accordance with the equation (1) giving the relation between the true stress ($\sigma$) and the true strain ($\epsilon$) in a range of from the point of 2% strain to the point of the maximum load. The symbol k in the equation (4) is a constant.

$$\sigma = k\epsilon^n \quad (4)$$

Figure 25:
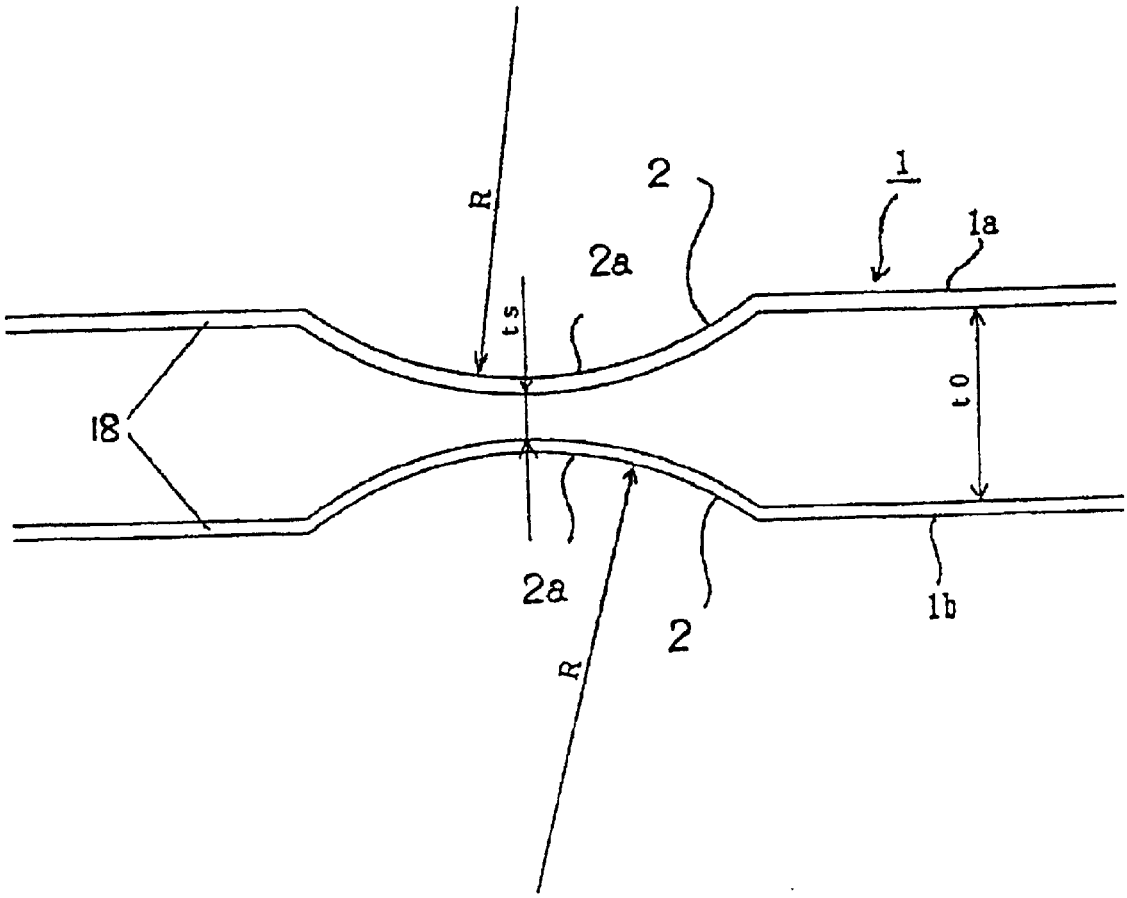
FIG. 25 is a graph showing the relation between the sheet thickness at the score portion and the tensile strength after the score was formed for the Steel A according to the Embodiment 5.
Figure 26:
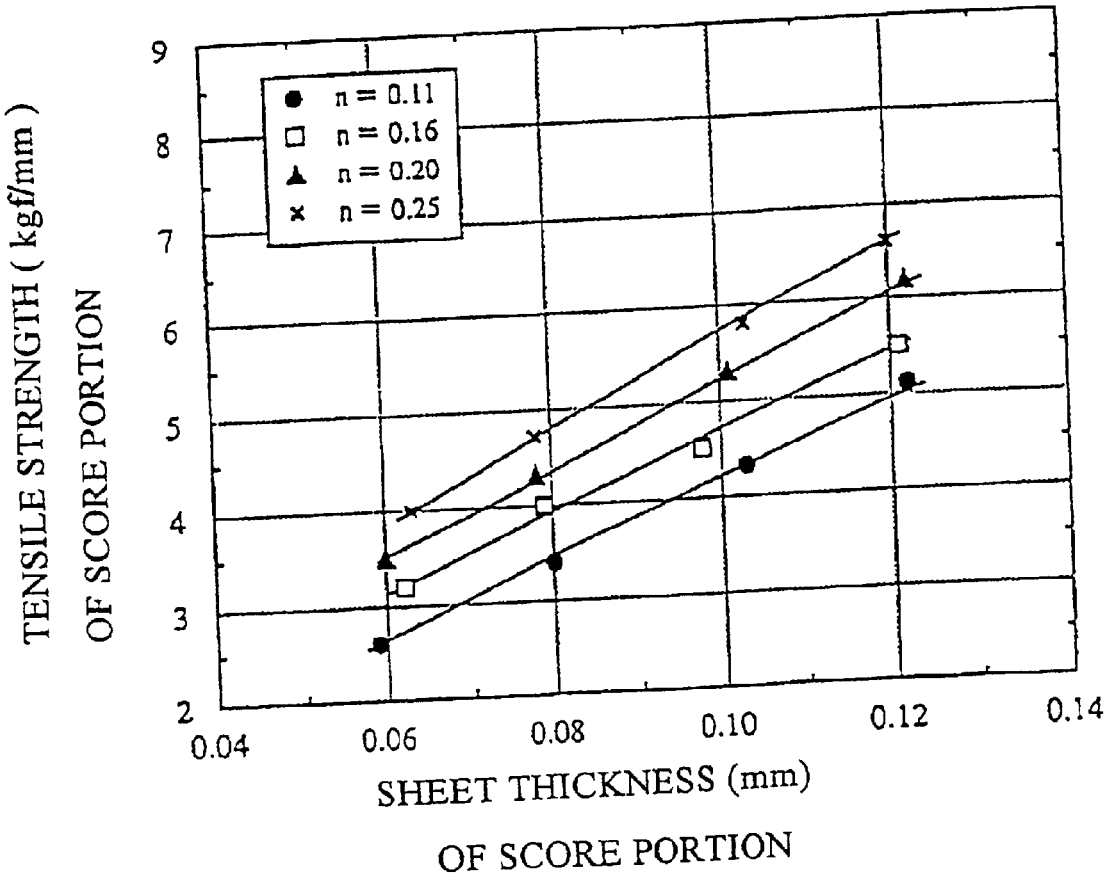
FIG. 26 is a graph showing the relation between the sheet thickness at the score portion and the tensile strength after the score was formed for the Steel B according to the Embodiment 5.

FIG. 25 shows the relation between the remaining sheet thickness at the score portion and the tensile strength of the score portion after being worked, for the steel A shown in Table 8. The tensile test was conducted by processing the base material the steel A under temper rolling rates of from 1.5 to 15% and finished sheet thickness of 0.3 mm, as shown in Table 9, to form strip test pieces, and by forming a straight score giving different remaining sheet thickness for each of the test pieces using a die having a cross sectional shape illustrate in FIG. 10. Since the tensile strength at the score portion is necessary to be evaluated taking into account both the remaining sheet thickness at the score portion and the degree of work hardening, the load was selected not on the basis of unit area, but as the value of the maximum load divided by the plate width. FIG. 26 shows the relation between the remaining sheet thickness at the score portion and the tensile strength at the score portion after being worked, for the steel B shown in Table 8. A similar test as for the steel A was performed on the steel B after processing the steel B under temper rolling rates of from 0 to 12% and a finished sheet thickness of 0.2 mm.

TABLE 8

| Test specimen | Chemical analysis (wt. %) | | | | | | | | | |
|---|---|---|---|---|---|---|---|---|---|---|
| | C | Si | Mn | P | S | Sol. Al | N | Nb | Cr | B |
| Steel A | 0.0023 | 0.01 | 0.12 | 0.010 | 0.013 | 0.039 | 0.0025 | 0.035 | 0.03 | — |
| Steel B | 0.0019 | 0.01 | 0.52 | 0.008 | 0.011 | 0.041 | 0.0028 | 0.030 | 0.03 | 0.0023 |

TABLE 9

| Test specimen | Steel type | Temper rolling rate (%) | Tensile strength of base material (kgf/mm$^2$) | n-value | Rivet form-ability) | Initial can opening load (kgf) | Total evalu-ation | Remark |
|---|---|---|---|---|---|---|---|---|
| No. 1 | Steel A | 1.5 | 30.0 | 0.25 | ○ | 1.7 | X | Comparative steel |
| No. 2 | Steel A | 5 | 32.6 | 0.20 | ○ | 1.4 | ○ | Steel of the present invention |
| No. 3 | Steel A | 10 | 34.1 | 0.16 | ○ | 1.2 | ○ | Steel of the present invention |
| No. 4 | Steel A | 15 | 34.9 | 0.11 | X | — | X | Comparative steel |
| No. 5 | Steel B | 0 | 31.2 | 0.23 | ○ | 1.8 | X | Comparative steel |
| No. 6 | Steel B | 2 | 35.3 | 0.18 | ○ | 1.5 | ○ | Steel of the present invention |
| No. 7 | Steel B | 7 | 40.2 | 0.15 | ○ | 1.3 | ○ | Steel of the present invention |
| No. 8 | Steel B | 12 | 42.7 | 0.09 | X | — | X | Comparative steel |
| Commercial steel | — | — | — | — | — | 1.8 | — | — |
| Commercial steel | — | — | — | — | — | 1.6 | — | — |

These figures show that, even the same remaining sheet thickness at the score portion, the material giving less n-value shown in Table 9 has less tensile strength at the score portion. If a base material having less n-value is used, the degree of work-hardening is less so that the score introduction at the same working rate suppresses the increase in the tensile strength at the score portion after being worked, thus enabling the reduction in can-opening load. When FIG. 25 and FIG. 26 are compared to each other, the material having less tensile strength of the base to material shown in Table 9 gives less tensile strength at the score portion after being worked even when the n-value is at a similar level. So the influence of the tensile strength of the base material on the tensile strength at the score portion was investigated with respect of commercial tin plates. As a result, it was found that when the tensile strength of the base material exceeds 45 kgf/mm$^2$, the tensile strength at the score portion after working becomes larger in spite of the n-value and it is impossible to reduce the can-opening load. To satisfactorily reduce the can-opening load, it is necessary for the n-value to be limited to 0.20 or less, and the tensile strength of the base material to be limited to 45 kgf/mm$^2$ or less. It is possible to have a larger remaining sheet thickness at the score portion than the conventional steel-made easy-opening end by reducing the can opening load, thus it is possible to reduce the tool abrasion, to increase the working accuracy, and also to reduce the accidental can-opening caused by internal defects of the steel sheet.

On the other hand, from the viewpoint of can end fabrication, in particular of rivet formability, larger n-value is preferable. If the n-value is less than 0.15, then sufficient protrusion-formability is not attained, and the rivet-formability becomes difficult. Therefore, the n-value shall be 0.15 or more.

For attaining favorable can-openability, the tensile strength of the base material is preferably at a low level. From the standpoint to assure the strength of can end panel, however, the lower limit of the tensile strength of base material should be selected to 30 kgf/mm$^2$. The yield strength is not specifically specified, but the yield strength is preferably 20 kgf/mm or more to stably ensure the strength of can end panel.

The effect of the present invention is functioned even when the steel according to the present invention is subjected to a single or combined use of plating such as tin plating, chromium plating, nickel plating, various kinds of chemical conversion processes, and resin coating such as lamination and painting.

During the fabrication of can end from the steel sheet according to the present invention, can end shape, method for forming a score for opening the can, score shape, and remained sheet thickness at the score portion are not specifically limited. Regarding the method for forming score, various methods other than general method are applicable, and any method ensures the effect of the present invention if only the method allows the steel sheet as the base material to conduct work-hardening at the score portion. The degree of work-hardening at the score portion differs with the method for forming score. Accordingly, the remained sheet thickness of the score portion should be selected within a range that the can-openability is favorable while taking into account of the stability of work-accuracy and the tool life.

Example

The Embodiment 5 is explained in more detail in the following with comparison between Examples and Comparative Examples.

EXAMPLE 1

A steel slab having the composition of the steel A shown in Table 8 was hot-rolled, pickled, and cold-rolled to the values of thickness of from 0.30 to 0.35 mm, followed by continuous annealing using known process. The steel sheet was then temper-rolled with the temper-rolling rates of Nos. 1 through 4 shown in Table 9 to give a finished sheet thickness of 0.30 mm. Thus prepared steel sheets were coated on both sides thereof with an electrolytic tin coating layer at coating weights of from 2.8 to 2.9 $\mu$m$^2$, further treated by chromate processing to form a metallic chromium layer at coating weights of from 12 to 14 mg/m$^2$ and further to form a chromium oxide hydrate layer at coating weights of from 10 to 12 mg/m$^2$ as metallic chromium. Table 9 also shows the observed values of tensile strength and n-value of the base material. Regarding the steel sheets shown in Table 9, Nos. 2 and 3 are the steels according to the present invention, and Nos. 1 and 4 are the comparative steels.

Thus prepared four kinds of steel sheets were processed to fabricate the stay-on tab easy-opening can end having a diameter of 202, which type can end has been widely used as the lids of drinks cans. For these can ends, the rivet-formability and the can-openability were evaluated. Formation of a score for opening the can was done by common method. The remained sheet thickness of the score portion was selected to 90 $\mu$m. The result of evaluation is given in Table 9. As for the rivet-formability, the test specimen that assured necessary protrusion height during can end fabrication and that formed the rivet without problem is marked with (o), the test specimen that failed to attain necessary protrusion height because of breaking and that failed to form the rivet is marked with (x). For the evaluation of can-openability, the load of initial can-opening (what is called the Pop value) was determined using a tensile tester.

EXAMPLE 2

A steel slab having the composition of the steel B shown in Table 8 was hot-rolled, pickled, and cold-rolled to the values of thickness of from 0.20 to 0.23 mm, followed by continuous annealing using known process. The steel sheet was then temper-rolled with the temper-rolling rates of Nos. 5 through 8 shown in Table 9 to give a finished sheet thickness of 0.20 mm. Thus prepared steel sheets were treated on both sides thereof by chromate processing to form a metallic chromium layer at coating weights of from 115 to 121 mg/m$^2$ and further to form a chromium oxide hydrate layer at coating weights of from 11 to 16 mg/m$^2$ as metallic chromium. Table 9 also shows the observed values of tensile strength and n-value of the base material using the method described before. Regarding the steel sheets shown in Table 9, Nos. 6 and 7 are the steels according to the present invention, and Nos. 5 and 8 are the comparative steels.

Thus prepared four kinds of steel sheets were processed to fabricate the stay-on tab easy-opening can end having a diameter of 202 following the same procedure as in Example 1. The remained sheet thickness of the score portion was selected to 60 $\mu$m. The result of evaluation is given in Table 9 on the same criteria.

For comparison of can-openability, the load of initial can-opening of commercially available stay-on tab easy-opening cans having a diameter of 202, (Commercial Nos. 1 and 2) shown in Table 10 was determined using the same procedure as in Example 1. The result is shown in Table 9.

TABLE 10

| Test specimen | End panel material | Thickness of base material (mm) | Remained sheet thickness at score portion |
|---|---|---|---|
| Commercial No.1 | Steel sheet | 0.22 | 50 |
| Commercial No.2 | Aluminum alloy | 0.30 | 90 |

As shown in the evaluation result in Table 9, the steel sheets according to the present invention have satisfactory rivet-formability. The easy-opening can ends fabricated from the steel sheets according to the present invention give less load of initial can-opening and have good can-openability compared with both of the commercially available products made of steel sheet and of aluminum alloy, in spite of larger remained sheet thickness at score portion than the Commercial No.1 (can end made of commercially available steel sheet).

The comparative steels Nos. 1 and 5 which had larger n-values than the range specified by the present invention gave heavier load of initial can-opening and showed poorer can-openability than those of Commercial No.2 made of commercially available aluminum alloy, though the rivet-formation was performed without problem. The comparative steels Nos. 4 and 8 which gave smaller n-values than the range specified by the present invention induced break during rivet-formation and failed to fabricate the can end.

As the total evaluation, the test specimen which gave good rivet-formation and showed lighter load of initial can-opening than Commercial No.2 is marked with (o), and the test specimen other than the above-described conditions is marked with (x). The result is listed in Table 2. The steels giving the characteristics range specified by the present invention have satisfactory rivet-formability and good can-openability. The steels giving the characteristics outside of the range specified by the present invention gave inferiority either in the rivet-formability or the can-openability.

Embodiment 6

Embodiment 6 provides a method for making an easy-opening can end comprising the steps of: providing a end panel comprising a metal sheet having a thickness of $t_0$ (mm), a work-hardening coefficient of n in a 40 to 90% range of uniform elongation region and a tensile strength of TS (kgf/mm$^2$);

providing an upper die and a lower die; and press-forming the end panel by using the upper die and the lower die to form a score on the end panel.

The press-formed can end panel has a thickness t (mm) at the thinnest portion thereof, the thickness t (mm) satisfying the following equations.

$$2.5 \leqq P \leqq 5.0$$

$$P = t \times TS \times \{\exp(n)/(n^n)\} \times [2/\sqrt{3} \times |\ln\{1+(t-t_0)\}|]^n$$

When the score is formed on an upper surface or a lower surface of the end panel, either the upper die or the lower die has a curved surface with a radius ranging from over 0.025 to 1 mm at the tip portion thereof and the other die has a flat surface at the tip portion thereof. When the scores are formed on an upper surface and a lower surface of the end panel, the upper die and the lower die have a curved surface with a radius ranging from over 0.025 to 1 mm at the tip portion thereof.

The method for manufacturing easy-opening can end according to the present invention is described in more detail in the following referring to the drawings.

Figure 27:
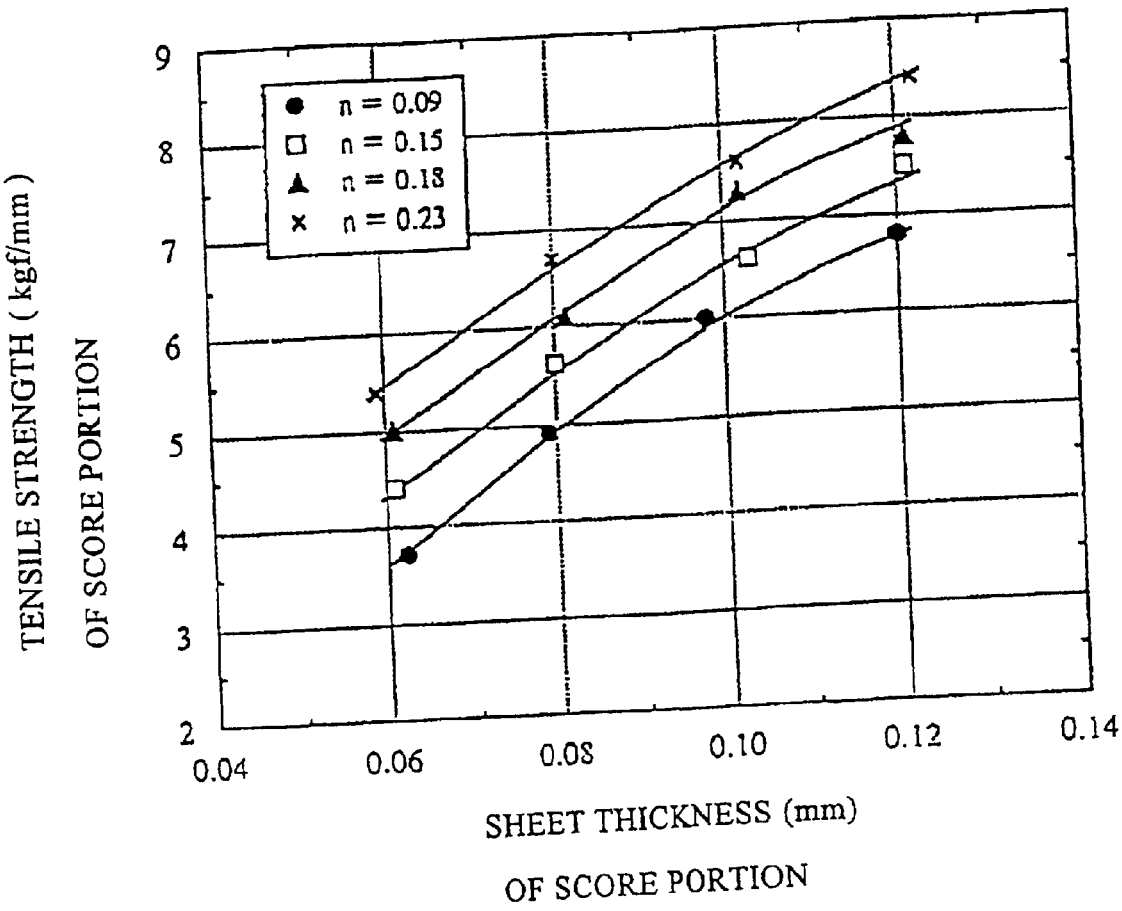
FIG. 27 is a cross sectional view of a score portion formed on the can end according to the Embodiment 6.

FIG. 27 is a cross sectional view of the score for opening the can formed on the can end. As shown in the figure, a die having a curved surface with the values of radius (R) thereof ranging from more than 0.025 mm and nor more than 1.0 mm is applied to the upper surface 1*a* of the can end 1 having a thickness of $t_0$, and a die having a flat surface is applied to the lower surface of the can end 1 to press-form the core 2 for opening the can to give a curved bottom cross section with a thickness t at the thinnest portion 2*a* thereof. The formation of the score is conducted to give a work-hardening coefficient of n in a 40 to 90% range of a uniform elongation region of the metal sheet forming the can end 1, and a tensile strength of TS (kgf/mm$^2$) thereof, and t which satisfy the following equations:

$$2.5 \leqq P \leqq 5.0,$$

$$P = t \times TS \times \{\exp(n)/(n^n)\} \times [2/\sqrt{3} \times |\ln(1+(t-t_0/t_0\}|]^n.$$

Figure 28:
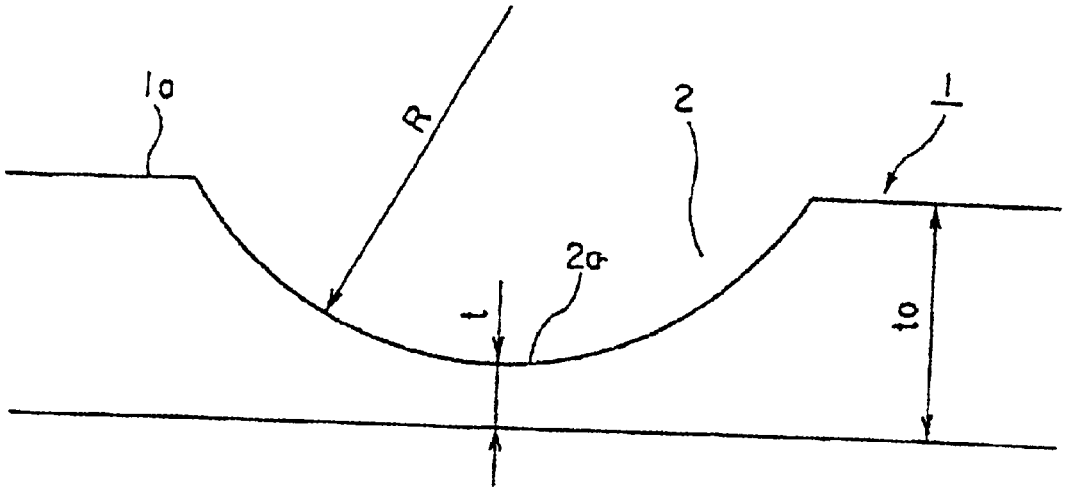
FIG. 28 is another cross sectional view of a score portion formed on the can end according to the Embodiment 6.

FIG. 28 is another cross sectional view of the score for opening the can formed on the can end. As shown in the figure, to the upper surface 1*a* and the lower surface 1*b* of the can end 1 having a thickness of to and being formed on the can end, each die having a curved surface with the values of radius (R) thereof ranging from more than 0.025 mm and not more than 1.0 mm is used to press-form the scores 2,2 for opening the can, respectively, to give a curved bottom cross section thereof, while giving a thickness at the thinnest portion 2*a* as t. The formation of the score is conducted to have a work-hardening coefficient of n in a 40 to 90% range of a uniform elongation region of the metal sheet forming the can end 1, and a tensile strength of TS in kgf/mm$^2$ thereof, and t which satisfy the following equations:

$$2.5 \leqq P \leqq 5.0,$$

$$P = t \times TS \times \{\exp(n)/(n^n)\} \times [2/\sqrt{3} \times |\ln(1+(t-t_0)/t_0\}|]^n.$$

Owing to the score 2, or scores 2,2 for opening the can having a curved shape with above-described radius (R) on the upper surface 1*a* or on both of the upper surface 1*a* and the lower surface 1*b* of the can end 1, the can-opening force is stably reduced to a level that child or aged person is able to easily open the can, while preventing the generation of shock fracture.

If the radius (R) of die for forming the score 2 for opening the can is 0.025 mm or less in forming score for opening the can on the upper surface or both the upper and lower surfaces of the can end 1, the working accuracy of the die degrades, die abrasion during forming works increases, and the die is requested to be replaced in a short period to secure scores in a stable shape, which is uneconomical.

If the radius (R) of the die exceeds 1.0 mm, the area of thin sheet section of the can end 1 increases, which results in unstable break-position of the can-opening section to make the opening shape poor, and further "sagging" (a portion of broken section is hung down) increases. It is also practically impossible to form a score for opening the can with widths wider than 1.0 mm on a can end panel having a limited space.

The sheet thickness t at the thinnest portion 2*a* of the score 2 for opening the can is formed under the condition of $2.5 \leqq P \leqq 5.0$, where $P = t \times TS \times \{\exp(n)/(n^n)\} \times [2/\sqrt{3} \times |\ln(1+(t-t_0)/t_0\}|]^n$, n is a work-hardening coefficient in a 40 to 90% range of uniform elongation region of the metal sheet forming the can end 1, and TS (kgf/mm$^2$) is a tensile strength thereof. The score 2 for opening the can is formed by press-forming the metal sheet for fabricating the can end using the dies having the shape described above. When, however, that kind of forming induces work-hardening at the thinnest portion 2*a* obtained by the working, thus the strength increases. The degree of work-hardening differs with the ratio of the original thickness $t_0$ of the metal sheet to the worked sheet thickness t, and the strength at the thinnest portion increases with decrease in the t value. When the equivalent stress at the thinnest portion is expressed by $\sigma$, and the equivalent strain is expressed by $\epsilon$, then their relation is defined by the equation of $\sigma = K \times \epsilon^n$. When the work-hardening coefficient in a 40 to 90% range of uniform elongation region of the metal sheet forming the can end 1 is expressed by n, and the tensile strength is expressed by TS (kgf/mm$^2$), the relation of $TS = K \times n^n/\exp(n)$ derives the following equation: $K = TS \times \{\exp(n)/(n)^n\}$. The strain $\epsilon$ ts in the sheet thickness direction induced by the formation of score for opening the can is written as the following equation: $\epsilon ts = \ln\{1+(t-t_0)/t_0\}$. The equivalent strain $\epsilon$ at the thinnest portion of the score for opening the can is written as the following equation with the assumption of flat plane strain:

$$\epsilon = 2/\sqrt{3} \times |\ln\{1+(t-t_0)/t_0\}|$$

From the above equations, the equivalent stress σ at the thinnest portion 2*a* is written as:

$$\sigma = TS \times \{\exp(n)/(n)^n\} \times [2/\sqrt{3} \times |\ln\{1+(t-t_0)/t_0\}|^n$$

The tensile break force P to break the thinnest portion 2*a* of the score for opening the can mainly by the tensile deformation is expressed by the equation of P=σ=t.

Thus, the expression becomes to the equation.

$$P = t \times TS \times \{\exp(n)/(n^n)\} \times [2/\sqrt{3} \times |\ln(1+(t-t_0)/t_0\}|]^n$$

As a result, less value of P decreases the can-opening force. And the effect becomes stable when the value of P is 5.0 or less. If the value of P exceeds 5.0, a large can-opening force is required, and a problem arises. If the value of P is less than 2.5, when a can with the formed can end is dropped or is subjected to external shock, the opening section may be fractured.

Therefore, the following-described conditions shall be satisfied to form a score for opening the can on the upper surface or both of the front and lower surfaces of the can end:

using a base material having a sheet thickness of $t_0$ (mm), a work-hardening coefficient in a 40 to 90% range of uniform elongation region of n, and a tensile strength of TS (kgf/mm$^2$);

using a pair of dies either one of which has a curved surface with tip radius ranging from more than 0.025 mm and not more than 1.0 mm, while the other of which has a flat surface, or using a pair of dies both of which have a curved surface with tip radius ranging from more than 0.025 mm and not more than 1.0 mm;

to apply press-forming to give a thickness t (mm) at the thinnest portion to form a score for opening the can; and satisfying the relation of $2.5 \leqq P \leqq 5.0$, where $P = t \times TS \times \{\exp(n)/(n^n)\} \times [2/\sqrt{3} \times |\ln(1+(t-t_0)/t_0\}|]^n$.

The metal sheet used in the above-described method for manufacturing a can end may be an aluminum alloy plate, a steel sheet, or any other metallic plate. Adequate kind of metal sheet may be adopted for individual objectives. An easy-opening can end is generally provided with a tab for opening the can. If a rivet mechanism is employed as the tab-attaching means, a preferable range of the work-hardening coefficient n of uniform elongation region is 0.15 or more, from the viewpoint of rivet-formability. When corrosion resistance is necessary to be assured, the metal sheet may be coated by various kinds of plating, chemical conversion, painting, or lamination of resin layer on either side or both of the front and the lower surfaces thereof.

The above-described method for manufacturing can end is applicable to both the pull-top tab can end , the stay-on tab can end , and the full-open can end.

Figure 29:
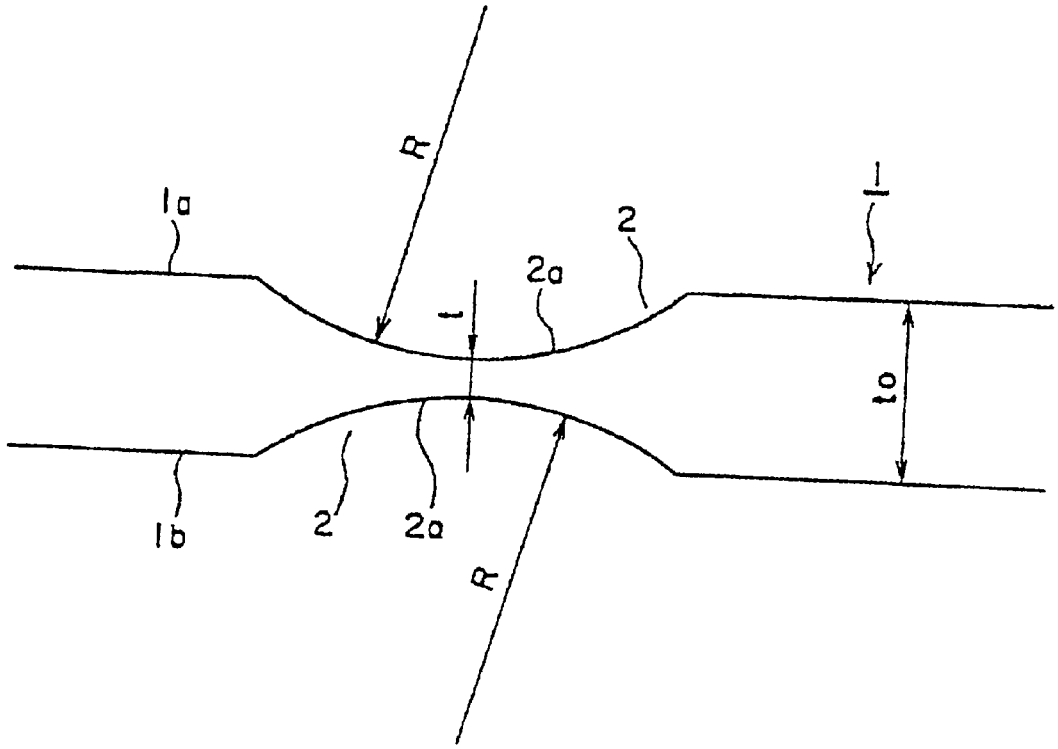
FIG. 29 and FIG. 30 are plan views of an easy-opening can end formed on the can end according to the Embodiment 6.
Figure 30A:
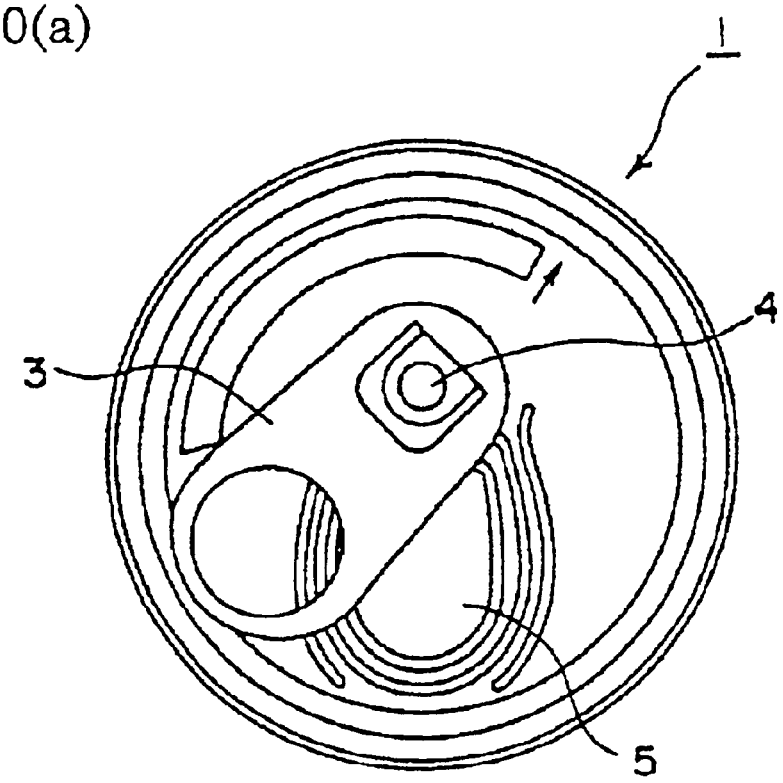
Figure 30B:
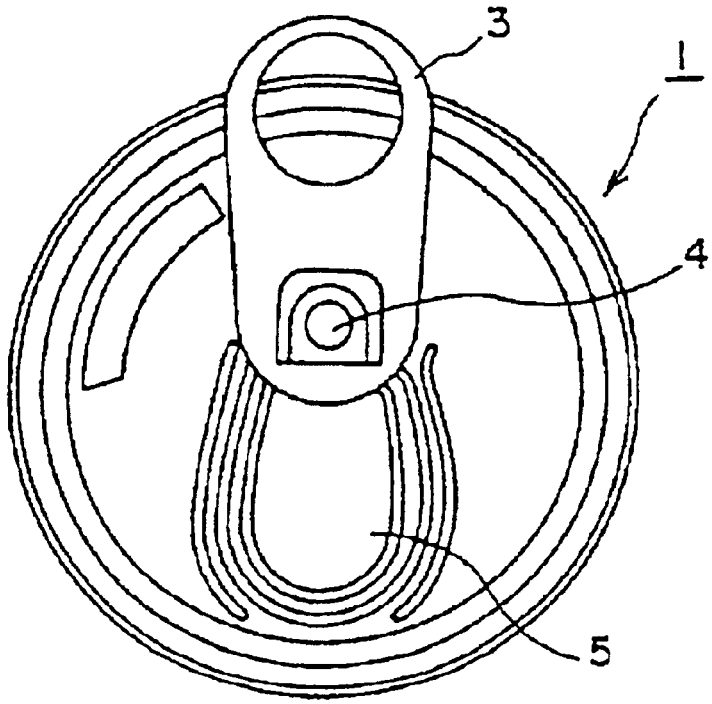

Alternatively, as shown in FIG. 29, if the tab 3 is attached to the can end 1 in a manner that the tab-fastening mean 4 is at an off-set position against the center of the can end 1 toward the opposite side of the opening section 5 to allow the tab 3 to rotate around the tab-fastening mean 4, while lengthening the distance between the tab-fastening mean 4 on the tab 3 and the tip of the tab to some degree compared with the conventional length, thus increasing the generated force at the working point. Under the configuration, when the tab 3 is rotated to the enabled-opening position as shown in FIG. 30, the can-opening force is further reduced if only the score for opening the can having the curved surface shape according to the present invention is formed on the can end on which the turning of the tab 3 to an enabled opening position brings the pick-up edge of the tab 3 to outside of the outer periphery of the can end.

EXAMPLE 1

A tin-free steel sheet was prepared from a thin steel sheet having thickness ranging from 0.20 to 0.30 mm, the values of tensile strength TS ranging from 29 to 56 kfg/mm$^2$, and the values of work-hardening coefficient n in a range of from 40 to 90% of uniform elongation region ranging from 0.10 to 0.20 by forming a chromate coating layer on both sides thereof, which chromate coating layer consists of a chromated metal chromium layer with coating weights ranging from 100 to 120 mg/m$^2$ and of a top layer of chromium oxide hydrate with coating weights ranging from 14 to 18 mg/m$^2$ as metallic chromium.

Thus prepared steel sheet coated with chromate layer on both sides thereof was formed into a can end panel. To the can end panel, a pair of dies both of which have a curved surface respectively having the tip radius ranging from more than 0.025 mm and not more than 1.0 mm, or one of which has a curved surface with tip radius ranging from more than 0.025 mm to not more than 1.0 mm while the other has a flat surface were applied to prepare the stay-on tab easy-opening can ends Nos. 1, 4, 6, 8, 11, and 13 shown in Table 1 using the method according to the present invention employing the press-forming with or without using lubricant while regulating the values of thickness t of the steel sheet at the thinnest portion ranging from 2.5 to 5.0 as P value. (Hereinafter these can ends are referred to as the examples of the present invention.)

TABLE 11

| No. | $t_0$ (mm) | t (mm) | TS (kgf/mm$^2$) | n | P | Can-open-ability | Shock fracture | Base material of metal sheet | Remark |
|---|---|---|---|---|---|---|---|---|---|
| 1 | 0.298 | 0.09 | 28.5 | 0.158 | 4.2 | ○ | ○ | Steel sheet | Example of this invention |
| 2 | 0.298 | 0.08 | 28.5 | 0.231 | 4.4 | ○ | ○ | Aluminum alloy plate | Example of this invention |
| 3 | 0.298 | 0.06 | 28.5 | 0.204 | 3.3 | ○ | ○ | Steel sheet | Example of this invention |
| 4 | 0.298 | 0.08 | 29.8 | 0.203 | 4.4 | ○ | ○ | Steel sheet | Example of this invention |
| 5 | 0.298 | 0.06 | 30.2 | 0.202 | 3.5 | ○ | ○ | Steel sheet | Example of this invention |
| 6 | 0.298 | 0.08 | 35.4 | 0.138 | 4.5 | ○ | ○ | Steel sheet | Example of this invention |

TABLE 11-continued

| No. | $t_0$ (mm) | t (mm) | TS (kgf/mm$^2$) | n | P | Can-open-ability | Shock fracture | Base material of metal sheet | Remark |
|---|---|---|---|---|---|---|---|---|---|
| 7 | 0.199 | 0.06 | 35.4 | 0.168 | 3.6 | ○ | ○ | Aluminum alloy plate | Example of this invention |
| 8 | 0.199 | 0.08 | 40.4 | 0.106 | 4.6 | ○ | ○ | Steel sheet | Example of this invention |
| 9 | 0.199 | 0.06 | 40.4 | 0.165 | 4.1 | ○ | ○ | Steel sheet | Example of this invention |
| 10 | 0.298 | 0.06 | 44.9 | 0.158 | 4.7 | ○ | ○ | Steel sheet | Example of this invention |
| 11 | 0.298 | 0.04 | 44.9 | 0.181 | 3.4 | ○ | ○ | Steel sheet | Example of this invention |
| 12 | 0.199 | 0.06 | 50.2 | 0.119 | 4.5 | ○ | ○ | Steel sheet | Example of this invention |
| 13 | 0.199 | 0.06 | 55.5 | 0.103 | 4.8 | ○ | ○ | Steel sheet | Example of this invention |
| 14 | 0.199 | 0.04 | 28.5 | 0.113 | 1.8 | ○ | X | Steel sheet | Comparative example |
| 15 | 0.298 | 0.04 | 28.5 | 0.203 | 2.3 | ○ | X | Aluminum alloy plate | Comparative example |
| 16 | 0.199 | 0.04 | 30.2 | 0.114 | 1.9 | ○ | X | Steel sheet | Comparative example |
| 17 | 0.298 | 0.04 | 30.2 | 0.201 | 2.4 | ○ | X | Steel sheet | Comparative example |
| 18 | 0.298 | 0.04 | 35.4 | 0.141 | 2.4 | ○ | X | Steel sheet | Comparative example |
| 19 | 0.199 | 0.04 | 40.4 | 0.105 | 2.4 | ○ | X | Steel sheet | Comparative example |
| 20 | 0.199 | 0.03 | 44.9 | 0.107 | 2.1 | ○ | X | Steel sheet | Comparative example |
| 21 | 0.251 | 0.03 | 50.2 | 0.111 | 2.4 | ○ | X | Steel sheet | Comparative example |
| 22 | 0.251 | 0.03 | 50.5 | 0.105 | 2.3 | ○ | X | Steel sheet | Comparative example |
| 23 | 0.298 | 0.10 | 30.2 | 0.205 | 5.4 | X | ○ | Steel sheet | Comparative example |
| 24 | 0.298 | 0.10 | 35.4 | 0.172 | 5.9 | X | ○ | Aluminum alloy plate | Comparative example |
| 25 | 0.199 | 0.10 | 40.4 | 0.111 | 5.6 | X | ○ | Steel sheet | Comparative example |
| 26 | 0.298 | 0.08 | 40.4 | 0.178 | 5.7 | X | ○ | Steel sheet | Comparative example |
| 27 | 0.298 | 0.08 | 44.9 | 0.183 | 6.4 | X | ○ | Steel sheet | Comparative example |
| 28 | 0.199 | 0.08 | 50.2 | 0.106 | 5.7 | X | ○ | Steel sheet | Comparative example |
| 29 | 0.298 | 0.06 | 55.5 | 0.174 | 6.0 | X | ○ | Steel sheet | Comparative example |

EXAMPLE 2

An electrolytic tin-plated steel sheet coated by chromate layer was prepared from a thin steel sheet having the values of thickness to ranging from 0.20 to 0.30 mm, the values of tensile strength TS ranging from 29 to 50 kfg/mm$^2$ , and the values of work-hardening coefficient n in a range of from 40 to 90% of uniform elongation region ranging from 0.12 to 0.20 by electro-tin plating on both sides thereof to form an electrolytic tin plating layer having coating weights ranging from 0.8 to 2.8 g/m$^2$ as tin, and further by forming a chromate coating layer on the tin plating layer, which chromate coating layer consists of a chromated metal chromium layer with coating weights ranging from 9 to 12 mg/m$^2$ and of a top layer of chromium oxide hydrate with coating weights ranging from 8 to 10 mg/m$^2$ as metallic chromium.

Thus prepared electrolytic tin-plated steel sheet coated with plating layer on both sides was formed into a can end panel. To the can end panel, a pair of dies both of which have a curved surface respectively having the tip radius ranging from more than 0.025 mm and not more than 1.0 mm, or one of which has a curved surface with tip radius ranging from more than 0.025 mm to not more than 1.0 mm while the other has a flat surface were applied to prepare the stay-on tab easy-opening can ends Nos. 3, 5, 9, 10, and 12 shown in Table 1 using the method according to the present invention employing the press-forming with or without using lubricant while regulating the values of thickness t of the aluminum alloy plate at the thinnest portion ranging from 2.5 to 4.5 as P value. (Hereinafter these can ends are also referred to as the examples of the present invention.)

EXAMPLE 3

An aluminum alloy plate having the values of thickness $t_0$ ranging from 0.20 to 0.30 mm, the values of tensile strength TS ranging from 29 to 35 kfg/mm$^2$, and the values of work-hardening coefficient n in a range of from 40 to 90% of uniform elongation region ranging from 0.17 to 0.23 was formed into can end panel. To the can end panel, a pair of dies both of which have a curved surface respectively having the tip radius ranging from more than 0.025 mm and not more than 1.0 mm, or one of which has a curved surface with tip radius ranging from more than 0.025 mm to not more than 1.0 mm while the other has a flat surface were applied to prepare the stay-on tab easy-opening can ends Nos. 2 and 7 shown in Table 1 using the method according to the present invention employing the press-forming with or without using lubricant while regulating the values of thickness t of the steel sheet at the thinnest portion ranging from 2.5 to 4.5 as P value. (Hereinafter these can ends are referred to also as the examples of the present invention.)

COMPARATIVE EXAMPLE 1

A tin-free steel sheet was prepared from a thin steel sheet having the values of thickness $t_0$ ranging from 0.20 to 0.30 mm, the values of tensile strength TS ranging from 29 to 51 kfg/mm$^2$, and the values of work-hardening coefficient n in a range of from 40 to 90% of uniform elongation region ranging from 0.11 to 0.20 by forming a chromate coating layer on both sides thereof with the same procedure as applied in Example 1. Thus prepared steel sheet coated with chromate layer on both sides was formed into a can end panel. To the can end panel, a pair of dies having the same configuration with that in Example 1 were used to prepare the stay-on tab easy-opening can ends Nos. 14, 17, 19, 22, 25, and 27 shown in Table 1 employing the press-forming with or without using lubricant while regulating the values of thickness t of the steel sheet at the thinnest portion to outside of the P value range specified by the present invention applying a method different from that of the present invention. (Hereinafter these can ends are referred to as the comparative examples.)

COMPARATIVE EXAMPLE 2

An electrolytic tin-plated steel sheet coated by chromate layer was prepared from a thin steel sheet having the values of thickness to ranging from 0.20 to 0.30 mm, the values of tensile strength TS ranging from 30 to 56 kfg/mm$^2$, and the values of work-hardening coefficient n in a range of from 40 to 90% of uniform elongation region ranging from 0.11 to 0.21 by applying the same procedure of electrolytic tin plating and chromate processing with that in Example 2. Thus prepared electrolytic tin-plated steel sheet coated with plating layer on both sides was formed into a can end panel. To the can end panel, press-forming was applied using the dies having the same configuration with that in Example 2 with or without applying lubricant to prepare the stay-on tab easy-opening can ends Nos. 16, 18, 20, 21, 23, 26, 28, and 29 while regulating the values of thickness t of the steel sheet at the thinnest portion to outside of the P value range specified by the present invention applying a method different from that of the present invention. (Hereinafter these can ends are also referred to as the comparative examples.)

COMPARATIVE EXAMPLE 3

An aluminum alloy plate having a thickness $t_0$ of 0.30 mm, the values of tensile strength TS ranging from 29 to 35 kfg/mm$^2$, and the values of work-hardening coefficient n in a range of from 40 to 90% of uniform elongation region ranging from 0.17 to 0.20 was formed into can end panel. To the can end panel, a pair of dies similar with those used in Example were applied to prepare the stay-on tab easy-opening can ends Nos. 15 and 24 shown in Table 11 using the method other than that specified by the present invention employing the press-forming with or without using lubricant while regulating the thickness t of the aluminum alloy sheet at the thinnest portion to outside of the P value range specified by the present invention. (Hereinafter these can ends are referred to also as the comparative examples.)

Regarding the can ends of above-described examples of the present invention and the comparative examples, the can-openability and the presence/absence of shock fracture were evaluated on the basis of criteria given below, and the result is shown in Table 11.

As for the can-openability, the Pop value (the force letting the opening section on the can end begin to open under a constant tensile force applied to the tab on the can end) was determined. When the observed Pop value is not higher than the maximum value (2.4 kg) observed on six kinds of commercially available aluminum alloy easy-opening can end, the test specimen is marked with (o). All the other test specimens are marked with (x). Shock fracture was evaluated by the presence/absence of shock fracture when a can 6 is dropped from 1 m above the concrete floor against the floor in a slanted position of the can facing the can end 1 downward to apply a shock force to the can end 1. Test specimen that generated no shock fracture is marked with (o), and the test specimen that generated shock fracture is marked with (x).

As seen in Table 11, the comparative examples Nos. 14 through 22 which were formed to give the P-value range of sheet thickness t at the thinnest portion of the score for opening the can was less than 2.5 generated shock fracture. The comparative examples Nos. 23 through 29 which were formed to give the P-value range of sheet thickness t at the thinnest portion of the score for opening the can was more than 5.0 gave inferior can-openability.

To the contrary, all the examples of the present invention, Nos. 1 through 13, gave excellent can-openability, and generated no shock fracture.

Embodiment 7

Embodiment 7 provides a method for making an easy-opening can end comprising the steps of:

providing a end panel comprising a steel sheet having a thickness of $t_0$ (mm), a work-hardening coefficient of n in a 40 to 90% range of uniform elongation region and a tensile strength of TS (kgf/mm$^2$) and resin film layers on both sides of the steel sheet;

providing an upper die and a lower die; and press-forming the end panel by using the upper die and the lower die to form score on the end panel.

The press-formed can end panel has a thickness t (mm) at the thinnest portion thereof, the thickness t (mm) satisfying the following equations.

$$2.5 \leqq P5.0$$

$$P = t \times TS \times \{\exp(n)/(n^n)\} \times [2/\sqrt{3} \times |\ln(1+(t-t_0)/t_0\}|]^n$$

When the score is formed on an upper surface or a lower surface of the end panel, either the upper die or the lower die has a curved surface with a radius ranging from 0.1 to 1 mm at the tip portion thereof and the other die has a flat surface at the tip portion thereof.

When the scores are formed on an upper surface and a lower surface of the end panel, the upper die and the lower die have a curved surface with a radius ranging from 0.1 to 1 mm at the tip portion The method for manufacturing easy-opening can end according to the present invention is described in more detail in the following referring to the drawings.

Figure 31:
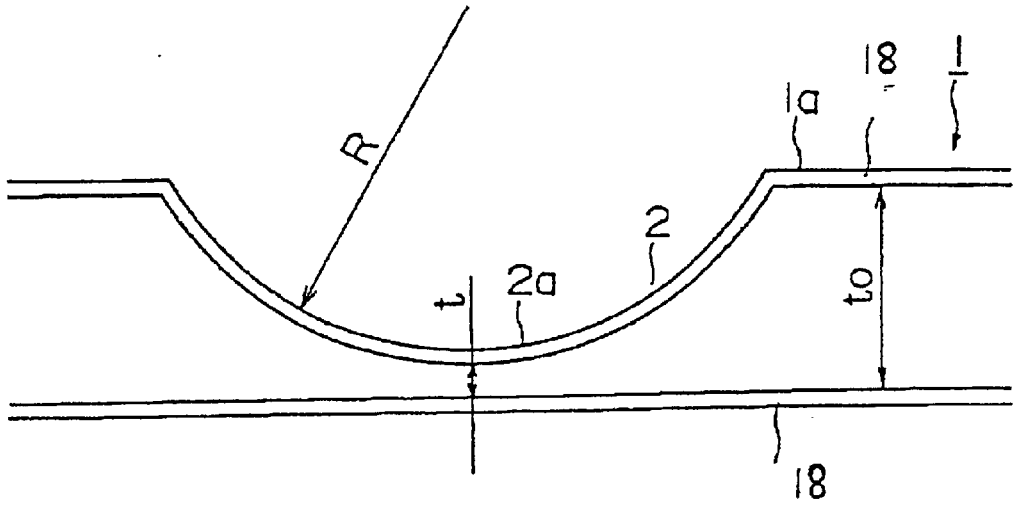
FIG. 31 is a cross sectional view of a score portion formed on the can end according to the Embodiment 7.

FIG. 31 is a cross sectional view of the score for opening the can formed on the can end. As shown in the figure, a die having a curved surface with the values of radius (R) thereof ranging from 0.1 to 1.0 mm to the upper surface 1*a* of the can end 1 made of a steel sheet having a thickness of $t_0$ and being coated with resin layer 8 on both sides thereof, and a die having a flat surface to the lower surface of the can end 1 are used to press-form the score 2 for opening the can to give a curved bottom cross section thereof having a steel sheet thickness t at the thinnest portion 2*a* and having a curved bottom cross section. The formation of the score is conducted to have a work-hardening coefficient of n in a 40 to 90% range of uniform elongation region of the metal sheet forming the can end 1, and a tensile strength of TS (kgf/mm$^2$) thereof, and t satisfies the relation of $2.5 \leqq P \leqq 5.0$, where $P = t \times TS \times \{\exp(n)/(n^n)\} \times [2/\sqrt{3} \times |\ln(1+(t-t_0)/t_0\}|]^n$.

Figure 32:
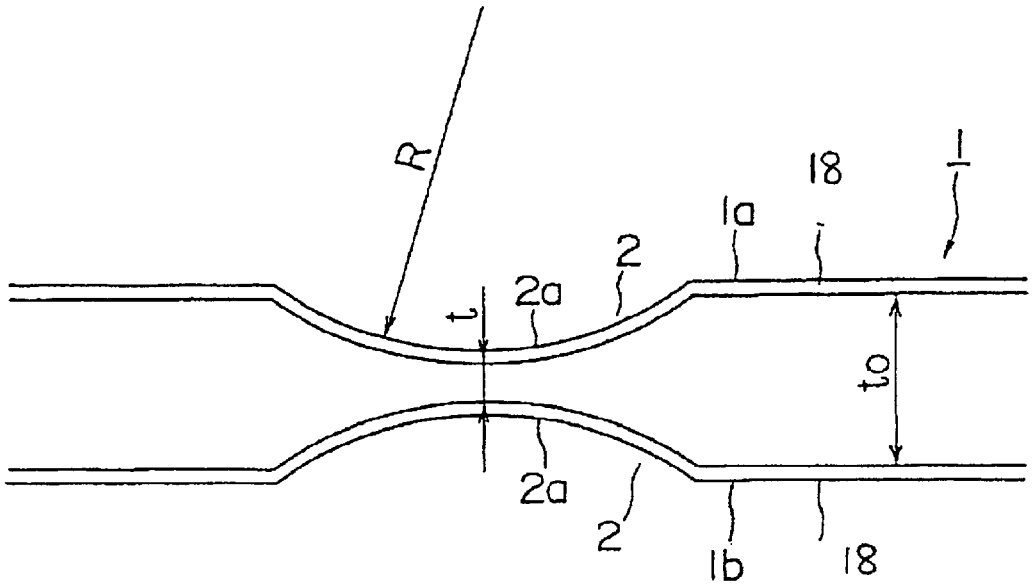
FIG. 32 is a cross sectional view of a score portion formed on the can end according to the Embodiment 7.

FIG. 32 is another cross sectional view of the score for opening the can formed on the can end. As shown in the figure, to the upper surface 1*a* and the lower surface 1*b* of the can end 1 formed on the can end, which can end 1 is made of a steel sheet having a thickness of to and having a resin coating layer 8 on both sides thereof, each die having a curved surface with the values of radius (R) thereof ranging from 0.1 mm to 1.0 mm, is used to press-form the scores 2, 2 for opening the can, respectively, to give a curved bottom cross section thereof while giving a thickness at the thinnest portion 2*a* is t. The formation of the score is conducted to have a work-hardening coefficient of n in a 40 to 90% range of uniform elongation region of the metal sheet to form the can end 1, and a tensile strength of TS (kgf/mm$^2$) thereof, and t satisfies the relation of $2.5 \leqq P \leqq 5.0$, where $P=t \times TS \times \{\exp(n)/(n^n)\} \times [2/\sqrt{33} \times |\ln(1+(t-t_0)/t_0\}|]^n$.

Owing to the score 2, or scores 2,2 for opening the can having a curved shape with above-described radius (R) on the upper surface 1*a* or on both of the upper surface 1*a* and the lower surface 1*b* of the can end, the can-opening force is stably reduced to a level that child or aged person is able to easily open the can, while preventing the generation of shock fracture.

If the radius (R) of die for forming the score 2 for opening the can is less than 0.1 mm in forming score for opening the can on the upper surface or both the front and lower surfaces of the can end, it is difficult to form the score for opening the can onto the can end panel without damaging the resin coating layer.

If the radius (R) of the die exceeds 1.0 mm, the area of thin plate section of the can end 1 increases, which results in unstable break-position of the can-opening section to make the opening shape poor, and further "sagging" (a portion of broken section is hung down) increases. It is also practically impossible to form a score for opening the can with widths wider than 1.0 mm on a can end panel having a limited space.

The sheet thickness t at the thinnest portion 2*a* of the score 2 for opening the can is formed under the condition of $2.5 \leqq P \leqq 5.0$, where $P=t \times TS \times \{\exp(n)/(n^n)\} \times [2/\sqrt{3} \times |\ln(1+(t-t_0)/to\}|]^n$, n is a work-hardening coefficient in a 40 to 90% range of uniform elongation region of the metal sheet forming the can end 1, and TS (kgf/mm$^2$) is a tensile strength thereof. The score 2 for opening the can is formed by press-forming the metal sheet for fabricating the can end using the dies having the shape described above. When, however, that kind of forming induces work-hardening at the thinnest portion 2*a* obtained by the working, thus the strength increases. The degree of work-hardening differs with the ratio of the original sheet thickness $t_0$ of the steel sheet to the worked sheet thickness t, and the strength at the thinnest portion increases with decrease in the t value. When the equivalent stress at the thinnest portion is expressed by $\sigma$, and the equivalent strain is expressed by $\epsilon$, then their relation is defined by the equation: $\sigma=K \times \epsilon^n$.

When the work-hardening coefficient in a 40 to 90% range of uniform elongation region of the metal sheet forming the can end 1 is expressed by n, and the tensile strength is expressed by TS (kgf/mm$^2$), the relation of $TS=K \times n^n/\exp(n)$ derives the equation: $K=TS \times \{\exp(n)/(n)^n\}$. The strain $\epsilon$ ts in the sheet thickness direction induced by the formation of score for opening the can is written as the equation:

$$\epsilon ts=\ln\{1+(t-t_0)/t_0\}.$$

The equivalent strain $\epsilon$ at the thinnest portion of the score for opening the can is written as the following equation with the assumption of flat plane strain.

$$\epsilon=2/\sqrt{3} \times |\ln\{1+(t-t_0)/t_0\}|$$

From the above equations, the equivalent stress $\sigma$ at the thinnest portion 2*a* is written as:

$$\sigma=TS \times \{\exp(n)/(n)^n\} \times [2/\sqrt{3} \times |\ln\{1+(t-t_0)/t_0\}|]^n$$

The tensile break force P to break the thinnest portion 2*a* of the score for opening the can mainly by the tensile deformation is expressed by the equation $P=\sigma xt$.
Thus, the expression becomes to the equation.

$$P=t \times TS \times \{\exp(n)/(n^n)\} \times [2/\sqrt{3} \times |\ln(1+(t-t_0)/t_0\}|]^n$$

As a result, less value of P decreases the can-opening force. And the effect becomes stable when the value of P is 5.0 or less. If the value of P exceeds 5.0, a large can-opening force is required, and a problem arises. If the value of P is less than 2.5, when a can with the formed can end is dropped or is subjected to external shock, the opening section may be fractured.

Therefore, the following-described conditions shall be satisfied to form a score for opening the can on the upper surface or both of the front and lower surfaces of the can end:

using a base material of steel sheet having a sheet thickness of $t_0$ (mm), a work-hardening coefficient in a 40 to 90% range of uniform elongation region of n, and a tensile strength of TS (kgf/mm$^2$);

using a pair of dies either one of which has a curved surface with tip radius ranging from 0.1 to 1.0 mm, while the other of which has a flat surface, or using a pair of dies both of which have a curved surface with tip radius ranging from 0.1 to 1.0 mm;

to apply press-forming to give a thickness t (mm) at the thinnest portion to form a score for opening the can; and satisfying the relation of $2.5 \leqq P \leqq 5.0$, where $P=t \times TS \times \{\exp(n)/(n^n)\} \times [2/\sqrt{3} \times |\ln(1+(t-t_0)/t_0\}|]^n$.

The steel sheet used in the above-described method for manufacturing a can end is not specifically limited, and adequate kind of metal sheet may be adopted for individual objectives. An easy-opening can end is generally provided with a tab for opening the can. If a rivet mechanism is employed as the tab-attaching means, a preferable range of the work-hardening coefficient n of uniform elongation region is 0.15 or more from the viewpoint of rivet-formability. To suppress the damage of resin coating layer, smaller face-pressure for forming the score for opening the can is preferable. To do this, it is preferable to satisfy the following condition.

$$TS \times \{\exp(n)/(n^n)\} \times [2/\sqrt{3} \times |\ln(1+(t-t_0)/t_0\}|]^n \leqq 70$$

Furthermore, either the upper surface or the lower surface, or both sides of the steel sheet may be applied with various kinds of plating or chemical conversion treatment to assure corrosion resistance and adhesiveness with resin coating layer.

The kind of resin of resin coating layer formed on both sides of the steel sheet is not specifically limited, and it may be selected depending on the contents of the can to which the can end is attached and on the use environment. Different kind of resin may be applied to each of the upper surface and the lower surface of the can end. Although the thickness of resin coating layer is not specifically limited, to prevent degradation of corrosion resistance caused by damage occurred during the formation of score for opening the can, the thickness is necessary to be 5 $\mu$m or more, preferably 10 $\mu$m or more.

If a solid or liquid lubricant is applied on forming the score for opening the can onto the can end panel, the friction force between the dies and the resin coating layer reduces, and the shear force induced in the resin coating layer reduces, which suppresses the occurrence of separation of interface between the resin coating layer and the steel sheet and suppresses the degradation of corrosion resistance.

The above-described method for manufacturing can end is applicable to both the pull-top tab can end, the stay-on tab can end, and the full-open can end.

Figure 33A:
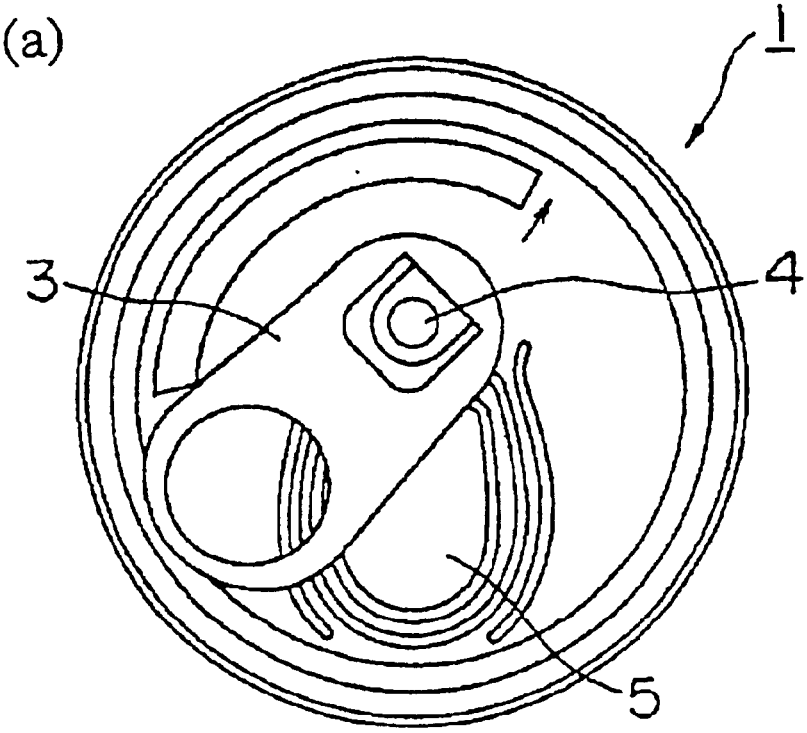
FIGS. 33(*a*) and 33(*b*) are cross sectional view of a score portion formed on the can end according to the Embodiment 7.
Figure 33B:
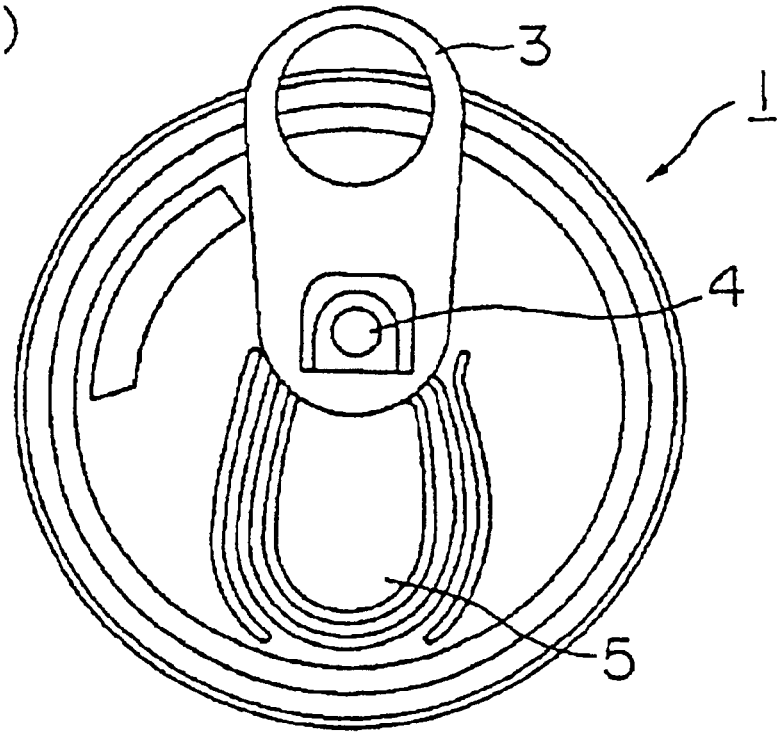

Alternatively, as shown in FIG. 33(*a*), if the tab 3 is attached to the can end 1 in a manner that the tab-fastening mean 4 is at an off-set position against the center of the can end 1 toward the opposite side of the opening section 5 to allow the tab 3 to rotate around the tab-fastening mean 4, while lengthening the distance between the tab-fastening mean 4 on the tab 3 and the tip of the tab to some degree compared with the conventional length, thus increasing the generated force at the working point. Under the configuration, when the tab 3 is rotated to the enabled-opening position as shown in FIG. 33(*b*), the can-opening force is further reduced if only the score for opening the can having the curved surface shape according to the present invention is formed on the can end on which the turning of the tab 3 to an enabled-opening position brings the pick-up edge of the tab 3 to outside of the outer periphery of the can end.

EXAMPLE 1

A tin-free steel sheet was prepared from a thin steel sheet having the values of thickness to ranging from 0.20 to 0.30 mm, the values of tensile strength TS ranging from 29 to 56 kfg/mm$^2$, and the values of work-hardening coefficient n in a range of from 40 to 90% of uniform elongation region ranging from 0.10 to 0.23 by forming a chromate coating layer on both sides thereof, which chromate coating layer consists of a chromated metal chromium layer with coating weights ranging from 100 to 120 mg/m$^2$ and of a top layer of chromium oxide hydrate with coating weights ranging from 14 to 18 mg/m$^2$ as metallic chromium. The prepared steel sheet was coated by polyester film of heat-fusion type on both sides thereof to thickness ranging from 15 to 30 $\mu$m on both sides thereof.

Thus prepared steel sheet laminated with polyester film on both sides was formed into a can end panel. To the can end panel, a pair of dies both of which have a curved surface respectively having tip radius ranging from 0.1 to 1.0 mm, or one of which has a curved surface with tip radius ranging from 0.1 to 1.0 mm while the other has a flat surface were applied to prepare the stay-on tab easy-opening can ends Nos. 1 through 13 shown in Table 12 using the method according to the present invention employing the press-forming with or without using lubricant while regulating the values of thickness t of the steel sheet at the thinnest portion ranging from 2.5 to 5.0 as P value. (Hereinafter these can ends are referred to as the examples of the present invention.)

TABLE 12

| No. | R (mm) | $t_0$ (mm) | t (mm) | TS (kgf/mm$^2$) | n | P | Can open-ability | Shock fracture | Damage of resin layer | Remark |
|---|---|---|---|---|---|---|---|---|---|---|
| 1 | 0.1 | 0.298 | 0.09 | 28.5 | 0.158 | 4.2 | ○ | ○ | ○ | Example |
| 2 | 0.5 | 0.298 | 0.08 | 28.5 | 0.231 | 4.4 | ○ | ○ | ○ | Example |
| 3 | 1.0 | 0.298 | 0.06 | 28.5 | 0.204 | 3.3 | ○ | ○ | ○ | Example |
| 4 | 0.5 | 0.298 | 0.08 | 29.8 | 0.203 | 4.4 | ○ | ○ | ○ | Example |
| 5 | 1.0 | 0.298 | 0.06 | 30.2 | 0.202 | 3.5 | ○ | ○ | ○ | Example |
| 6 | 0.5 | 0.298 | 0.08 | 35.4 | 0.138 | 4.5 | ○ | ○ | ○ | Example |
| 7 | 1.0 | 0.199 | 0.06 | 35.4 | 0.168 | 3.6 | ○ | ○ | ○ | Example |
| 8 | 0.1 | 0.199 | 0.08 | 40.4 | 0.106 | 4.6 | ○ | ○ | ○ | Example |
| 9 | 0.5 | 0.199 | 0.06 | 40.4 | 0.165 | 4.1 | ○ | ○ | ○ | Example |
| 10 | 0.5 | 0.298 | 0.06 | 44.9 | 0.158 | 4.7 | ○ | ○ | ○ | Example |
| 11 | 1.0 | 0.298 | 0.04 | 44.9 | 0.181 | 3.4 | ○ | ○ | ○ | Example |
| 12 | 0.1 | 0.199 | 0.06 | 50.2 | 0.119 | 4.5 | ○ | ○ | ○ | Example |
| 13 | 0.5 | 0.199 | 0.06 | 55.5 | 0.103 | 4.8 | ○ | ○ | ○ | Example |
| 14 | 0.1 | 0.199 | 0.04 | 28.5 | 0.113 | 1.8 | ○ | X | ○ | Comparison |
| 15 | 0.5 | 0.298 | 0.04 | 28.5 | 0.203 | 2.3 | ○ | X | ○ | Comparison |
| 16 | 0.5 | 0.199 | 0.04 | 30.2 | 0.114 | 1.9 | ○ | X | ○ | Comparison |
| 17 | 1.0 | 0.298 | 0.04 | 30.2 | 0.201 | 2.4 | ○ | X | ○ | Comparison |
| 18 | 0.1 | 0.298 | 0.04 | 35.4 | 0.141 | 2.4 | ○ | X | ○ | Comparison |
| 19 | 0.5 | 0.199 | 0.04 | 40.4 | 0.105 | 2.4 | ○ | X | ○ | Comparison |
| 20 | 0.5 | 0.199 | 0.03 | 44.9 | 0.107 | 2.1 | ○ | X | ○ | Comparison |
| 21 | 0.5 | 0.251 | 0.03 | 50.2 | 0.111 | 2.4 | ○ | X | ○ | Comparison |
| 22 | 0.5 | 0.251 | 0.03 | 50.5 | 0.105 | 2.3 | ○ | X | ○ | Comparison |
| 23 | 0.1 | 0.298 | 0.10 | 30.2 | 0.205 | 5.4 | X | ○ | ○ | Comparison |
| 24 | 0.5 | 0.298 | 0.10 | 35.4 | 0.172 | 5.9 | X | ○ | ○ | Comparison |
| 25 | 0.5 | 0.199 | 0.10 | 40.4 | 0.111 | 5.6 | X | ○ | ○ | Comparison |
| 26 | 1.0 | 0.298 | 0.08 | 40.4 | 0.178 | 5.7 | X | ○ | ○ | Comparison |
| 27 | 0.1 | 0.298 | 0.08 | 44.9 | 0.183 | 6.4 | X | ○ | ○ | Comparison |
| 28 | 0.5 | 0.199 | 0.08 | 50.2 | 0.106 | 5.7 | X | ○ | ○ | Comparison |
| 29 | 0.5 | 0.298 | 0.06 | 55.5 | 0.174 | 6.0 | X | ○ | ○ | Comparison |
| 30 | 0.03 | 0.298 | 0.09 | 28.5 | 0.158 | 4.2 | ○ | ○ | X | Comparison |
| 31 | 0.05 | 0.298 | 0.08 | 28.5 | 0.228 | 4.4 | ○ | ○ | X | Comparison |
| 32 | 0.08 | 0.298 | 0.06 | 28.5 | 0.206 | 3.3 | ○ | ○ | X | Comparison |
| 33 | 0.03 | 0.298 | 0.08 | 28.5 | 0.207 | 4.2 | ○ | ○ | X | Comparison |
| 34 | 0.05 | 0.298 | 0.06 | 30.2 | 0.209 | 3.5 | ○ | ○ | X | Comparison |
| 35 | 0.05 | 0.298 | 0.08 | 35.4 | 0.145 | 4.6 | ○ | ○ | X | Comparison |
| 36 | 0.08 | 0.199 | 0.06 | 35.4 | 0.172 | 3.6 | ○ | ○ | X | Comparison |

For comparison, the can end panel fabricated from the above-described tin-free steel sheet was press-formed using a pair of dies described above applying or without applying lubricant thereto under the condition that the sheet thickness t at the thinnest portion is outside of the P range specified by the present invention, thus prepared the test samples No. 14 through 29 for stay-on tab easy-opening can ends shown also in Table 12 applying a method different from that of the present invention. (Hereinafter these test samples are referred to as the comparative test samples.) Separately, by applying dies having the tip radius thereof being outside of the range specified by the present invention, the press-forming is applied to a steel sheet in a manner that the sheet thickness t at the thinnest portion is in a P range specified by the present invention to form the stay-on tab easy-opening can ends Nos. 30 through 36 with or without applying lubricant applying a method different from that of the present invention. (Hereinafter these samples are referred to also as the comparative examples.)

Regarding the can ends of above-described examples of the present invention and the comparative examples, the presence/absence of shock fracture and of damage on resin coating layer were evaluated on the basis of criteria given below, and the result is shown in Table 12.

As for the can-openability, the Pop value (the force letting the opening section on the can end begin to open under a constant tensile force applied to the tab on the can end) was determined. When the observed Pop value is not higher than the maximum value (2.4 kg) observed on six kinds of commercially available aluminum alloy easy-opening can end, the test specimen is marked with (o). All the other test specimens are marked with (x). Shock fracture was evaluated by the presence/absence of shock fracture when a can 6 is dropped from 1 m above the concrete floor against the floor in a slanted position of the can facing the can end 1 downward to apply a shock force to the can end 1. Test specimen that generated no shock fracture is marked with (o), and the test specimen that generated shock fracture is marked with (x). The damage on resin coating layer was evaluated by a corrosion test on the can end and based on the presence/absence of rust at and in the vicinity of score for opening the can on front and lower surfaces. The test specimen that generated no rust on both sides is marked with (o), and a test specimen that generated even a slight amount of rust either on upper surface or lower surface is marked with (x). As seen in Table 1, the comparative examples Nos. 14 through 22 which were formed to give the P-value range of sheet thickness t at the thinnest portion of the score for opening the can was less than 2.5 generated shock fracture. The comparative examples Nos. 23 through 29 which were formed to give the P-value range of sheet thickness t at the thinnest portion of the score for opening the can being more than 5.0 gave inferior can-openability. Furthermore, the comparative examples Nos. 30 through 36 which were prepared by press-forming using a pair of dies at least one of which has tip radius outside of the range specified by the present invention generated rust at the score for opening the can in the corrosion test, and gave damage on the resin coating layer.

To the contrary, all the examples of the present invention, Nos. 1 through 13, gave excellent can-openability, generated no shock fracture, generated no rust on and in the vicinity of score for opening the can, and gave no damage on resin coating layer.

Embodiment 8

Embodiment 8 provides a method for making an easy-opening can end comprising the steps of:

providing a end panel comprising a metal sheet having a thickness of $t_0$ (mm), a work-hardening coefficient of n in a 40 to 90% range of uniform elongation region and a tensile strength of TS (kgf/mm$^2$);

providing an upper die and a lower die;

press-forming the end panel by using the upper die and the lower die to form score on the end panel;

attaching a tab having a finger grasping portion to the can end panel rotatably around tab-fastening means;

arranging a slope protrusion for lifting the tab to above a height of a seam portion when the tab is rotated to a position for allowing the can open.

In forming a score on an upper surface or a lower surface of the end panel, either the upper die or the lower die has a curved surface with a radius ranging from over 0.025 to 1 mm at the tip portion thereof and the other die has a flat surface at the tip portion thereof.

In forming scores on an upper surface and lower surface of the end panel, the upper die and the lower die have a curved surface with a radius ranging from over 0.025 to 1 mm at the tip portion thereof.

The press-formed can end panel has a thickness t (mm) at the thinnest portion thereof, the thickness t (mm) satisfying the following equations:

$$5<P\leqq 7.0$$

$$P=t\times TS\times\{\exp(n)/(n^n)\}\times[2/\sqrt{3}\times|\ln(1+(t-t_0)/t_0\}|]^n$$

The tab-fastening means is positioned offset by a distance "a" expressed in the following equation from the center of the can end to the opposite side of an openable section:

$$(D-d)/2<a<d/2-l$$

The finger grasping portion has a distance "L" from the tab-fastening means, the distance "L" being defined by the following equation:

$$d-l>L>d/2-a$$

The tab has a first center line before rotation thereof and a second center line at an opening position, the first center line and the second line having an angle "θ" therebetween which is within a range defined by the equation:

$$-1<\cos\theta<1/(2\times a\times L)\times\{(d/2)^2-(L^2+a^2)\}$$

In the above equations, "a" is the distance between the center of the tab-fastening means and the center of can end, "L" is the distance between the center of the tab-fastening means and the finger grasping portion on the tab, "l" is the distance between the center of the tab-fastening means and a tab working section, "θ" the angle between the center line of tab before rotation and the center line at opening position, "d" the inner diameter of the can end, and "D" the outer diameter of the can end.

The method for manufacturing easy-opening can end according to the present invention is described in more detail in the following referring to the drawings.

Figure 34:
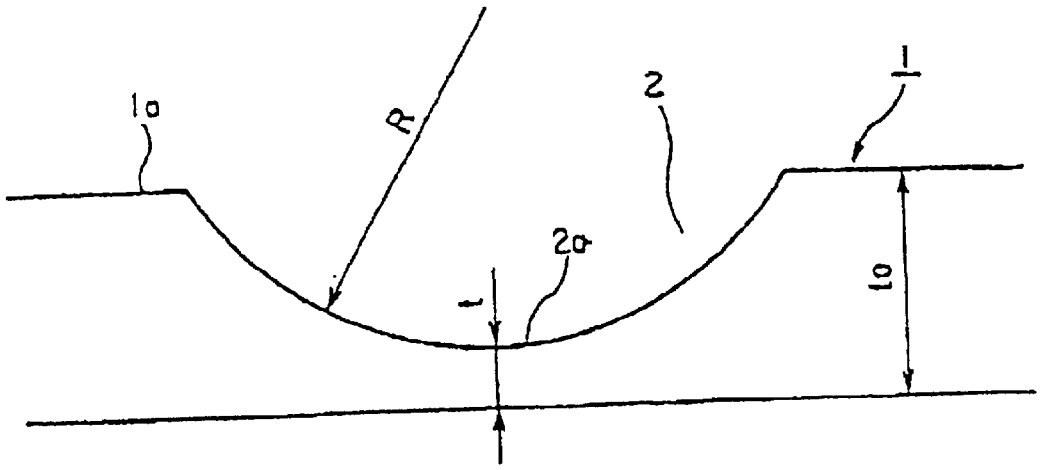
FIG. 34 is a cross sectional view of a score portion formed on the can end according to the Embodiment 8.

FIG. 34 is a cross sectional view of the score for opening the can formed on the can end. As shown in the figure, a die having a curved surface with the values of radius (R) thereof ranging from 0.25 to 1.0 mm to the upper surface 1*a* of the can end 1 having a thickness of $t_0$, and a die having a flat surface to the lower surface of the can end 1 are used to press-form the score 2 for opening the can to give a curved bottom cross section thereof having a sheet thickness t at the thinnest portion 2*a* and having a curved bottom cross section. The formation of the score is conducted to have a work-hardening coefficient of n in a 40 to 90% range of uniform elongation region of the metal sheet forming the can end 1, and a tensile strength of TS (kgf/mm$^2$) thereof, and t satisfies the following equations:

$$5<P\leqq 7.0,$$

$$P=t\times TS\times\{\exp(n)/(n^n)\}\times[2/\sqrt{3}\times|\ln(1+(t-t_0)/t_0\}|]^n.$$

Figure 35:
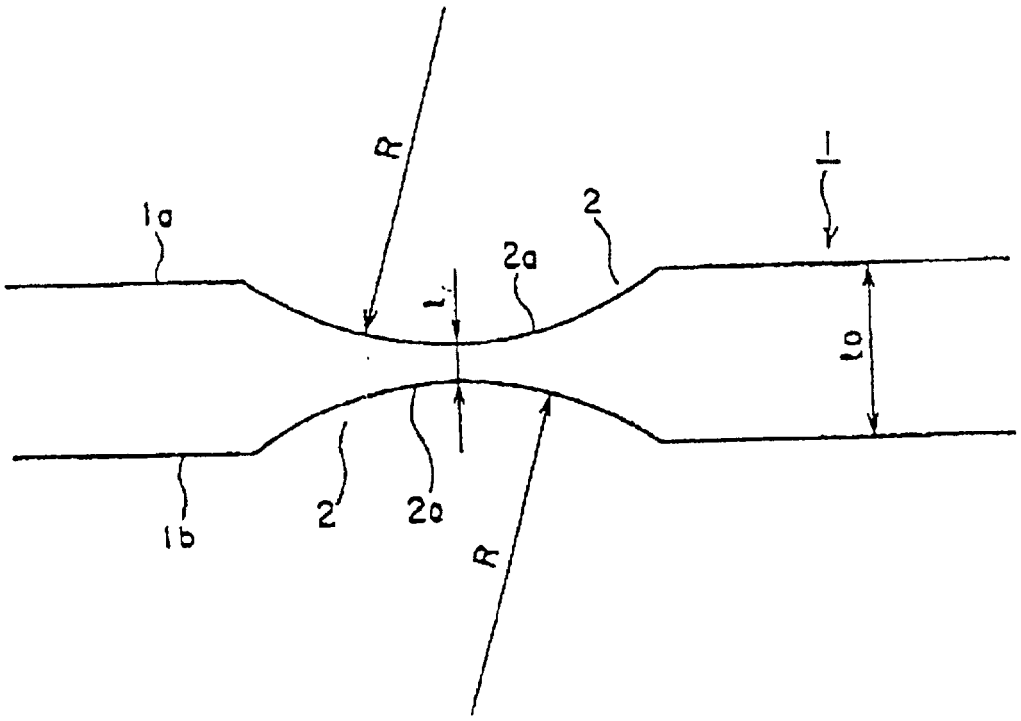
FIG. 35 is a cross sectional view of a score portion formed on the can end according to the Embodiment 8.

FIG. 35 is a cross sectional view of the score for opening the can formed on the can end. As shown in the figure, to the upper surface la and the lower surface 1*b* of the can end 1 formed on the can end, which can end 1 is made of a metal sheet having a thickness of $t_0$, each die having a curved surface with the values of radius (R) thereof ranging from 0.25 mm to 1.0 mm, is used to press-form the scores 2, 2 for opening the can, respectively, to give a curved bottom cross section thereof while giving a thickness t at the thinnest portion 2*a*. The formation of the score is conducted to have a work-hardening coefficient of n in a 40 to 90% range of uniform elongation region of the metal sheet to form the can end 1, and a tensile strength of TS (kgf/mm$^2$) thereof, and t satisfies the following equations:

$$5.0<P\leqq 7.0,$$

$$P=t\times TS\times\{\exp(n)/(n^n)\}\times[2/\sqrt{3}\times|\ln(1+(t-t_0)/t_0\}|]^n.$$

Owing to the formation of score 2, or scores 2,2 for opening the can having a curved shape with above-described radius (R) on the upper surface 1*a* or on both of the upper surface 1*a* and the lower surface 1*b* of the can end, and owing to the attaching of longer tab than that in prior art, the can-opening force is stably reduced to a level that child or aged person is able to easily open the can, while preventing the generation of shock fracture.

For the case that the score 2 for opening the can is formed either of or both of the upper surface and the lower surface of the can end 1, provided by the radius (R) of the die for forming the score 2 for opening the can being less than 0.025 mm, the working accuracy of the dies degrades, and the abrasion of the dies induced by the forming work appears in an early working time, so a problem of need for frequently exchanging the dies arises, which is uneconomical.

If the radius (R) of the die exceeds 1.0 mm, the area of thin plate section of the can end 1 increases, which results in unstable break-position of the can-opening section to make the opening shape poor, and further "sagging" (a portion of broken section is hung down) increases. It is also practically impossible to form a score for opening the can with widths wider than 1.0 mm on a can end panel having a limited space.

The sheet thickness t at the thinnest portion 2*a* of the score 2 for opening the can is formed under the condition of $5.0<P\leqq 7.0$, where $P=t\times TS\times\{\exp(n)/(n^{n)}\}\times[2/\sqrt{3}\times|\ln(1+(t-t_0)/t_0\}|]^n$, n is a work-hardening coefficient in a 40 to 90% range of uniform elongation region of the metal sheet forming the can end 1, and TS (kgf/mm$^2$) is a tensile strength thereof. The score 2 for opening the can is formed by press-forming the metal sheet for fabricating the can end using the dies having the shape described above. When, however, that kind of forming induces work-hardening at the thinnest portion 2*a* obtained by the working, thus the strength increases. The degree of work-hardening differs with the ratio of the original sheet thickness $t_0$ of the metal sheet to the worked sheet thickness t, and the strength at the thinnest portion increases with decrease in the t value. When the equivalent stress at the thinnest portion 2*a* is expressed by σ, and the equivalent strain is expressed by ϵ, then their relation is defined by the equation: $\sigma=K\times\epsilon^n$.

When the work-hardening coefficient in a 40 to 90% range of uniform elongation region of the metal sheet forming the can end 1 is expressed by n, and the tensile strength is expressed by TS (kgf/mm$^2$), the relation of [TS $K\times n^n$ exp(n)] derives the following equation:

$$K=TS\times\{\exp(n)/(n)^n\}.$$

The strain ϵ ts in the sheet thickness direction induced by the formation of score for opening the can is written as the following equation:

$$\epsilon ts=\ln\{1+(t-t_0)/t_0\}.$$

The equivalent strain ϵ at the thinnest portion of the score for opening the can is written as the following equation with the assumption of flat plane strain.

$$\epsilon=2/\sqrt{3}\times|\ln\{1+(t-t_0)/t_0\}|$$

From the above equations, the equivalent stress σ at the thinnest portion 2*a* is written as:

$$\sigma=TS\times\{\exp(n)/(n)^n\}\times[2/\sqrt{3}\times|\ln\{1+(t-t_0)/t_0\}|]^n$$

The tensile break force P to break the thinnest portion 2*a* of the score for opening the can mainly by the tensile deformation is expressed by the equation:
$P=\sigma\times t$ . Thus, the expression becomes to the following equation:

$$P=t\times TS\times\{\exp(n)/(n^n)\}\times[2/\sqrt{3}\times|\ln(1+(t-t_0)/t_0\}|]^n.$$

As a result, less value of P decreases the can-opening force. And the effect becomes stable when the value of P is 7.0 or less provided by the simultaneous use of the tab-attaching method described later. If the value of P exceeds 7.0, a large can-opening force is required, and a problem arises.

Therefore, to form a score for opening the can at either of the upper surface or the lower surface or at both sides of the can end, it is necessary to use a can end panel fabricated from a base material of metal sheet having a sheet thickness of $t_0$ (mm), a work-hardening coefficient of n in a 40 to 90% range of uniform elongation region, and a tensile strength of TS (kgf/mm$^2$), which can end panel is subjected to press-forming using a pair of dies either one of which has a curved shape having tip radius thereof ranging from 0.25 to 1.0 mm while the other of which has a flat surface to form the score for opening the can, or both of which have a curved shape having tip radius respectively ranging from 0.25 to 1.0 mm, to form a score for opening the can giving a sheet thickness t (mm) at the thinnest section thereof, and it is necessary to satisfy the condition of:

$$5.0<P\leqq 7.0$$

where, $$P=t\times TS\times\{\exp(n)/(n^n)\}\times[2/\sqrt{33}\times|\ln(1+(t-t_0)/t_0\}|]^n$$

The following is the description of the method for attaching a tab referring to the drawings.

Figure 36:
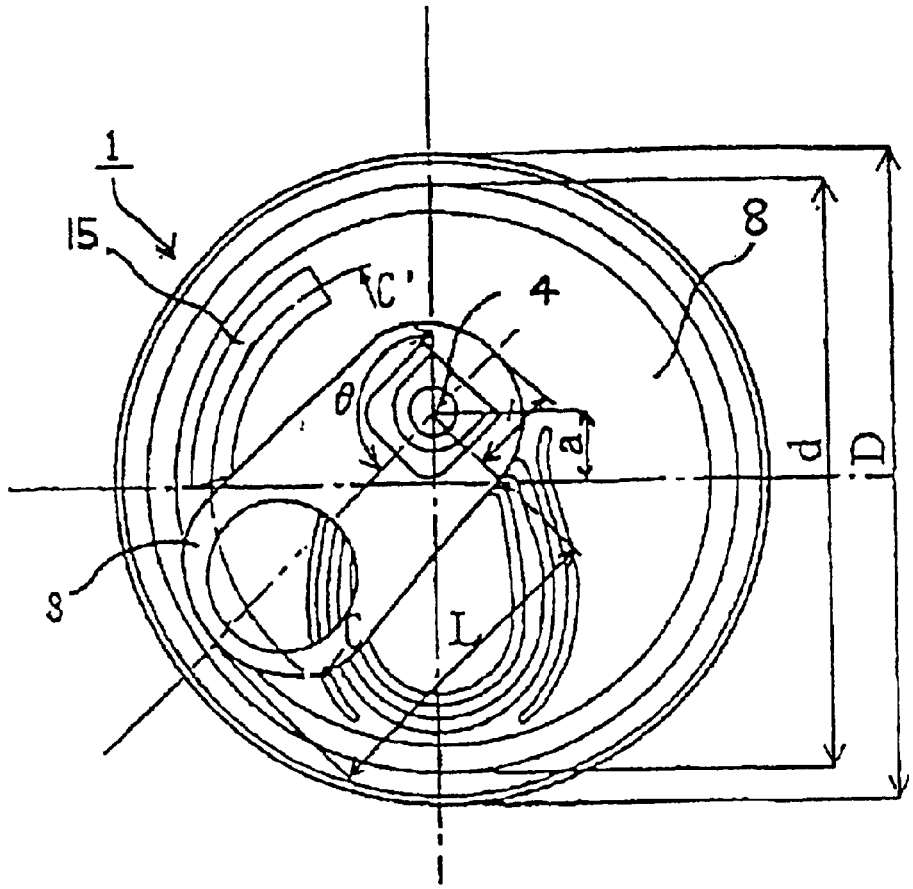
FIG. 36 is a plan view of a can end according to the Embodiment 8.

FIG. 36 shows a plan view of the easy-opening can end according to the present invention illustrating a mode thereof. In the figure, "a" denotes the off-set between the center of tab-fastening mean 4 and the center of can end 1, "L" denotes the distance between the center of tab-fastening mean 4 and the tip of the finger-picking section on the tab 3, "l" denotes the distance between the center of tab-fastening means 4 and the tip of working section of the tab 3, "θ" denotes the angle between the center line of tab before rotation and the center line after the rotation of the tab and before the opening of the can, "d" denotes the inner diameter of the can end 1, and "D" denotes the outer diameter of the can end 1.

According to the Embodiment 8, the center of the tab-fastening mean 4 is displaced by an off-set of "a" from the center of the can end 1 to opposite side of the can-opening section. The off-set of "a" is defined by the following equation:

$$(D-d)/2<a<d/2-l$$

The distance "L" between the center of the tab-fastening mean 4 and the tip of the finger-picking section on the tab 3 is limited by the following equation: d−l>L>d/2−a to extend longer than that in prior art, thus increasing the distance between the support point of lever work and the work point thereof, which increases the generated force at the work point compared with that in the prior art.

If, however, a tab-fastening mean is applied at the center of the can end 1 as in prior art, the whole tab cannot be held within the area of the central panel section, so the performance of stacking, storing, and transporting of cans is significantly degraded. In this regard, according to the Embodiment 8, the position of the tab-fastening mean 4 is moved from the center of the can end 1 to opposite side of the can opening section within a range of the equation: (D−d)/2<a<d/2−l. The tab 3 is rotated by an angle of θ derived from the following equation around the tab-fastening mean 4.

$$-1<\cos\theta<1/(2\times a\times L)\times\{(d/2)^2\mathbf{31}\ (L^2+a^2)\}$$

By moving the position of the tab-fastening mean 4 by "a" and by rotating the tab 3 by an angle of "θ", the total tab is able to be held inside of the area of the central panel section 8.

Figure 37:
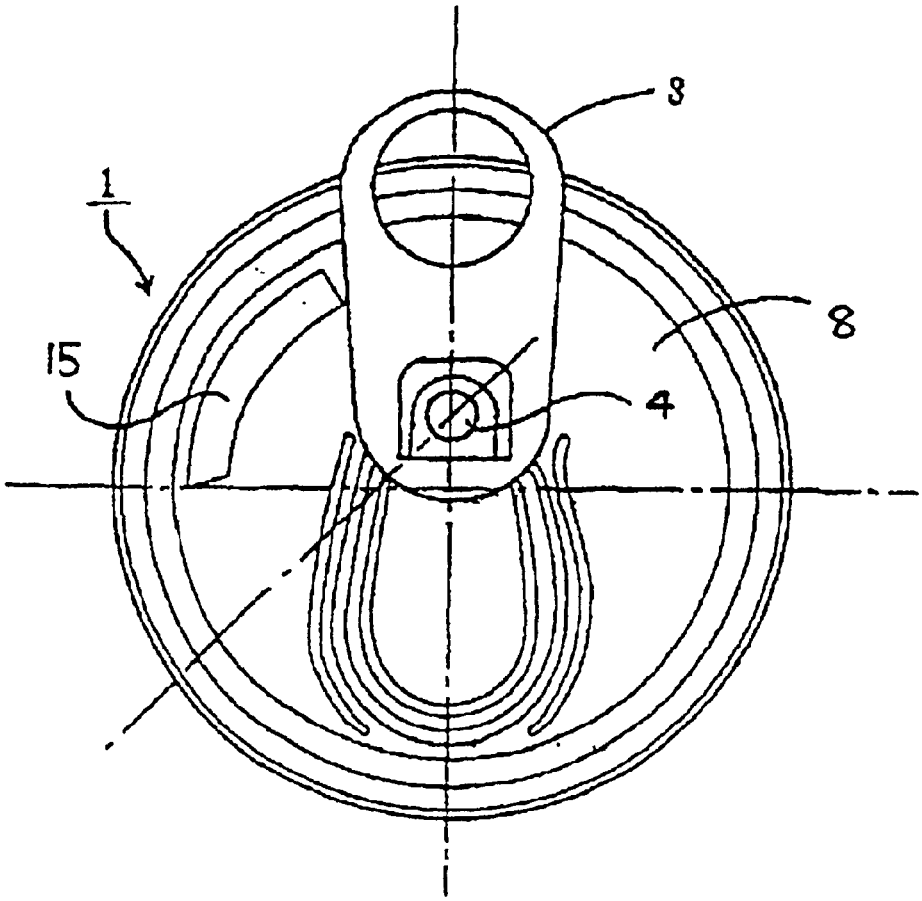
FIG. 37 is a plain view of a can end after the tab rotation and immediately before the can opening according to the Embodiment 8.

In addition, as shown in FIG. 37, the tab 3 is rotated around the tab-fastening mean 4 from the disabled-opening position to the enabled-opening position during the can-opening step. With the simple rotation, however, the tab edge section collides against the seam section in the periphery of the can end to prevent further rotation of the tab 3. To solve the problem, a slope-shape protrusion 15 is formed on the center panel section 8. By pulling-up the tip of the tab 3 to above the height of the seam section, the tab 3 becomes possible to rotate to the enabled-opening position as seen in FIG. 37.

After the tab 3 is rotated to the enabled-opening position in this manner, the tab picking-up edge becomes outside of the outer periphery of the can end (or the outer periphery of the seam section) so that the finger picking and holding the tab 3 are easily done.

FIG. 36 uses a rivet as a means to hold the tab 3 in free-rotational angle movement. The means is, however, not limited to the rivet, and a tab-fastening mean material having the same construction may be attached to the central panel section using an adhesive. The shape of the tab 3 is preferably raised from the can end for easy angle movement and for easy finger picking.

The metal sheet used in the above-described method for manufacturing a can end may be an aluminum plate, a metal sheet, or a plate of other kind of metal, and adequate kind of metal sheet may be adopted for individual objectives. An easy-opening can end is generally provided with a tab for opening the can. If a rivet mechanism is employed as the tab-attaching means, a preferable range of the work-hardening coefficient n of uniform elongation region is 0.15 or more from the viewpoint of rivet-formability. When corrosion resistance is necessary to be assured, the metal sheet may be coated by various kinds of plating, chemical conversion, painting, or lamination of resin layer on either side or both of the front and the lower surfaces thereof.

The above-described method for manufacturing can end is applicable to both the pull-top tab can end and the stay-on tab can end .

EXAMPLE 1

A tin-free metal sheet was prepared from a thin metal sheet having the values of thickness to ranging from 0.20 to 0.30 mm, the values of tensile strength TS ranging from 30 to 56 kfg/mm$^2$, and the values of work-hardening coefficient n in a range of from 40 to 90% of uniform elongation region ranging from 0.11 to 0.21 by forming a chromate coating layer on both sides thereof, which chromate coating layer consists of a chromated metal chromium layer with coating weights ranging from 100 to 120 mg/m$^2$ and of a top layer of chromium oxide hydrate with coating weights ranging from 14 to 18 mg/m$^2$ as metallic chromium.

Thus prepared tin-free steel having chromate layer on both sides thereof was formed into a can end panel. To the can end panel, a pair of dies both of which have a curved surface respectively having tip radius ranging from 0.25 to 1.0 mm, or one of which has a curved surface with tip radius ranging from 0.25 to 1.0 mm while the other has a flat surface were applied to prepare the stay-on tab easy-opening can ends Nos. 1 through 7 shown in Table 1 using the method according to the present invention employing the press-forming with or without using lubricant while regulating the values of thickness t of the metal sheet at the thinnest portion ranging from more than 5.0 to not more than 7.0 as P value, while attaching the tab 3 having a structure shown in FIG. 36 and with the relative position listed below. (Hereinafter these can ends are referred to as the examples of the present invention.)

Off-set between the center of tab-fastening mean and the center of can end (a): 5 mm
Distance between the center of tab-fastening mean and the finger-picking section on the tab (L): 25 mm
Distance between the center of tab-fastening mean and the tab working section (1): 10 mm
Inner diameter of the can end (d): 49 mm
Outer diameter of the can end (D): 53 mm

EXAMPLE 2

An electrolytic tin plated metal sheet was prepared from a thin metal sheet having the values of thickness to ranging from 0.17 to 0.30 mm, the values of tensile strength TS ranging from 30 to 50 kfg/mm , and the values of work-hardening coefficient n in a range of from 40 to 90% of uniform elongation region ranging from 0.10 to 0.21 by forming an electrolytic tin coating layer on both sides thereof to coating weights ranging from 0.8 to 2.8 g/m$^2$ of tin, further by forming a chromate coating layer on both sides thereof, which chromate coating layer consists of a chromated metal chromium layer with coating weights ranging from 9 to 12 mg/m$^2$ and of a top layer of chromium oxide hydrate with coating weights ranging from 8 to 10 mg/m$^2$ as metallic chromium.

Thus prepared metal sheet on both sides thereof was formed into a can end panel. To the can end panel, a pair of dies both of which have a curved surface respectively having tip radius ranging from more than 0.025 to not more than 1.0 mm, or one of which has a curved surface with tip radius ranging from more than 0.025 to not more than 1.0 mm while the other has a flat surface were applied to prepare the stay-on tab easy-opening can ends Nos. 8 through 12 shown in Table 13 using the method according to the present invention employing the press-forming with or without using lubricant while regulating the values of thickness t of the metal sheet at the thinnest portion ranging from more than 5.0 to not more than 7.0 as P value. (Hereinafter these can ends are referred to as the examples of the present invention.)

COMPARATIVE EXAMPLE 1

A tin-free steel was prepared from a thin metal sheet having a thickness $t_0$ of 0.30 mm, the values of tensile strength TS ranging from 40 to 56 kfg/mm$^2$, and the values of work-hardening coefficient n in a range of from 40 to 90% of uniform elongation region ranging from 0.16 to 0.18 by applying chromate treatment similar with that applied in Example 1 on both sides thereof. To thus prepared can end panel, the stay-on tab easy-opening can ends Nos. 13 through 15 shown also in Table 1 were fabricated by press-forming the plate by the dies described in Example 1 with or without using lubricant giving P range outside of the specified one by the present invention as the sheet thickness t at the thinnest portion while attaching the tab 3 similar with that has the same structure according to the present invention as shown in FIG. 36, applying a method different from that of the present invention. (Hereinafter these can ends are referred to as the comparative examples of the present invention.)

Regarding the can ends of above-described examples of the present invention and the comparative examples, the can-openability was evaluated on the basis of criteria given below, and the result is shown in Table 13.

As for the can-openability, the Pop value (the force letting the opening section on the can end begin to open under a constant tensile force applied to the tab on the can end) was determined. When the observed Pop value is not higher than the maximum value (2.4 kg) observed on six kinds of commercially available aluminum alloy easy-opening can end, the test specimen is marked with (o). All the other test specimens are marked with (x).

As seen in Table 13, the comparative examples Nos. 12 through 14 which were formed to give the P-value range of sheet thickness t at the thinnest portion of the score for opening the can was more than 7.0 gave poor can-openability.

To the contrary, all the examples of the present invention, Nos. 1 through 11, gave excellent can-openability.

TABLE 13

| No. | $t_0$ (mm) | t (mm) | TS (kgf/mm2) | n | P | Can open-ability | Remark |
|---|---|---|---|---|---|---|---|
| 1 | 0.298 | 0.10 | 30.2 | 0.205 | 5.4 | ○ | Example of the present invention |
| 2 | 0.298 | 0.10 | 35.4 | 0.172 | 5.9 | ○ | Example of the present invention |
| 3 | 0.199 | 0.10 | 40.4 | 0.111 | 5.6 | ○ | Example of the present invention |
| 4 | 0.298 | 0.08 | 40.4 | 0.178 | 5.7 | ○ | Example of the present invention |
| 5 | 0.298 | 0.08 | 44.9 | 0.183 | 6.4 | ○ | Example of the present invention |
| 6 | 0.199 | 0.08 | 50.2 | 0.106 | 5.7 | ○ | Example of the present invention |
| 7 | 0.298 | 0.06 | 55.5 | 0.174 | 6.0 | ○ | Example of the present invention |
| 8 | 0.298 | 0.12 | 30.2 | 0.207 | 6.2 | ○ | Example of the present invention |
| 9 | 0.298 | 0.12 | 35.4 | 0.163 | 6.8 | ○ | Example of the present invention |
| 10 | 0.199 | 0.12 | 40.4 | 0.101 | 6.4 | ○ | Example of the present invention |
| 11 | 0.199 | 0.10 | 50.2 | 0.104 | 6.9 | ○ | Example of the present invention |
| 12 | 0.168 | 0.10 | 40.3 | 0.153 | 5.8 | ○ | Example of the present invention |
| 13 | 0.298 | 0.12 | 40.4 | 0.183 | 8.0 | X | Comparative example |
| 14 | 0.298 | 0.10 | 44.9 | 0.181 | 7.6 | X | Comparative example |
| 15 | 0.298 | 0.10 | 55.5 | 0.162 | 9.1 | X | Comparative example |

Embodiment 9

Embodiment 9 provides a method for making an easy-opening can end comprising the steps of:

providing a end panel comprising a metal sheet having a thickness of $t_0$ (mm), a work-hardening coefficient of n in a 40 to 90% range of uniform elongation region and a tensile strength of TS (kgf/mm$^2$) and resin film layers on both sides of the steel sheet;

providing an upper die and a lower die;

press-forming the end panel by using the upper die and the lower die to form score on the end panel;

attaching a tab having a finger grasping portion to the can end panel rotatably around tab-fastening means; and arranging a slope protrusion for lifting the tab to above a height of a seam portion when the tab is rotated to a position for allowing the can open.

In forming a score on an upper surface or a lower surface of the end panel, either the upper die or the lower die has a curved surface with a radius ranging from over 0.1 to 1 mm at the tip portion thereof and the other die has a flat surface at the tip portion thereof.

In forming scores on an upper surface and lower surface of the end panel, the upper die and the lower die have a curved surface with a radius ranging from over 0.1 to 1 mm at the tip portion thereof.

The press-formed can end panel has a thickness t (mm) at the thinnest portion thereof, the thickness t (mm) satisfying the following equations;

$$5<P\leqq 7.0$$

$$P=t\times TS\times\{\exp(n)/(n^n)\}\times[2/\sqrt{3}\times|\ln(1+(t-t_0)/t_0\}|]^n$$

The tab-fastening means is positioned offset by a distance "a" expressed in the following equation from the center of the can end to the opposite side of an openable section:

$$(D-d)/2<a<d/2-l$$

The finger grasping portion has a distance "L" from the tab-fastening means, the distance "L" being defined by the following equation:

$$d-l>L>d/2-a$$

The tab has a first center line before rotation thereof and a second lo center line at an opening position, the first center line and the second line having an angle "θ" therebetween which is within a range defined by the equation:

$$-1<\cos\theta<1/(2\times a\times L)\times\{(d/2)^2-(L^2+a^2)\}$$

In the above equations, "a" is the distance between the center of the tab-fastening means and the center of can end, "L" is the distance between the center of the tab-fastening means and the finger grasping portion on the tab, "l" is the distance between the center of the tab-fastening means and a tab working section, "θ" the angle between the center line of tab before rotation and the center line at opening position, "d" the inner diameter of the can end, and "D" the outer diameter of the can end.

The method for manufacturing easy-opening can end according to the Embodiment 9 is described in more detail in the following referring to the drawings.

Figure 38:
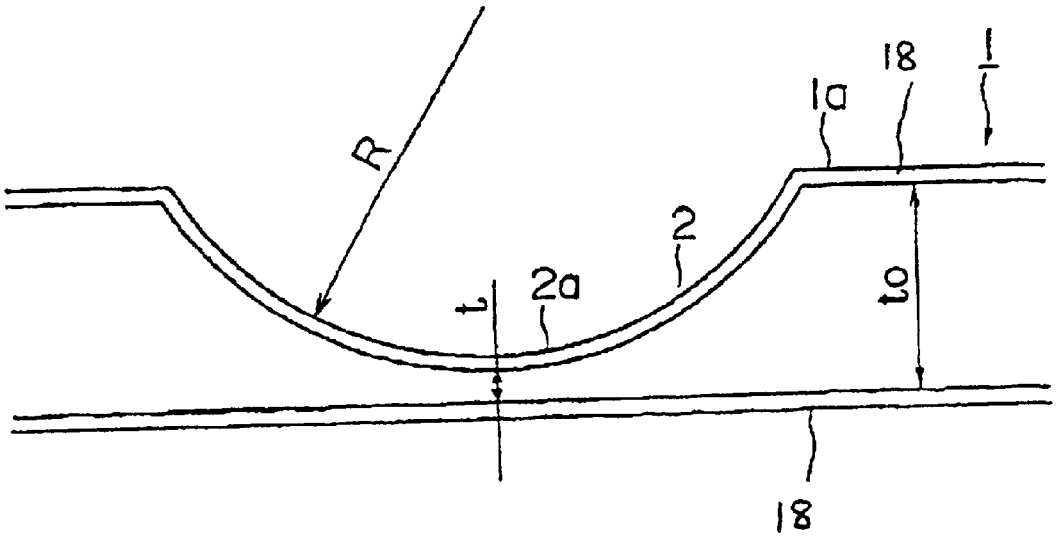
FIG. 38 is a cross sectional view of a score portion formed on the can end according to the Embodiment 9.

FIG. 38 is a cross sectional view of the score for opening the can formed on the can end. As shown in the figure, a die having a curved surface with the values of radius (R) thereof ranging from 0.1 to 1.0 mm to the upper surface 1*a* of the can end 1 having a thickness of to and being coated with resin layer 18 on both sides thereof, and a die having a flat surface to the lower surface of the can end 1 are used to press-form the score 2 for opening the can to give a curved bottom cross section thereof having a steel sheet thickness t at the thinnest portion 2*a* and having a curved bottom cross section. The formation of the score is conducted to have a work-hardening coefficient of n in a 40 to 90% range of uniform elongation region of the metal sheet forming the can end 1, and a tensile strength of TS (kgf/mm$^2$) thereof, and t satisfies the relation of 5<P7.0, where $P=t\times TS\times\{\exp(n)/(n^n)\}\times[2/\sqrt{33}\times|\ln(1+(t-t_0)/t_0\}|]^n$.

Figure 39:
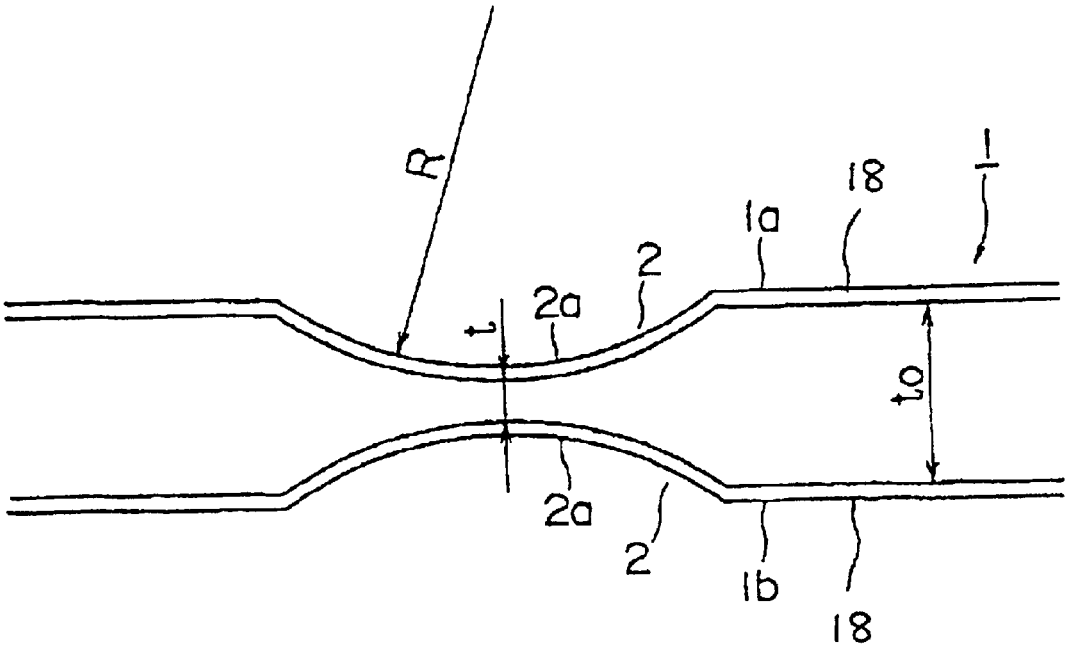
FIG. 39 is a cross sectional view of a score portion formed on the can end according to the Embodiment 9.

FIG. 39 shows another easy-opening can end of Embodiment 9. FIG. 39 is a cross sectional view of the score for opening the can formed on the can end. As shown in the figure, to the upper surface 1*a* and the lower surface 1*b* of the can end 1 formed on the can end, which can end 1 is made of a steel sheet having a thickness of to and having a resin coating layer 18 on both sides thereof, each die having a curved surface with the values of radius (R) thereof ranging from 0.1 mm to 1.0 mm, is used to press-form the scores 2, 2 for opening the can, respectively, to give a curved bottom cross section thereof while giving a thickness t at the thinnest portion 2*a*. The formation of the score is conducted to have a work-hardening coefficient of n in a 40 to 90% range of uniform elongation region of the metal sheet to form the can end 1, and a tensile strength of TS (kgf/mm$^2$) thereof, and t satisfies the relation of $5.0<P\leqq 7.0$, where $P=t\times TS\times\{\exp(n)/(n^n)\}\times[2/\sqrt{33}\times|\ln(1+(t-t_0)/t_{\}|]}^n$.

Owing to the formation of score 2, or scores 2,2 for opening the can having a curved shape with above-described radius (R) on the upper surface 1*a* or on both of the upper surface 1*a* and the lower surface 1*b* of the can end, and owing to the attaching of longer tab than that in prior art, the can-opening force is stably reduced to a level that child or aged person is able to easily open the can, while preventing the generation of shock fracture.

If the radius (R) of die for forming the score 2 for opening the can is less than 0.1 mm in forming score for opening the can on either of the upper surface and the lower surface or both the front and lower surfaces of the can end, it is difficult to form the score for opening the can onto the can end panel without damaging the resin coating layer.

If the radius (R) of the die exceeds 1.0 mm, the area of thin plate section of the can end 1 increases, which results in unstable break-position of the can-opening section to make the opening shape poor, and further "sagging" (a portion of broken section is hung down) increases. It is also practically impossible to form a score for opening the can with widths wider than 1.0 mm on a can end panel having a limited space.

The steel sheet thickness t at the thinnest portion 2*a* of the score 2 for opening the can is formed under the condition of $5.0<P\leqq 7.0$, where $P=t\times TS\times\{\exp(n)/(n^n)\}\times[2/\sqrt{3}\times|\ln(1+(t-t_0)/t_0\}|]^n$, n is a work-hardening coefficient in a 40 to 90% range of uniform elongation region of the steel sheet forming the can end 1, and TS (kgf/mm$^2$) is a tensile strength thereof. The score 2 for opening the can is formed by press-forming the steel sheet for fabricating the can end using the dies having the shape described above. When, however, that kind of forming induces work-hardening at the thinnest portion 2*a* obtained by the working, thus the strength increases. The degree of work-hardening differs with the ratio of the original sheet thickness $t_0$ of the steel sheet to the worked sheet thickness t, and the strength at the thinnest portion increases with decrease in the t value. When the equivalent stress at the thinnest portion 2*a* is expressed by a, and the equivalent strain is expressed by ϵ, then their relation is defined by the equation of $\sigma=K\times\epsilon^n$. When the work-hardening coefficient in a 40 to 90% range of uniform elongation region of the metal sheet forming the can end 1 is expressed by n, and the tensile strength is expressed by TS (kgf/mm$^2$), the relation of $TS=K\times n^n\exp(n)$ derives the following equation: $K=TS\times\{\exp(n)/(n)^n\}$. The strain ϵts in the sheet thickness direction induced by the formation of score for opening the can is written as the equation: $\epsilon ts=\ln\{1+(t-t_0)/t_0\}$. The equivalent strain ϵ at the thinnest portion of the score for opening the can is written as the equation: $\epsilon=2/\sqrt{33}\times|\ln\{1+(t-t_0)/t_0\}|$ with the assumption of flat plane strain. From the above equations, the equivalent stress a at the thinnest portion 2*a* is written as:

$$\sigma=TS\times\{\exp(n)/(n)^n\}\times[2/\sqrt{3}\times|\ln\{1+(t-t_0)/t_0\}|]^n$$

The tensile break force P to break the thinnest portion 2*a* of the score for opening the can mainly by the tensile deformation is expressed by the equation:

$P=\sigma\times t$ .

Thus, the expression becomes to the equation:

$$P=t\times TS\times\{\exp(n)/(n^n)\}\times[2/\sqrt{3}\times|\ln(1+(t-t_0)/t_0\}|]^n$$

As a result, less value of P decreases the can-opening force. And the effect becomes stable when the value of P is 7.0 or below provided by the simultaneous use of the tab-attaching method described later. If the value of P exceeds 7.0, a large can-opening force is required, and a problem arises.

Therefore, to form a score for opening the can at either of the upper surface or the lower surface or at both sides of the can end, it is necessary to use a can end panel fabricated from a base material of steel sheet having a sheet thickness of $t_0$ (mm), a work-hardening coefficient of n in a 40 to 90% range of uniform elongation region, and a tensile strength of TS (kgf/mm$^2$), which base material being further coated by a resin layer on both sides thereof, which can end panel is subjected to press-forming using a pair of dies either one of which has a curved shape having tip radius thereof ranging from 0.1 to 1.0 mm while the other of which has a flat surface to form the score for opening the can, or both of which have a curved shape having tip radius respectively ranging from 0.1 to 1.0 mm, to form a score for opening the can giving a steel sheet thickness t (mm) at the thinnest section thereof, and it is necessary to satisfy the condition of:

$$5.0<P\leqq 7.0$$

where, $$P=t\times TS\times\{\exp(n)/(n^n)\}\times[2/\sqrt{3}\times|\ln(1+(t-t_0)/t_0\}|]^n$$

The following is the description of the method for attaching a tab referring to the drawings.

Figure 40:
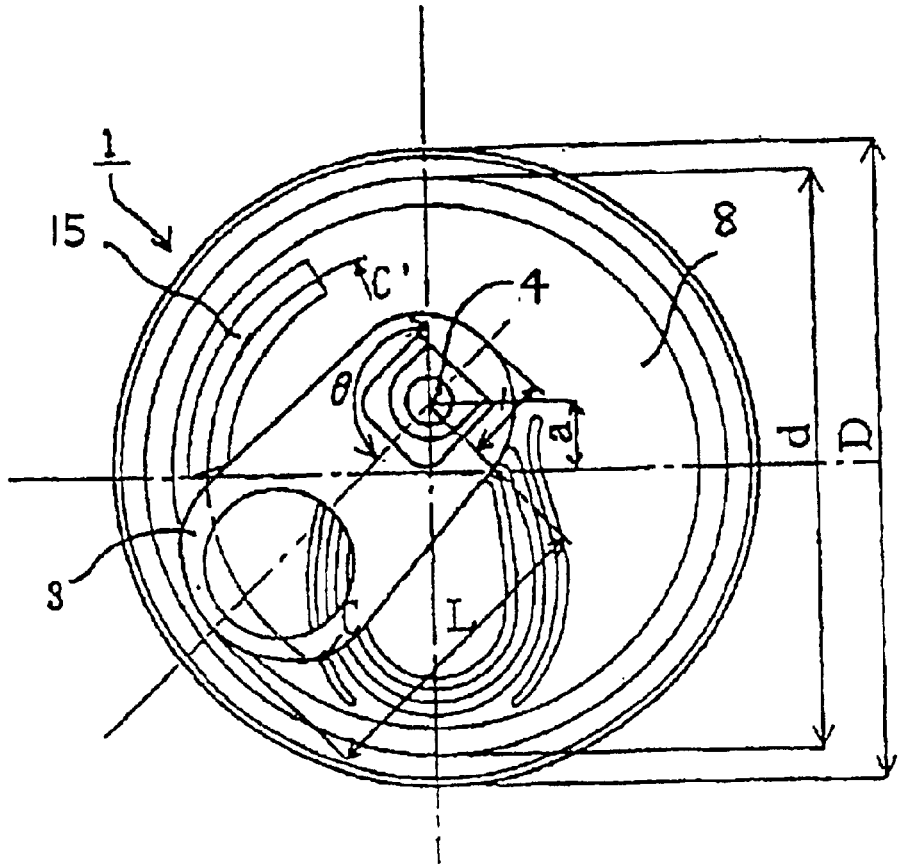
FIG. 40 is a plan view of a can end according to the Embodiment 9.

FIG. 40 shows a plan view of the easy-opening can end according to the present invention illustrating a mode thereof. In the figure, "a" denotes the off-set between the center of tab-fastening mean 4 and the center of can end 1, "L" denotes the distance between the center of tab-fastening mean 4 and the tip of the finger-picking section on the tab 3, "l" denotes the distance between the center of tab-fastening means 4 and the tip of working section of the tab 3, "θ" denotes the angle between the center line of tab before rotation and the center line after the rotation of the tab and before the opening of the can, "d" denotes the inner diameter of the can end 1, and "D" denotes the outer diameter of the can end 1.

According to the Embodiment 9, the center of the tab-fastening mean 4 is displaced by an off-set of "a" from the center of the can end 1 to opposite side of the can-opening section. The off-set of "a" is defined by the equation of $(D-d)/2<a<d/2-l$. The distance "L" between the center of the tab-fastening mean 4 and the tip of the finger-picking section on the tab 3 is limited by the equation: $d-l>L>d/2-a$ to extend longer than that in prior art, thus increasing the distance between the support point of lever work and the work point thereof, which increases the generated force at the work point compared with that in the prior art.

If, however, a tab-fastening mean is applied at the center of the can end 1 as in prior art, the whole tab cannot be held within the area of the central panel section, so the performance of stacking, storing, and transporting of cans is significantly degraded. In this regard, according to the present invention, the position of the tab-fastening mean 4 is moved from the center of the can end 1 to opposite side of the can opening section within a range of the equation: $(D-d)/2<a<d/2-l$, and the tab 3 is rotated by an angle of θ derived from the following equation around the tab-fastening mean 4.

$$-1<\cos\theta<1/(2\times a\times L)\times\{(d/2)^2-(L^2+a^2)\}$$

By moving the position of the tab-fastening mean 4 by "a" and by rotating the tab 3 by an angle of "θ", the total tab is able to be held inside of the area of the central panel section 8.

Figure 41:
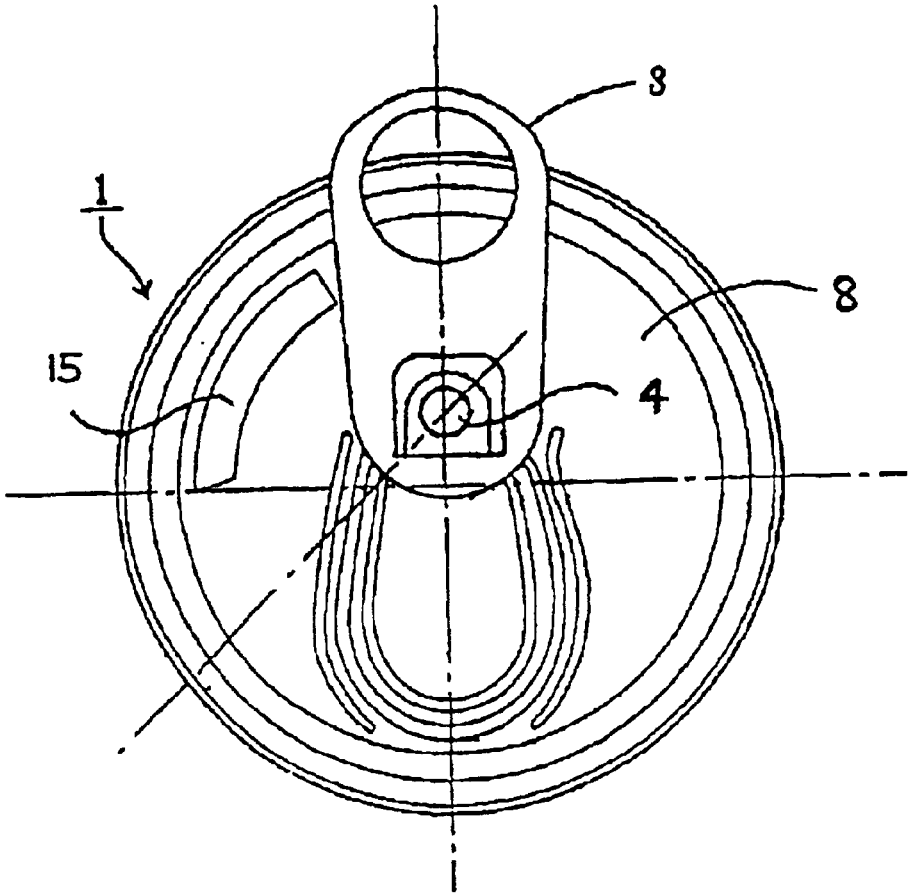
FIG. 41 is a plain view of can end after the tab rotation and immediately before the can opening according to the Embodiment 9.

In addition, as shown in FIG. 41, the tab 3 is rotated around the tab-fastening mean 4 from the disabled-opening position to the enabled-opening position during the can-opening step. With the simple rotation, however, the tab edge section collides against the seam section in the periphery of the can end to prevent further rotation of the tab 3. To solve the problem, a slope-shape protrusion 15 is formed on the center panel section 9. By pulling-up the tip of the tab 3 to above the height of the seam section, the tab 3 becomes possible to rotate to the enabled-opening position as seen in FIG. 41.

After the tab 3 is rotated to the enabled-opening position in this manner, the tab picking-up edge becomes outside of the outer periphery of the can end (or the outer periphery of the seam section) so that the finger picking and holding the tab 3 are easily done.

FIG. 40 uses a rivet as a means to hold the tab 3 in free-rotational angle movement. The means is, however, not limited to the rivet, and a tab-fastening mean material having the same construction may be attached to the central panel section using an adhesive. The shape of the tab 3 is preferably raised from the can end for easy angle movement and for easy finger picking.

The steel sheet used in the above-described method for manufacturing a can end is not specifically limited, and adequate kind of metal sheet may be adopted for individual objectives. An easy-opening can end is generally provided with a tab for opening the can. If a rivet mechanism is employed as the tab-attaching means, a preferable range of the work-hardening coefficient n of uniform elongation region is 0.15 or more from the viewpoint of rivet-formability. To suppress the damage of resin coating layer, smaller face-pressure for forming the score for opening the can is preferable. To do this, it is preferable to satisfy the following condition.

$$TS\times\{\exp(n)/(n^n)\}\times[2/\sqrt{33}\times|\ln(1+(t-t_0)/t_0\}|]^n\leqq 70$$

Furthermore, either the upper surface or the lower surface, or both sides of the steel sheet may be applied with various kinds of plating or chemical conversion treatment to assure corrosion resistance and adhesiveness with resin coating layer.

The kind of resin of resin coating layer formed on both sides of the steel sheet is not specifically limited, and it may be selected depending on the contents of the can to which the can end is attached and on the use environment. Different kind of resin may be applied to each of the upper surface and the lower surface of the can end. Although the thickness of resin coating layer is not specifically limited, to prevent degradation of corrosion resistance caused by damage occurred during the formation of score for opening the can, the thickness is necessary to be 5 μm or more, preferably 10 μm or more.

If a solid or liquid lubricant is applied on forming the score for opening the can onto the can end panel, the friction force between the dies and the resin coating layer reduces, and the shear force induced in the resin coating layer reduces, which suppresses the occurrence of separation of interface between the resin coating layer and the steel sheet and suppresses the degradation of corrosion resistance.

The above-described method for manufacturing can end is applicable to both the pull-top tab can end and the stay-on tab can end.

EXAMPLE 1

A tin-free steel sheet was prepared from a thin steel sheet having the values of thickness to ranging from 0.17 to 0.30 mm, the values of tensile strength TS ranging from 30 to 56 kfg/mm$^2$, and the values of work-hardening coefficient n in a range of from 40 to 90% of uniform elongation region ranging from 0.10 to 0.21 by forming a chromate coating layer on both sides thereof, which chromate coating layer consists of a chromated metal chromium layer with coating weights ranging from 100 to 120 mg/m$^2$ and of a top layer of chromium oxide hydrate with coating weights ranging from 14 to 18 mg/m$^2$ as metallic chromium. The prepared steel sheet was coated by polyester film of heat-fusion type on both sides thereof to thickness ranging from 15 to 30μm on both sides thereof.

Thus prepared steel sheet laminated with polyester film on both sides was formed into a can end panel. To the can end panel, a pair of dies both of which have a curved surface respectively having tip radius ranging from 0.1 to 1.0 mm, or one of which has a curved surface with tip radius ranging from 0.1 to 1.0 mm while the other has a flat surface were applied to prepare the stay-on tab easy-opening can ends Nos. 1 through 12 shown in Table 1 using the method according to the present invention employing the press-forming with or without using lubricant while regulating the values of thickness t of the steel sheet at the thinnest portion ranging from more than 5.0 to not more than 7.0 as P value, while attaching the tab 3 having a structure shown in FIG. 40 and with the relative position listed below. (Hereinafter these can ends are referred to as the examples of the present invention.)

Off-set between the center of tab-fastening mean and the center of can end (a): 5 mm Distance between the center of tab-fastening mean and the finger-picking section on the tab (L): 25 mm Distance between the center of tab-fastening mean and the tab working section (1): 10 mm Inner diameter of the can end (d): 49 mm Outer diameter of the can end (D): 53 mm

COMPARATIVE EXAMPLE 1

A can end panel fabricated from a film-laminated tin-free steel sheet which was prepared by applying chromate treatment and film-lamination treatment similar with those applied in Example 1 on both sides of a thin steel sheet having a thickness $t_0$ of 0.30 mm, the values of tensile strength TS ranging from 40 to 56 kfg/mm$^2$, and the values of work-hardening coefficient n in a range of from 40 to 90% of uniform elongation region ranging from 0.16 to 0.18, and by press-forming the plate by the dies described above with or without using lubricant giving P range outside of the specified one by the present invention as the sheet thickness t at the thinnest portion while attaching the tab 3 similar with that has the same structure according to the present invention as shown in FIG. 3, thus prepared the stay-on tab easy-opening can ends Nos. 13 through 15 shown also in Table 1 applying a method different from that of the present invention. (Hereinafter these can ends are referred to as the comparative examples of the present invention.)

COMPARATIVE EXAMPLE 2

A can end panel fabricated from a film-laminated tin-free steel sheet which was prepared by applying chromate treatment and film-lamination treatment similar with those applied in Example 1 on both sides of a thin steel sheet having the values of thickness $t_0$ ranging from 0.20 to 0.30 mm, the values of tensile strength TS ranging from 29 to 40 kfg/mm$^2$, and the values of work-hardening coefficient n in a range of from 40 to 90% of uniform elongation region ranging from 0.16 to 0.21, and by press-forming the plate with or without using lubricant giving P range inside of the specified one by the present invention as the steel sheet thickness at the thinnest portion while applying the dies having the tip radius outside of the range specified by the present invention, thus prepared the stay-on tab easy-opening can ends Nos. 16 through 20 shown also in Table 1 applying a method different from that of the present invention. (Hereinafter these can ends are referred also to as the comparative examples of the present invention.)

Regarding the can ends of above-described examples of the present invention and the comparative examples, the can-openability and the presence/absence of damage on resin coating layer were evaluated on the basis of criteria given below, and the result is shown in Table 1.

As for the can-openability, the Pop value (the force letting the opening section on the can end begin to open under a constant tensile force applied to the tab on the can end) was determined. When the observed Pop value is not higher than the maximum value (2.4 kg) observed on six kinds of commercially available aluminum alloy easy-opening can end, the test specimen is marked with (o). All the other test specimens are marked with (x). The damage on resin coating layer was evaluated by a corrosion test on the can end and based on the presence/absence of rust at and in the vicinity of score for opening the can on front and lower surfaces. The test specimen that generated no rust on both sides is marked with (o), and a test specimen that generated even a slight amount of rust either on upper surface or lower surface is marked with (x).

As seen in Table 14, the comparative examples Nos. 12 through 14 which were formed to give the P-value range of sheet thickness t at the thinnest portion of the score for opening the can was more than 7.0 gave poor can-openability. The comparative examples Nos. 15 through 19 which were prepared by press-forming using a pair of dies at least one of which has the tip radius outside of the range specified by the present invention generated rust at the score for opening the can during the corrosion test, and generated damage on resin coating layer.

To the contrary, all the examples of the present invention, Nos. 1 through 11, gave excellent can-openability, generated no rust on and in the vicinity of score for opening the can, and gave no damage on resin coating layer.

Regarding the evaluation of shock fracture of can ends, each of the can ends of the examples and the comparative examples was seamed around the respective can shell, and the can was dropped from 1 m above the concrete floor against the floor in a slanted position of the can facing the can end downward to apply a shock force to the can end. All the can ends tested showed no shock fracture.

TABLE 14

| No. | R (mm) | $t_0$ (mm) | t (mm) | TS kgf/mm$^2$ | n | P | Can opena-bility | Damage on resin coating layer | Remark |
|---|---|---|---|---|---|---|---|---|---|
| 1 | 0.1 | 0.298 | 0.10 | 30.2 | 0.205 | 5.4 | ○ | ○ | Example of the present invention |
| 2 | 0.5 | 0.298 | 0.10 | 35.4 | 0.172 | 5.9 | ○ | ○ | Example of the present invention |
| 3 | 0.5 | 0.199 | 0.10 | 40.4 | 0.111 | 5.6 | ○ | ○ | Example of the present invention |
| 4 | 1.0 | 0.298 | 0.08 | 40.4 | 0.178 | 5.7 | ○ | ○ | Example of the present invention |
| 5 | 0.1 | 0.298 | 0.08 | 44.9 | 0.183 | 6.4 | ○ | ○ | Example of the present invention |
| 6 | 0.5 | 0.199 | 0.08 | 50.2 | 0.106 | 5.7 | ○ | ○ | Example of the present invention |
| 7 | 0.5 | 0.298 | 0.06 | 55.5 | 0.174 | 6.0 | ○ | ○ | Example of the present invention |

TABLE 14-continued

| No. | R (mm) | $t_0$ (mm) | t (mm) | TS kgf/mm$^2$ | n | P | Can opena-bility | Damage on resin coating layer | Remark |
|---|---|---|---|---|---|---|---|---|---|
| 8 | 0.1 | 0.298 | 0.12 | 30.2 | 0.207 | 6.2 | ○ | ○ | Example of the present invention |
| 9 | 0.5 | 0.298 | 0.12 | 35.4 | 0.163 | 6.8 | ○ | ○ | Example of the present invention |
| 10 | 0.5 | 0.199 | 0.12 | 40.4 | 0.101 | 6.4 | ○ | ○ | Example of the present invention |
| 11 | 0.5 | 0.199 | 0.10 | 50.2 | 0.104 | 6.9 | ○ | ○ | Example of the present invention |
| 12 | 0.5 | 0.168 | 0.10 | 40.3 | 0.153 | 5.8 | ○ | ○ | Example of the present invention |
| 13 | 1.0 | 0.298 | 0.12 | 40.4 | 0.183 | 8.0 | X | ○ | Comparative example |
| 14 | 0.1 | 0.298 | 0.10 | 44.9 | 0.181 | 7.6 | X | ○ | Comparative example |
| 15 | 0.5 | 0.298 | 0.10 | 55.5 | 0.162 | 9.1 | X | ○ | Comparative example |
| 16 | 0.03 | 0.298 | 0.12 | 28.5 | 0.158 | 5.4 | ○ | X | Comparative example |
| 17 | 0.05 | 0.199 | 0.10 | 35.4 | 0.172 | 5.5 | ○ | X | Comparative example |
| 18 | 0.05 | 0.298 | 0.08 | 40.4 | 0.178 | 5.7 | ○ | X | Comparative example |
| 19 | 0.08 | 0.298 | 0.12 | 30.2 | 0.206 | 6.0 | ○ | X | Comparative example |
| 20 | 0.05 | 0.298 | 0.12 | 35.4 | 0.162 | 6.8 | ○ | X | Comparative example |

What is claimed is:

1. A method for making an easy-opening can end, comprising the step of:

(a) providing an upper die and a lower die, either the upper die or the lower die having a curved surface with a radius ranging from 0.1 to 1 mm at a tip portion thereof, the other die having a flat surface at the tip portion thereof;

(b) confronting the curved surface of the upper die or the lower die with a flat surface of the die; and (c) press-forming an end panel by using the upper die and the lower die to form scores on the upper surface or the lower surface of the end panel so that the end panel has a thickness of 0.025 to 0.08 mm at the thinnest portion thereof.

2. A method for making an easy-opening can end, comprising the step of:

(a) providing an upper die and a lower die, the upper die and the lower die having a curved surface with a radius ranging from over 0.025 to 1 mm at a tip portion thereof;

(b) confronting the curved surface of the upper die with the curved surface of the lower die; and (c) press-forming an end panel by using the upper die and the lower die to form scores on the upper surface and the lower surface of the end panel so that the end panel has a thickness of 0.025 to 0.08 mm at the thinnest portion thereof.

3. A method for making an easy-opening can end, comprising the step of:

(a) providing an end panel comprising a steel sheet and resin film layers on an upper surface and a lower surface of the steel sheet;

(b) providing an upper die and a lower die, at least one of the upper die and the lower die having a curved surface with a radius ranging from 0.1 to 1 mm at a tip portion thereof;

(c) confronting a surface at the tip portion of the upper die with a surface at the tip portion of the lower die; and (d) press-forming the end panel by using the upper die and the lower die to form scores on at least one surface of the upper surface and the lower surface of the end panel so that the end panel has a thickness of 0.025 to 0.08 mm at the thinnest portion thereof.

4. A method of claim 3, wherein the press-forming of the end panel is carried out by applying a lubricant to the end panel.

5. A method for making an easy-opening can end comprising the steps of:

providing a end panel comprising a metal sheet having a thickness of $t_0$ in mm, a work-hardening coefficient of n in a 40 to 90% range of uniform elongation region and a tensile strength of TS in kgf/mm$^2$;

providing an upper die and a lower die, either the upper die or the lower die having a curved surface with a radius of over 0.025 to 1 mm at the tip portion thereof, the other die having a flat surface at the tip portion thereof; and press-forming the end panel by using the upper die and the lower die to form scores on the upper surface or the lower surface of the end panel, the press-formed can end panel having a thickness t in mm at the thinnest portion thereof, the thickness t in mm which satisfies the following equations:

$$2.5 \leqq P \leqq 5.0$$

$$P = t \times TS \times \{\exp(n)/(n^n)\} \times [2/\sqrt{3} \times |\ln(1+(t-t_0)/t_0\}|]^n.$$

6. A method of claim 5, wherein the press-forming of the end panel is carried out by applying a lubricant to the end panel.

7. A method for making an easy-opening can end comprising the steps of:

providing a end panel comprising a metal sheet having a thickness of $t_0$ in mm, a work-hardening coefficient of n in a 40 to 90% range of a uniform elongation region and a tensile strength of TS in kgf/mm$^2$;

providing an upper die and a lower die, the upper die and the lower die having a curved surface with a radius ranging from over 0.025 to 1 mm at the tip portion thereof; and press-forming the end panel by using the upper die and the lower die to form scores on the upper surface or the lower surface of the end panel, the press-formed can end panel having a thickness t in mm at the thinnest portion thereof, the thickness t in mm which satisfies the following equations:

$$2.5 \leqq P \leqq 5.0$$

$$P = t \times TS \times \{\exp(n)/(n^n)\} \times [2/\sqrt{3} \times |\ln(1+(t-t_0)/t_0\}|]^n.$$

8. A method of claim 7, wherein the press-forming of the end panel is carried out by applying a lubricant to the end panel.

9. A method for making an easy-opening can end comprising the steps of:

providing a end panel comprising a steel sheet having a thickness of $t_0$ in mm, a work-hardening coefficient of n in a 40 to 90% range of uniform elongation region and a tensile strength of TS in kgf/mm$^2$ and resin film layers on both sides of the steel sheet;

providing an upper die and a lower die, either the upper die or the lower die having a curved surface with a radius ranging from over 0.1 to 1 mm at the tip portion thereof, the other die having a flat surface at the tip portion thereof; and press-forming the end panel by using the upper die and the lower die to form scores on the upper surface or the lower surface of the end panel, the press-formed can end panel having a thickness t in mm at the thinnest portion thereof, the thickness t in mm which satisfies the following equations:

$$2.5 \leqq P \leqq 5.0$$

$$P = t \times TS \times \{\exp(n)/(n^n)\} \times [2/\sqrt{3} \times |\ln(1+(t-t_0)/t_0\}|]^n.$$

10. A method of claim 9, wherein the press-forming of the end panel is carried out by applying a lubricant to the end panel.

11. A method for making an easy-opening can end comprising the steps of:

providing a end panel comprising a steel sheet having a thickness of $t_0$ in mm, a work-hardening coefficient of n in a 40 to 90% range of uniform elongation region and a tensile strength of TS in kgf/mm$^2$ and resin film layers on both sides of the steel sheet;

providing an upper die and a lower die, the upper die and the lower die having a curved surface with a radius ranging from over 0.1 to 1 mm at the tip portion thereof; and press-forming the end panel by using the upper die and the lower die to form scores on the upper surface and the lower surface of the end panel, the press-formed can end panel having a thickness t in mm at the thinnest portion thereof, the thickness t i mm which satisfies the following equations:

$$2.5 \leqq P \leqq 5.0$$

$$P = t \times TS \times \{\exp(n)/(n^n)\} \times [2/\sqrt{3} \times |\ln(1+(t-t_0)/t_0\}|]^n.$$

12. A method of claim 11, wherein the press-forming of the end panel is carried out by applying a lubricant to the end panel.

13. A method for making an easy-opening can end comprising the steps of:

providing a end panel comprising a metal sheet having a thickness of $t_0$ in mm, a work-hardening coefficient of n in a 40 to 90% range of uniform elongation region and a tensile strength of TS in kgf/mm$^2$;

providing an upper die and a lower die, either the upper die or the lower die having a curved surface with a radius of over 0.025 to 1 mm at the tip portion thereof, the other die having a flat surface at the tip portion thereof;

press-forming the end panel by using the upper die and the lower die to form scores on the upper surface or the lower surface of the end panel, the press-formed can end panel having a thickness t in mm at the thinnest portion thereof, the thickness t in mm which satisfies the following equations:

$$2.5 \leqq P \leqq 5.0$$

$$P = t \times TS \times \{\exp(n)/(n^n)\} \times [2/\sqrt{3} \times |\ln(1+(t-t_0)/t_0\}|]^n,$$

attaching a tab having a finger grasping portion to the can end panel rotatably around tab-fastening means;

said tab-fastening means being positioned offset by a distance "a" expressed in the following equation from the center of the can end to the opposite side of an openable section:

$$(D-d)/2 < a < d/2 - l,$$

said finger grasping portion having a distance "L" from the tab-fastening means, the distance "L" being defined by the following equation:

$$d - l > L > d/2 - a,$$

the tab having a first center line before rotation thereof and a second center line at an opening position, the first center line and the second line having an angle "θ" therebetween which is within a range defined by the equation:

$$-1 < \cos\theta < 1/(2 \times a \times L) \times (d/2)^2 - (L^2 + a^2)\},$$

and arranging a slope protrusion for lifting the tab to above a height of a seam portion when the tab is rotated to a position for allowing the can open; wherein a is a distance between the center of the tab-fastening means and the center of can end, L is a distance between the center of the tab-fastening means and the finger grasping portion on the tab, l is a distance between the center of the tab-fastening means and a tab working section, θ angle between the center line of tab before rotation and the center line at opening position, d is an inner diameter of the can end, D is an outer diameter of the can end.

14. A method of claim 13, wherein the press-forming of the end panel is carried out by applying a lubricant to the end panel.

15. A method for making an easy-opening can end comprising the steps of:

providing a end panel comprising a metal sheet having a thickness of $t_0$ in mm, a work-hardening coefficient of n in a 40 to 90% range of uniform elongation region and a tensile strength of TS in kgf/mm$^2$;

providing an upper die and a lower die, the upper die and the lower die having a curved surface with a radius ranging from over 0.025 to 1 mm at the tip portion thereof;

press-forming the end panel by using the upper die and the lower die to form scores on the upper surface or the lower surface of the end panel, the press-formed can end panel having a thickness t in mm at the thinnest portion thereof, the thickness t in mm which satisfies the following equations:

$$5<P\leqq 7.0$$

$$P=t\times TS\times\{\exp(n)/(n^n)\}\times[2/\sqrt{3}\times|\ln(1+(t-t_0)/t_0\}|]^n,$$

attaching a tab having a finger grasping portion to the can end panel rotatably around tab-fastening means;

said tab-fastening means being positioned offset by a distance "a" expressed in the following equation from the center of the can end to the opposite side of an openable section:

$$(D-d)/2<a<d/2-l,$$

said finger grasping portion having a distance "L" from the tab-fastening means, the distance "L" being defined by the following equation:

$$d-l>L>d/2-a,$$

the tab having a first center line before rotation thereof and a second center line at an opening position, the first center line and the second line having an angle "θ" therebetween which is within a range defined by the equation:

$$-1<\cos\theta<1/(2\times a\times L)\times\{(d/2)^2-(L^2+a^2)\},$$

and arranging a slope protrusion for lifting the tab to above a height of a seam portion when the tab is rotated to a position for allowing the can open; wherein a is a distance between the center of the tab-fastening means and the center of can end, L is a distance between the center of the tab-fastening means and the finger grasping portion on the tab, l is a distance between the center of the tab-fastening means and a tab working section, θ angle between the center line of tab before rotation and the center line at opening position, d is an inner diameter of the can end, D is an outer diameter of the can end.

16. A method of claim 15, wherein the press-forming of the end panel is carried out by applying a lubricant to the end panel.

17. A method for making an easy-opening can end comprising the steps of:

providing a end panel comprising a metal sheet having a thickness of $t_0$ in mm, a work-hardening coefficient of n in a 40 to 90% range of uniform elongation region and a tensile strength of TS in kgf/mm$^2$ and resin film layers on both sides of the steel sheet;

providing an upper die and a lower die, either the upper die or the lower die having a curved surface with a radius of 0.1 to 1 mm at the tip portion thereof, the other die having a flat surface at the tip portion thereof;

press-forming the end panel by using the upper die and the lower die to form scores on the upper surface or the lower surface of the end panel, the press-formed can end panel having a thickness t in mm at the thinnest portion thereof, the thickness t in mm satisfying the following equations:

$$5<P\leqq 7.0$$

$$P=t\times TS\times\{\exp(n)/(n^n)\}\times[2/\sqrt{3}\times|\ln(1+(t-t_0)/t_0\}|]^n,$$

attaching a tab having a finger grasping portion to the can end panel rotatably around tab-fastening means;

said tab-fastening means being positioned offset by a distance "a" expressed in the following equation from the center of the can end to the opposite side of an openable section:

$$(D-d)/2<a<d/2-l,$$

said finger grasping portion having a distance "L" from the tab-fastening means, the distance "L" being defined by the following equation:

$$d-l>L>d/2-a,$$

the tab having a first center line before rotation thereof and a second center line at an opening position, the first center line and the second line having an angle "θ" therebetween which is within a range defined by the equation:

$$-1<\cos\theta<1/(2\times a\times L)\times\{(d/2)^2-(L^2+a^2)\},$$

and arranging a slope protrusion for lifting the tab to above a height of a seam portion when the tab is rotated to a position for allowing the can open, wherein a is a distance between the center of the tab-fastening means and the center of can end, L is a distance between the center of the tab-fastening means and the finger grasping portion on the tab, l is a distance between the center of the tab-fastening means and a tab working section, θ is an angle between the center line of tab before rotation and the center line at opening position, d is an inner diameter of the can end, and D is an outer diameter of the can end.

18. A method of claim 17, wherein the press-forming of the end panel is carried out by applying a lubricant to the end panel.

19. A method for making an easy-opening can end comprising the steps of:

providing a end panel comprising a metal sheet having a thickness of $t_0$ in mm, a work-hardening coefficient of n in a 40 to 90% range of uniform elongation region and a tensile strength of TS in kgf/mm$^2$ and resin film layers on both sides of the steel sheet;

providing an upper die and a lower die, the upper die and the lower die having a curved surface with a radius of over 0.1 to 1 mm at the tip portion thereof;

press-forming the end panel by using the upper die and the lower die to form scores on the upper surface and the lower surface of the end panel, the press-formed can end panel having a thickness t in mm at the thinnest portion thereof, the thickness t in mm satisfying the following equations:

$$5<P\leqq 7.0$$

$$P=t\times TS\times\{\exp(n)/(n^n)\}\times[2/\sqrt{3}\times|\ln(1+(t-t_0)/t_0\}|]^n,$$

attaching a tab having a finger grasping portion to the can end panel rotatably around tab-fastening means;

said tab-fastening means being positioned offset by a distance "a" expressed in the following equation from the center of the can end to the opposite side of an openable section:

$$(D-d)/2<a<d/2-l,$$

said finger grasping portion having a distance "L" from the tab-fastening means, the distance "L" being defined by the following equation:

$$d-l>L>d/2-a,$$

the tab having a first center line before rotation thereof and a second center line at an opening position, the first center line and the second line having an angle "θ" therebetween which is within a range defined by the equation $$-1<\cos\theta<1/(2\times a\times L)\times\{(d/2)^2-(L^2+a^2)\},$$

and arranging a slope protrusion for lifting the tab to above a height of a seam portion when the tab is rotated to a position for allowing the can open; wherein a is a distance between the center of the tab-fastening means and the center of can end, L is a distance between the center of the tab-fastening means and the finger grasping portion on the tab, l is a distance between the center of the tab-fastening means and a tab working section, θ angle between the center line of tab before rotation and the center line at opening position, d is an inner diameter of the can end, and D is an outer diameter of the can end.

20. A method of claim 19, wherein the press-forming of the end panel is carried out by applying a lubricant to the end panel.

* * * * *